US007755506B1

(12) United States Patent
Clegg et al.

(10) Patent No.: US 7,755,506 B1
(45) Date of Patent: Jul. 13, 2010

(54) AUTOMATION AND THEATER CONTROL SYSTEM

(75) Inventors: Paul T. Clegg, Lindon, UT (US); Jared Meiners, Lehi, UT (US); Scott C. Losee, Santaquin, UT (US); Douglas E. Allen, Lindon, UT (US); Michelle Chatterton, Lindon, UT (US); Jared T. Lemke, Pleasant Grove, UT (US); James Beagley, Herriman, UT (US)

(73) Assignee: Legrand Home Systems, Inc., Middletown, PA (US)

( * ) Notice: Subject to any disclaimer, the term of this patent is extended or adjusted under 35 U.S.C. 154(b) by 1709 days.

(21) Appl. No.: 10/934,115

(22) Filed: Sep. 3, 2004

Related U.S. Application Data

(60) Provisional application No. 60/500,066, filed on Sep. 3, 2003.

(51) Int. Cl.
*G08C 19/20* (2006.01)

(52) U.S. Cl. ..... 340/825.72; 340/825.69; 340/825.22; 340/3.1; 341/176

(58) Field of Classification Search ..... 340/825.72, 340/825.69, 825.22, 3.1; 341/176; 398/106, 398/107, 111, 112, 115; 315/391
See application file for complete search history.

(56) References Cited

U.S. PATENT DOCUMENTS

| | | | |
|---|---|---|---|
| 2,482,773 | A | 9/1949 | Hieronymus |
| D163,736 | S | 6/1951 | Bangert, Jr. |
| 2,828,413 | A | 3/1958 | Bowers et al. |
| 2,853,585 | A | 9/1958 | Danziger et al. |
| 3,284,667 | A | 11/1966 | Harris et al. |
| 3,491,249 | A | 1/1970 | Rabinow |
| 3,579,030 | A | 5/1971 | Bentham et al. |
| 3,689,886 | A | 9/1972 | Durkee |
| 3,697,821 | A | 10/1972 | Johnson |
| 3,706,914 | A | 12/1972 | Van Buren |

(Continued)

FOREIGN PATENT DOCUMENTS

| | | |
|---|---|---|
| CA | 2 245 671 | 9/2003 |

(Continued)

OTHER PUBLICATIONS

Horowitz et al., The Art of Electronics, 1989, Cambridge University Press, 2nd Ed., pp. 595-598.

(Continued)

*Primary Examiner*—Edwin C Holloway, III
(74) *Attorney, Agent, or Firm*—McCarter & English, LLP

(57) ABSTRACT

An integrated controller for complete automation with the ability to control electrical devices through both RF transmission and IR transmissions. In one illustrative embodiment, the integrated controller comprises an antenna for two-way communication with stations located throughout a structure. Each station may control the power supply to an attached electrical device. The buttons on the station may control any electrical device on the system through RF transmission with the integrated controller. The integrated controller also may comprise an IR receiver and at least one IR output. The IR receiver may receive signals from a remote and pass them through to a device, such as a device used in a home theater system, with a built in IR receiver via the IR output. In this manner, the integrated controller is capable of providing complete in home automation.

37 Claims, 31 Drawing Sheets

U.S. PATENT DOCUMENTS

| | | | |
|---|---|---|---|
| 3,707,682 | A | 12/1972 | Harris |
| 3,736,591 | A | 5/1973 | Rennels et al. |
| 3,746,923 | A | 7/1973 | Spira et al. |
| 3,763,394 | A | 10/1973 | Blanchard |
| 3,784,875 | A | 1/1974 | Baker et al. |
| 3,867,596 | A | 2/1975 | Schadow |
| 3,868,546 | A | 2/1975 | Gilbreath et al. |
| 3,868,547 | A | 2/1975 | Kappenhagen et al. |
| 3,885,116 | A | 5/1975 | Kodaira |
| 3,918,062 | A | 11/1975 | Haruki et al. |
| 3,940,660 | A | 2/1976 | Edwards |
| 3,980,954 | A | 9/1976 | Whyte |
| 3,986,423 | A | 10/1976 | Rossum |
| 3,996,441 | A | 12/1976 | Ohashi |
| 4,016,561 | A | 4/1977 | Parker et al. |
| 4,057,751 | A | 11/1977 | Bonsignore et al. |
| 4,060,735 | A | 11/1977 | Pascucci et al. |
| 4,095,139 | A | 6/1978 | Symonds et al. |
| D249,141 | S | 8/1978 | Mayo |
| 4,123,756 | A | 10/1978 | Nagata et al. |
| 4,131,777 | A | 12/1978 | Bailey et al. |
| 4,156,866 | A | 5/1979 | Miller |
| 4,163,218 | A | 7/1979 | Wu |
| 4,169,972 | A | 10/1979 | Black, III et al. |
| 4,185,531 | A | 1/1980 | Oberheim et al. |
| 4,187,528 | A | 2/1980 | Morriss |
| 4,194,099 | A | 3/1980 | Mickelson |
| 4,196,388 | A | 4/1980 | Weller et al. |
| 4,200,862 | A | 4/1980 | Campbell et al. |
| 4,203,096 | A | 5/1980 | Farley et al. |
| 4,206,443 | A | 6/1980 | Britton |
| 4,225,808 | A | 9/1980 | Saraceni |
| 4,246,494 | A | 1/1981 | Foreman et al. |
| 4,253,048 | A | 2/1981 | Osako |
| 4,259,619 | A | 3/1981 | Wall |
| 4,262,180 | A | 4/1981 | Walter |
| 4,274,045 | A | 6/1981 | Goldstein |
| 4,277,727 | A | 7/1981 | LeVert |
| 4,300,090 | A | 11/1981 | Weber |
| 4,303,811 | A | 12/1981 | Parkinson |
| 4,334,171 | A | 6/1982 | Parman et al. |
| 4,336,464 | A | 6/1982 | Weber |
| 4,338,595 | A | 7/1982 | Newman |
| 4,339,632 | A | 7/1982 | Early et al. |
| 4,359,670 | A | 11/1982 | Hosaka et al. |
| 4,381,456 | A | 4/1983 | Saito et al. |
| 4,388,567 | A | 6/1983 | Yamazaki et al. |
| 4,390,814 | A | 6/1983 | Peek |
| 4,392,187 | A | 7/1983 | Bornhorst |
| 4,395,660 | A | 7/1983 | Waszkiewicz |
| 4,418,333 | A | 11/1983 | Schwarzbach et al. |
| 4,421,966 | A | 12/1983 | Pounds |
| 4,436,972 | A | 3/1984 | Scanlon |
| 4,437,169 | A | 3/1984 | Bertenshaw et al. |
| 4,455,546 | A | 6/1984 | Roszel |
| 4,463,287 | A | 7/1984 | Pitel |
| 4,468,542 | A | 8/1984 | Pounds |
| 4,471,493 | A | 9/1984 | Schober |
| 4,484,190 | A | 11/1984 | Bedard |
| 4,485,374 | A | 11/1984 | Meserow et al. |
| 4,489,385 | A | 12/1984 | Miller et al. |
| 4,491,843 | A | 1/1985 | Boubouleix |
| 4,504,778 | A | 3/1985 | Evans |
| 4,521,843 | A | 6/1985 | Pezzolo et al. |
| 4,523,132 | A | 6/1985 | Christiansen et al. |
| 4,524,288 | A | 6/1985 | Schimmelpennink et al. |
| 4,527,198 | A | 7/1985 | Callahan |
| 4,532,395 | A | 7/1985 | Zukowski |
| 4,540,917 | A | 9/1985 | Luchaco et al. |
| 4,550,276 | A | 10/1985 | Callahan et al. |
| 4,560,909 | A | 12/1985 | Peil |
| 4,563,592 | A | 1/1986 | Yuhasz et al. |
| 4,575,660 | A | 3/1986 | Zaharchuck et al. |
| 4,582,967 | A | 4/1986 | Brumit et al. |
| 4,590,614 | A | 5/1986 | Erat |
| D285,066 | S | 8/1986 | Liss et al. |
| 4,611,198 | A | 9/1986 | Levinson et al. |
| 4,628,440 | A | 12/1986 | Thompson |
| 4,631,377 | A | 12/1986 | Imazeki et al. |
| 4,635,040 | A | 1/1987 | Masot |
| 4,638,299 | A | 1/1987 | Campbell |
| 4,644,320 | A | 2/1987 | Carr et al. |
| 4,680,536 | A | 7/1987 | Roszel et al. |
| 4,684,822 | A | 8/1987 | Angott |
| 4,689,547 | A | 8/1987 | Rowen et al. |
| 4,691,341 | A | 9/1987 | Knoble et al. |
| 4,695,820 | A | 9/1987 | D'Aleo et al. |
| 4,697,227 | A | 9/1987 | Callahan |
| 4,703,306 | A | 10/1987 | Barritt |
| 4,714,983 | A | 12/1987 | Lang |
| 4,716,409 | A | 12/1987 | Hart et al. |
| 4,719,446 | A | 1/1988 | Hart |
| 4,727,296 | A | 2/1988 | Zaharchuk et al. |
| 4,728,949 | A | 3/1988 | Platte et al. |
| 4,737,769 | A | 4/1988 | Masot |
| 4,745,351 | A | 5/1988 | Rowen et al. |
| 4,749,917 | A | 6/1988 | Angott et al. |
| 4,751,385 | A | 6/1988 | Van Benthusysen et al. |
| 4,755,792 | A | 7/1988 | Pezzolo et al. |
| 4,764,981 | A | 8/1988 | Miyahara et al. |
| 4,772,824 | A | 9/1988 | Gulledge |
| 4,772,825 | A | 9/1988 | Tabor et al. |
| 4,783,581 | A | 11/1988 | Flowers et al. |
| 4,792,731 | A | 12/1988 | Pearlman et al. |
| 4,797,599 | A | 1/1989 | Ference et al. |
| 4,814,776 | A | 3/1989 | Caci et al. |
| 4,823,069 | A | 4/1989 | Callahan et al. |
| 4,825,209 | A | 4/1989 | Sasaki et al. |
| 4,843,386 | A | 6/1989 | Wolf |
| 4,864,588 | A | 9/1989 | Simpson et al. |
| 4,876,552 | A | 10/1989 | Zakman |
| 4,878,010 | A | 10/1989 | Weber |
| 4,880,950 | A | 11/1989 | Carson et al. |
| 4,889,999 | A | 12/1989 | Rowen |
| 4,893,062 | A | 1/1990 | D'Aleo et al. |
| 4,908,806 | A | 3/1990 | Nickolaus |
| 4,918,432 | A | 4/1990 | Pauley et al. |
| 4,918,717 | A | 4/1990 | Bissonnette et al. |
| 4,924,109 | A | 5/1990 | Weber |
| 4,924,151 | A | 5/1990 | D'Aleo et al. |
| 4,940,903 | A | 7/1990 | Brown, Jr. et al. |
| D310,249 | S | 8/1990 | LaLonde |
| 4,948,987 | A | 8/1990 | Weber |
| 4,955,084 | A | 9/1990 | Umetsu et al. |
| D311,382 | S | 10/1990 | Mayo et al. |
| D311,485 | S | 10/1990 | Jacoby et al. |
| D311,678 | S | 10/1990 | Graef et al. |
| 4,980,806 | A | 12/1990 | Taylor et al. |
| D313,738 | S | 1/1991 | Mayo et al. |
| 4,995,053 | A | 2/1991 | Simpson et al. |
| 5,003,318 | A | 3/1991 | Berneking et al. |
| 5,012,225 | A | 4/1991 | Gill |
| 5,017,837 | A | 5/1991 | Hanna et al. |
| 5,027,106 | A | 6/1991 | Lizzi et al. |
| 5,028,853 | A | 7/1991 | Brown, Jr. et al. |
| 5,030,893 | A | 7/1991 | Spira et al. |
| 5,034,602 | A | 7/1991 | Garcia, Jr. et al. |
| D319,429 | S | 8/1991 | D'Aleo et al. |
| 5,041,825 | A | 8/1991 | Hart et al. |
| 5,051,720 | A | 9/1991 | Kittirutsunetorn |
| 5,059,871 | A | 10/1991 | Pearlman et al. |
| 5,079,559 | A | 1/1992 | Umetsu et al. |
| 5,086,385 | A | 2/1992 | Launey et al. |
| 5,097,249 | A * | 3/1992 | Yamamoto ..... 340/538.17 |

5,099,193 A 3/1992 Moseley et al.
5,103,209 A 4/1992 Lizzi et al.
5,109,222 A 4/1992 Welty
5,113,498 A 5/1992 Evan et al.
D327,255 S 6/1992 D'Aleo et al.
5,128,855 A 7/1992 Hilber et al.
5,146,153 A 9/1992 Luchaco et al.
5,175,477 A 12/1992 Grissom
5,187,655 A 2/1993 Post et al.
5,189,412 A 2/1993 Mehta et al.
5,191,265 A 3/1993 D'Aleo et al.
5,209,560 A 5/1993 Taylor et al.
5,225,765 A 7/1993 Callahan et al.
5,237,264 A 8/1993 Moseley et al.
5,239,205 A 8/1993 Hoffman et al.
5,247,293 A 9/1993 Nakagawa
5,248,919 A 9/1993 Hanna et al.
5,280,296 A 1/1994 Tan et al.
D344,264 S 2/1994 D'Aleo et al.
5,311,656 A 5/1994 Eldershaw
5,321,736 A 6/1994 Beasley
5,327,426 A 7/1994 Dolin, Jr. et al.
5,340,954 A 8/1994 Hoffman et al.
5,349,362 A 9/1994 Forbes et al.
5,357,170 A 10/1994 Luchaco et al.
5,361,184 A 11/1994 El-Sharkawi et al.
5,361,985 A 11/1994 Rein et al.
5,367,133 A 11/1994 Schmidt et al.
5,373,411 A 12/1994 Grass et al.
5,382,947 A 1/1995 Thaler et al.
5,399,940 A 3/1995 Hanna et al.
5,400,041 A 3/1995 Strickland
5,400,246 A 3/1995 Wilson et al.
5,401,927 A 3/1995 Lundell et al.
5,414,426 A * 5/1995 O'Donnell et al. ..... 341/176
5,430,356 A 7/1995 Ference et al.
5,436,510 A 7/1995 Gilbert
5,452,291 A 9/1995 Eisenhandler et al.
5,455,464 A 10/1995 Gosling
5,455,761 A 10/1995 Kushiro et al.
5,463,286 A 10/1995 D'Aleo et al.
5,467,264 A 11/1995 Rauch et al.
5,473,202 A 12/1995 Mudge et al.
5,481,750 A 1/1996 Parise et al.
5,490,144 A 2/1996 Tran et al.
5,495,406 A 2/1996 Kushiro et al.
5,523,631 A 6/1996 Fishman et al.
5,555,150 A 9/1996 Newman, Jr.
5,563,459 A 10/1996 Kurosawa et al.
5,565,855 A 10/1996 Knibbe
5,565,865 A 10/1996 So
5,574,431 A 11/1996 McKeown et al.
5,588,760 A 12/1996 So
5,598,322 A 1/1997 Von Arx et al.
5,637,930 A 6/1997 Rowen et al.
5,638,296 A 6/1997 Johnson et al.
5,640,141 A 6/1997 Myllymäki
5,657,005 A 8/1997 Seebeck et al.
5,668,358 A 9/1997 Wolf et al.
5,711,588 A 1/1998 Rudisill
5,726,644 A 3/1998 Jednacz et al.
5,736,965 A 4/1998 Mosebrook et al.
5,748,828 A 5/1998 Steiner et al.
5,751,224 A * 5/1998 Fitzgibbon ..... 340/825.72
5,796,382 A 8/1998 Beeteson
5,801,345 A 9/1998 Mikula-Curtis et al.
5,802,467 A * 9/1998 Salazar et al. ..... 455/420
5,812,293 A * 9/1998 Yen ..... 398/115
5,861,809 A 1/1999 Eckstein et al.
5,905,442 A 5/1999 Mosebrook et al.
5,912,443 A 6/1999 Hasunuma
5,960,942 A 10/1999 Thornton
5,962,109 A 10/1999 Schwietz
5,975,711 A 11/1999 Parker et al.
5,977,901 A 11/1999 Fenner
5,982,103 A 11/1999 Mosebrook et al.
6,032,202 A 2/2000 Lea et al.
6,080,940 A 6/2000 Rice
6,091,205 A 7/2000 Newman, Jr. et al.
6,092,903 A 7/2000 Higgins, Jr.
6,100,659 A 8/2000 Will et al.
6,140,987 A 10/2000 Stein et al.
6,169,256 B1 1/2001 Hanahara et al.
6,180,895 B1 1/2001 Hutchinson et al.
6,184,481 B1 2/2001 Chen
6,192,282 B1 2/2001 Smith et al.
6,199,136 B1 3/2001 Shteyn
6,201,364 B1 3/2001 Will et al.
6,207,913 B1 3/2001 Nakajima et al.
6,229,433 B1 * 5/2001 Rye et al. ..... 340/310.12
6,233,132 B1 5/2001 Jenski
6,310,609 B1 10/2001 Morgenthaler
6,331,687 B1 12/2001 Dunk et al.
6,355,890 B1 3/2002 Kuroda
6,359,562 B2 3/2002 Rubin
6,369,524 B1 4/2002 Sid
6,369,800 B1 4/2002 Nading et al.
6,400,271 B1 6/2002 Davies, Jr. et al.
6,400,968 B1 * 6/2002 White et al. ..... 455/572
D461,782 S 8/2002 Butler et al.
6,453,687 B2 9/2002 Sharood et al.
6,467,924 B2 10/2002 Shipman
6,493,874 B2 12/2002 Humpleman
6,510,995 B2 1/2003 Muthu et al.
6,523,696 B1 2/2003 Saito et al.
6,549,190 B1 4/2003 Windrem
6,555,774 B1 4/2003 Nielsen
6,575,607 B1 6/2003 Klemish et al.
6,593,530 B2 7/2003 Hunt
6,608,271 B2 8/2003 Duarte
6,618,764 B1 9/2003 Shteyn
6,640,141 B2 10/2003 Bennett
6,646,843 B1 11/2003 Newman, Jr. et al.
6,674,248 B2 1/2004 Newman, Jr. et al.
6,680,730 B1 1/2004 Shields et al.
6,753,661 B2 6/2004 Muthu et al.
6,774,328 B2 8/2004 Adams et al.
6,797,902 B2 9/2004 Farage et al.
6,882,111 B2 4/2005 Kan et al.
6,909,424 B2 6/2005 Liebenow et al.
6,931,364 B1 8/2005 Anturna
6,950,087 B2 9/2005 Knox et al.
6,965,848 B2 11/2005 Ballus
6,967,448 B2 11/2005 Morgan et al.
6,967,565 B2 11/2005 Lingemann
7,111,952 B2 * 9/2006 Veskovic ..... 362/1
7,130,774 B2 10/2006 Thomas et al.
2001/0000422 A1 4/2001 Sid
2001/0047250 A1 11/2001 Schuller et al.
2001/0047251 A1 11/2001 Kemp
2001/0055003 A1 12/2001 Chi et al.
2002/0016639 A1 2/2002 Smith et al.
2002/0026533 A1 2/2002 Dutta et al.
2002/0037004 A1 3/2002 Bossemeyer et al.
2003/0009315 A1 1/2003 Thomas et al.
2003/0012035 A1 1/2003 Bernard
2003/0052770 A1 3/2003 Mansfield, Jr. et al.
2003/0056012 A1 3/2003 Modeste et al.
2003/0129969 A1 7/2003 Rucinski
2003/0164787 A1 * 9/2003 Dresti et al. ..... 341/176
2003/0227894 A1 12/2003 Wang et al.
2003/0233429 A1 12/2003 Matte et al.
2004/0024624 A1 2/2004 Ciscon et al.
2004/0037288 A1 2/2004 Bourgart et al.
2004/0038683 A1 2/2004 Rappaport et al.
2004/0054747 A1 3/2004 Breh et al.

| | | | |
|---|---|---|---|
| 2004/0088082 | A1 | 5/2004 | Ahmed |
| 2004/0113945 | A1 | 6/2004 | Park et al. |
| 2004/0143428 | A1 | 7/2004 | Rappaport et al. |
| 2004/0225811 | A1 | 11/2004 | Fosler |
| 2004/0267385 | A1 | 12/2004 | Lingemann |

FOREIGN PATENT DOCUMENTS

| | | | |
|---|---|---|---|
| DE | 30 08 339 | A1 | 9/1981 |
| DE | 30 12 840 | A1 | 10/1981 |
| DE | 32 21 873 | A1 | 1/1984 |
| DE | 32 24 997 | A1 | 1/1984 |
| DE | 219 637 | A1 | 3/1985 |
| DE | 43 08 161 | A1 | 9/1994 |
| DE | 103-06-080 | A1 | 8/2004 |
| EP | 0 022 516 | | 1/1981 |
| EP | 0 040 339 | | 11/1981 |
| EP | 0 054 582 | | 6/1982 |
| EP | 0 196 347 | | 10/1986 |
| EP | 0 293 569 | | 12/1988 |
| EP | 0 327 128 | | 8/1989 |
| EP | 0 346 614 | | 12/1989 |
| EP | 0 357 136 | | 3/1990 |
| EP | 0 361 734 | | 4/1990 |
| EP | 0 435 224 | | 7/1991 |
| EP | 0 466 152 | | 1/1992 |
| EP | 0 513 443 | | 11/1992 |
| EP | 0 552 769 | | 7/1993 |
| EP | 0 555 869 | | 8/1993 |
| EP | 0 558 349 | | 9/1993 |
| EP | 0 616 451 | | 9/1994 |
| EP | 0 626 635 | | 11/1994 |
| EP | 0 687 078 | | 12/1995 |
| FR | 2 701 115 | | 9/1994 |
| GB | 1090891 | | 11/1967 |
| GB | 1 215 009 | | 12/1970 |
| GB | 2 076 180 | | 11/1981 |
| GB | 2 097 918 | | 11/1982 |
| GB | 2 099 222 | | 12/1982 |
| GB | 2 166 328 | | 4/1986 |
| WO | WO-86/06890 | | 11/1986 |
| WO | WO-90/08418 | | 7/1990 |
| WO | WO-93/13507 | | 7/1993 |
| WO | WO-95/32595 | | 11/1995 |
| WO | WO-97/29560 | | 8/1997 |

OTHER PUBLICATIONS

ADEMCO, "No. 5827BD Wireless Bidirectional Console used with No. 5800TH Transmitter Module Installation Instructions and Operating Guide;" Aug. 1993.
ADEMCO, "No. 5827BD Wireless Bidirectional Console Installation and Setup Guide," Feb. 2004.
Advanced Control Technologies, Inc., "Innovative and Quality Solutions to Control Problems!" www.act-solutions.com, at least as early as Aug. 23, 2005.
Advanced Control Technologies, Inc., "Introducing the Next Generation of Home Control Systems HomePro RF," Mar. 17, 2006.
Air Conditioning Heating & Refrigeration News, "The search for standard automation protocols narrows," Air Conditioning Heating & Refigeration News, vol. 191, No. 5, p. 9, Jan. 1994.
Anonymous, "Echelon releases LonWorks control network protocol, opening up huge potential," Sensor Review, vol. 16, No. 4, p. 9, 1996.
Anonymous, "New products offer high-speed transmission in control networks," Sensor Review, vol. 13, No. 4, p. 39, 1993.
Appliance Manufacturer, "1 Million Nodes," Appliance Manufacturer, vol. 44, No. 1, p. 16, Jan. 1996.
Ballerini et al., "AISI Research and MPR Ltd. to Develop and Market Home Automation Products for Telecommunications Industry," Business Wire, Sec. 1, p. 1, Jun. 2, 1989.
Berger, "Plug-In Remote Controls for the Whole House," Home Mechanix, vol. 88, No. 762, pp. 26-29, 76, Feb. 1992.
Bertsch, "Development Tools for Home Automation," IEEE Transactions on Consumer Electronics, vol. 36, No. 4, pp. 854-858, Nov. 1990.
Beuth Verlag GMBH, "DIN 19 245 Teil 1: Profibus," DIN Deutsches Institute fur Normung E.V., Apr. 1991.
Boughton, "Hard-Wired Home: Automated systems can control everything from lights to curling irons to hot tubs—all at the push of a button," The San Francisco Chronicle, p. Z1, Aug. 30, 1995.
Buffkin, "CEBus, LonWorks heading from 'HomeLAN,'" Electronic Engineering Times, vol. 847, p. 58, May 8, 1995.
Bushby, "The BACnet communication protocol for building automation systems," Ashrae Journal, pp. 14-21, Apr. 1991.
Business Week, "Getting all your appliances on the same wavelength," Business Week, vol. 3088, p. 92E, Jan. 23, 1989.
Butler, "Personal Technology at Home with Technology: LonWorks may run home of the future," The Atlanta Journal the Atlanta Constitution, p. P6, Nov. 19, 1995.
Butler, "Wireless Light Switch Flexible, Easy to Install," The Columbus Dispatch, p. 10H, Oct. 23, 1993.
Butler, "Add-On Light Switches Eliminate Wiring Hassles," Roanoke Times & World News, p. 3, Jun. 6, 1995.
Bybee, "Build Reacts: The Radio-Electronics Advanced Control System," Radio-Electronics, vol. 59, No. 10, p. 65, Oct. 1988.
Caristi, "Carrier-current remote control," Electronics Now, vol. 66, No. 6, p. 49, Jun. 1, 1995.
Carlin, "On the bus," Sound & Image, vol. 4, No. 3, p. 20, Fall, 1994.
WWW.CBUS-SHOP.COM, "What's new in CBus ShopTM?" www.cbus-shop.com, at least as early as Jun. 18, 2004.
WWW.CBUS-SHOP.COM, "U105RHH001BPW1: Handheld Remote Unit—Pearl White," www.cbus-shop.com, at least as early as Jun. 18, 2004.
Coffey, "CEBus," email, at least as early as Jul. 2004.
Compute! "Open the pod bay door," Compute!, vol. 14, No. 11, p. 44, Dec. 1992.
Cooper, "X10 FAQ html version. Based on the X10 FAQ version 1.08," Jan. 8, 1995.
Crevier, "Scott Crevier's X-10 Web Interface," at least as early as Nov. 11, 2002.
Cross et al., "A Fiber Optic Home Automation System," IEEE Transactions on Consumer Electronics, vol. 39, No. 3, pp. 636-645, Aug. 1993.
Davidson, "Echelon's Local Operating Network," Circuit Cellar Ink, pp. 74-77, Jun./Jul. 1991.
Davidson, "Take a Tour of the Bright Home," The Computer Applications Journal, vol. 25, pp. 14-21, Feb./Mar. 1992.
Davidson, "CEBus: A New Standard in Home Automation," Circuit Cellar Ink, pp. 40-52, Aug./Sep. 1989.
Davidson, "CEBus Update," Circuit Cellar Ink, pp. S2-S10, Building Automation Special, Jun./Jul. 1990.
Davidson, "CEBus Gets Physical," Circuit Cellar Ink, pp. 103-104, Feb./Mar. 1991.
Davidson, "CEBus Update: More Physical Details Available," Circuit Cellar Ink, pp. 66-72, Jun./Jul. 1991.
Davidson, "CEBus Goes Coax," The Comptuer Applications Journal, vol. 25, pp. 108-110, Feb./Mar. 1992.
Davidson, "Habitech 94," The Computer Applications Journal, vol. 47, pp. 46-51, Jun. 1994.
Davis, "Zigbee Aims at Home, Utility Markets," www.reed-electronics.com/electronicnews/article/CA469135%20, Oct. 7, 2004.
Delaney, "The CEBus perspective," Appliance Manufacturer, vol. 41, No. 5, p. 31, May 1993.
DiChristina et al., "Controlling the Home," Popular Science, vol. 240, No. 5, p. 48, May 1992.
DiLouie, "Automated Controls Can Save Energy," Facilities Design & Management, vol. 14, No. 11, p. 35, Nov. 1995.
Douligeris et al., "The Consumer Electronic Bus Symbol Encoding Sublayer: A Twisted Pair Implementation," IEEE, pp. 385-388, 1992.
Douligeris, "Intelligent Home Systems: Low-cost computers and fiber optics make it possible to implement systems that can integrate data, voice, and visual communications inside the home," IEEE Communications Magazine, pp. 52-61, Oct. 1993.
Douligeris et al., "Communications and Control for a Home Automation System," IEEE, pp. 171-175, 1991.

Driscoll, "A Timeline for Home Automation," www.eddriscoll.com, 2002.
Edden, "Modelling CEBus Home Automation with Knowledge Based Tools," IEEE, pp. 623-627, 1990.
Electronic Engineering Times, "LONworks gets interface boards," Electronic Engineering Times, p. 54, Jul. 3, 1995.
Electronic Industries Association. EIA-600 (Sections 600.10, 600.31, 600.32, 600.33, 600.35, 600.37, 600.38, 600.41, 600.42, 600.81, and 600.82). Feb. 1995.
Electronic News, "New CEBus devices target energy management," Electronic News, vol. 40, No. 2006, p. 48, Mar. 21, 1994.
Electronic News, "Intellon-IBM CEBus deal eyes energy/com system," Electronic News, vol. 41, No. 2063, p. 24, May 1, 1995.
Electronic News, "Intellon spins home automation roadmap," Electronic News, vol. 41, No. 2064, p. 46, May 8, 1995.
Electronics Australia, "WA firm wins US automation award," Electronics Australia, vol. 57, No. 1, p. 123, Jan. 1995.
Evans, "Solving Home Automation Problems Using Artificial Intelligence Techniques," IEEE, pp. 395-400, 1991.
Evans, "CAL: Part of the Solution," Home Automation & Building Control, pp. 59-67, Jul. 1995.
Evans, The CEBus Standard User's Guide: A Complete Technical Overview, The Training Department Publications, 1996.
Fisher, "Switch-On CEBus: A CAL Interpreter," The Computer Applications Journal, vol. 31, pp. 24-30, Feb. 1993.
Futurist, "Home automation," Futurist, vol. 28, No. 5, p. 7, Sep./Oct. 1994.
GE. Appendix A, GE Authentication and Encryption Algorithm. Version II. Nov. 1995.
Gfeller et al., "Wireless In-House Data Communication via Diffuse Infrared Radiation," Proceedings of the IEEE, vol. 61, No. 11, pp. 1474-1486, Nov. 1979.
Gikas, "Total Home Control Home Control from Your Car," Home Mechanix, vol. 91, No. 794, p. 24, Apr. 1995.
Gilmore, "The integrated automated educated house," Popular Science, vol. 236, No. 6, p. 104, Jun. 1990.
Gilmore, "The World's Smartest Houses," Popular Science, vol. 237, No. 3, pp. 56-65, Sep. 1990.
Gilmore et al., "Open (automated) house," Popular Science, vol. 237, No. 4, p. 48, Oct. 1990.
WWW.GLOBALSUCCESSINC.COM, "Home Automation: GSI Home Automation Controller—The Next Generation in Home Automation!" www.globalsuccessinc.com, 2003.
Gorzelany, "Hot new electronics," J. Consumers Digest, vol. 28, No. 3, p. 74, May/Jun. 1989.
Home Controls, Inc., Home Automation and Networking Catalog, No. 52, Fall 2005.
Homepro, "ZTH100 Radio Frequency Wireless Controller," 2001.
WWW.HOMESEER.COM, "Z-Wave Information," www.homeseer.com, at least as early as Jun. 21, 2004.
WWW.HOMESEER.COM, "Z-Wave Lamp Module (HomePro)," www.homeseer.com, at least as early as Jun. 21, 2004.
WWW.HOMESEER.COM, "Z-Wave Remote Control (ivory)," www.homeseer.com, at least as early as Jun. 21, 2004.
House, "CEBus for the Masses," Home Automation & Building Control, pp. 61-68, Apr. 1995.
Hunt et al., "Are We There Yet?: CEBus Ready to Bring 'Home of the Future' into the Present," Chicago Tribune, p. 22, Mar. 1, 1996.
Intellon Corporation, "Intellon HomePlug7 Family of Products," 2005.
Intellon Corporation, "SSC P485 PL Transceiver IC," at least as early as Jul. 3, 2006.
Interim Standard. IS-60.04 Node Communications Protocol, Part 6: Application Layer Specification. Apr. 1996.
Iversen, "A New Push Begins to Sell a Home Bus," Electronics, vol. 61, No. 12, p. 40, Jun. 1988.
IW, "Building Blocks for Home Automation," IW, p. 23, May 15, 1995.
Jancsurak, "Smart receptacle for smart plugs," Electronic Industries Association, vol. 41, No. 4, p. 62, Apr. 1993.
Karpinski, "In-home networks draw industry attention," Interactive Age, vol. 2, No. 6, p. 39, Jan. 16, 1995.
Keefe, Jr., "Power Line Modem for Home Control," Electronics Now, p. 65, Mar. 1994.
Khawand et al., "Common Application Language (CAL) and Its Integration into a Home Automation System," IEEE, pp. 157-162, 1991.
Kingery, "Which One Should I Use?" at least as early as Jun. 30, 2006.
Kingery, "Which One Should I Use, Part XII (Preamble)," at least as early as Jun. 30, 2006.
Kingery, "'Digital X-10' Which One Should I Use, Part XIII (Preamble)," at least as early as Jun. 30, 2006.
Kingery, "'Two Way and Extended Code' Which One Should I Use, Part XIV (Preamble)," at least as early as Jun. 30, 2006.
Kingery, "Which One Should I Use #17. What is 'Extended Code'? (and does it wear a tuxedo?) Part 1—Different Ways of Counting," at least as early as Jun. 30, 2006.
Kingery, "Which One Should I Use #18. What is 'Extended Code'? Part 2—Big Indians and Little Indians," at least as early as Jun. 30, 2006.
Kirschner, "Smarts at Last?" Popular Science, vol. 247, No. 1, p. 38, Jul. 1995.
Kleiman, "MacDaniel's Advice: Introduction to the X10 System," Sep. 24, 2001.
Krause, "Echelon-CEBus rivalry tangles decoder specs," Electronic News, vol. 41, No. 2067, p. 1, May 29, 1995.
Krause, "EIA sees potential CEBus role in U.S. NII Proposal," Electronic News, vol. 40, No. 2021, p. 38, Jul. 4, 1994.
Kung, "Perceived requirements concerning home automation," Trialog, pp. 1-5, Dec. 1995.
Lamson & Sessions, Product Installation Instructions, 2004.
Langreth, "Slow going for smart homes," Popular Science, vol. 242, No. 2, p. 60, Feb. 1993.
Leeb, "A User Interface for Home-Net," IEEE, pp. 897-902, 1994.
Lutron Electronics Co., Inc., "Homeworks7 seeTouch J Ordering Guide," 2003.
Lutron Electronics Co., Inc., "Homeworks7 Interactive Vareo7-Style Local Lighting Controls," 1998.
Lutron Electronics Co., Inc., Residential Lighting Controls Catalog, at least as early as Jun. 28, 2006.
Lutron Electronics Co., Inc., "RadioRA7 Wireless Home Lighting Control RA-IR, RB-IR Setup and Installation Guide Addendum for RadioRA7 Infrared Interface," 2001.
Lutron Electronics Co., Inc., "RadioRA7 Wireless Home Lighting Control RAMC-MFE, RBMC-MFE Setup and Installation for a RadioRA7 Multi-Function Entry Master Control," 2001.
Lutron Electronics Co., Inc., "RadioRA7 Wireless Home Lighting Control Installation Instructions for Visor Control Transmitter," 2001.
Markwalter et al., "Design Influences for the CEBus Automation Protocol," IEEE, pp. 145-153, 1991.
McGrath, "Seizing the future," Electric Perspectives, vol. 14, No. 6, p. 14, Nov./Dec. 1990.
McLeister, "Builders in Subdivisions, Scattered Sites Gain Edge with Home Automation," Professional Builder, pp. 82-83, Feb. 1995.
McLeister, "Dramatic Changes Lie Ahead for Home Automation," Professional Builder, p. 101, Feb. 1994.
Meth, "Where Will Smart Homes Get Their Smarts?" Electronic Design, vol. 43, No. 19, pp. 61-64, Sep. 18, 1995.
Munro, "Automating the Home," Washington Technology, p. 1, Nov. 9, 1995.
Murray, "Wired and ready," Popular Science, vol. 247, No. 2, p. 36, Aug. 1995.
Nisley, "Two-Way Power Line Communication," The Computer Applications Journal, vol. 25, pp. 74-81, Feb./Mar. 1992.
Pacelle, "Automation Is Knocking at U.S. Homes—TVs Can Talk to Thermostats, but Cost Keeps Most Doors From Opening," Asian Wall Street Journal, p. 7, Sep. 29, 1992.
Palenchar, "Z-Wave Takes on Home-Automation Market," www.twice.com, Mar. 22, 2004.
Pargh, "High-tech functions improve new light switches," Chicago Sun-Times. p. 7, Oct. 7, 1990.
Parks, "The State of Home Systems," The Computer Applications Journal, vol. 25, pp. 12-13, Feb./Mar. 1992.

Parks Associates, Home Systems 94: Home Controls, Parks Associates, Dallas, 1994.
Parks et al., X-10 Ltd. Myths and Reality: The Facts Behind the Company and the Technology, Parks Associates, Dallas, 1994.
Phillips, "Installing a Home Alarm: Protect your property and enjoy extra conveniences with an affordable do-it-yourself system," Home Mechanix, vol. 90, No. 782, p. 60, Feb. 1994.
Price, "Product Development Flow Using Domosys HeadStart Suite," www.hometoys.com/htinews/aug99/articles/domosys/domosys.htm, Aug. 1999.
PR Newswire, "Cyberhouse Software Wins Mark of Excellence Award from Home Automation Association," PR Newswire, p. 325, Mar. 25, 1996.
Professional Builder, "From start to finish: Molex's Smart House home automation system means quality," Professional Builder, vol. 59, No. 10, p. 18, Oct. 1994.
Professional Builder, "Home automation networks links public utility," Professional Builder, vol. 59, No. 7, p. 64, Jul. 1994.
Professional Builder, "Home automation & electronics," Professional Builder, vol. 60, No. 2, p. 350, Mid-Jan. 1995.
Professional Builder, "Exclusive survey results: Home buyers & the intelligent house," Professional Builder, vol. 60, No. 19, p. 13, Dec. 1995.
Rabbie, title unknown, 1992.
Radio-Electronics, "CEBus Developments," Radio-Electronics, vol. 62, No. 8, p. 4, Aug. 1991.
Remlich, Jr., "Intelligent gas appliances," Appliance Manufacturer, vol. 41, No. 3, p. 63, Mar. 1993.
RF Locker, "RF Locker," at least as early as Jul. 2004.
Rochfort, "Sensory experience," Custom Builder, vol. 9, No. 5, p. S-28, Sep./Oct. 1994.
Ruling, "The Wybron Autopilot," TCI, vol. 29, No. 4, p. 54, Apr. 1995.
Schade, "Convenient Remote-Control Light Switching Saves Energy," Energy & Automation, vol. 9, No. 1, pp. 37-39, Jan./Feb. 1987.
Schade, "Switching of Lighting Installations by Remote Control," Elektrische Energie-Technik, vol. 29, No. 2, p. 18, Jun./Jul. 1984.
Schade, "New Aspects in the Horizontal Power Supply of Lighting Installations," Siemens Power Engineering, vol. 6, No. 4, pp. 238-239, Jul./Aug. 1984.
Schofield, "Home Automation Takes Off: Intellon products support a 'home electronic highway,'" Design News, pp. 84-87, Apr. 10, 1995.
WWW.SHED.COM, "x-10 is both a Company and the Technology that it developed," www.shed.com/x10.html, at least as early as Jun. 30, 2006.
WWW.SMARTHOMEPRO.COM, "Introducing Digital Wireless Lighting and Appliance Control," www.smarthomepro.com, at least as early as Jun. 21, 2004.
WWW.SMARTHOMEUSA.COM, "Z-Wave Radio Frequency Wireless Controller," www.smarthomeusa.com, at least as early as Jun. 19, 2004.
WWW.SMARTHOME.COM, "Sophisticated Lighting Control for Your Home," www.smarthome.com, at least as early as Jun. 18, 2004.
WWW.SMARTHOME.COM, "Getting Started," www.smarthome.com, at least as early as Jun. 21, 2004.
WWW.SMARTHOME.COM, "A Full-Featured Dimmer for Every Home!" www.smarthome.com, at least as early as Jun. 21, 2004.
WWW.SMARTHOME.COM, "What is X10?" www.smarthome.com, at least as early as Jun. 21, 2004.
WWW.SMARTHOME.COM, "Automatically Turn On X10 Lights When You Enter the Room!" www.smarthome.com, at least as early as Jun. 18, 2004.
WWW.SMARTHOME.COM, "Control Lights and Appliances from the Comfort of Your Sofa!" www.smarthome.com, at least as early as Jun. 21, 2004.
Stauffer, "The Smart House System," The Computer Applications Journal, vol. 31, pp. 14-23, Feb. 1993.
Strassberg, "Home Automation Buses: Protocols really hit home," EDN, pp. 69-80, Apr. 13, 1995.
Taber, "The Arrival of a World Without Wires," Business for Central New Jersey, vol. 2, No. 3, Section 1, p. 3, Feb. 13, 1989.
Tanenbaum, Computer Networks, Prentice-Hall, Inc., Englewood Cliffs, New Jersey, pp. 144, 271-275, 1989.
TCI, "Lighting control (Buyers Guide)," TCI, vol. 28, No. 10, p. 56, Dec. 1, 1994.
Texas Instruments, Chipcon Products from Texas Instruments, 2006.
Teyssier, "BatiBUS: BatiBUS System Design Principles," Jun. 1990.
Uhara et al., "Development of HI (Home Information) Control System," Sharp Technical Journal, vol. 59, pp. 39-42, Aug. 1994.
WWW.UNITYSYSTEMSHOMEMANAGER.COM, "Lighting & Appliance Control," www.unitysystemshomemanager.com, at least as early as Jun. 23, 2004.
Unknown, "What is X10?" unknown, at least as early as Jul. 18, 2006.
Unknown, "X-10 Technology Transmission Theory," unknown, at least as early as Jul. 18, 2006.
Wacks, "The Impact of Home Automation on Power Electronics," IEEE, pp. 3-9, 1993.
Williams, "Brightening Up The House: Latest Technology, Marketing Developments Bring Sophisticated Home Automation Closer to the Masses," Chicago Tribune, p. 1, Mar. 3, 1996.
Winick, "The RF Medium in the Home—The Move to Spread Spectrum," IEEE Transactions on Consumer Electronics, vol. 37, No. 2, pp. 108-115, May 1991.
"Wireless hookups offered through radio technology," UCLA.
WWW.X10.COM, "Let There Be Light," www.x10.com/news/articles/0309_light.htm, at least as early as Jul. 18, 2006.
WWW.X10.COM, "SuperRemote Home Control Kit," www.x10.com, at least as early as Jun. 18, 2004.
WWW.X10.COM, "X10 Powerline Carrier (PLC) Technology," www.x10.com/support/technology1.htm, at least as early as Jun. 30, 2006.
X10PRO, "X10 Platform Basics," at least as early as Jun. 30, 2006.
Yoshida, "LONWorks connects," Electronic Engineering Times, vol. 769, p. 16, Oct. 25, 1993.
Zhonglei et al., "Simultaneous Control Signal and Power Transmission Through Mechanical Rotary Joint Without Wiring Connection," IEEE, pp. 1589-1593, 1996.

* cited by examiner

| | W3 | R4 | Satellite Parts |
|---|---|---|---|
| VSUB125 | Load | DNI | DNI |
| VSUB125-N | DNI | Load | DNI |
| VSUB125-S | Load | DNI | Load |
| VSUB125-SN | DNI | Load | Load |

| QTY | | REFERENCE | DESCRIPTION | VALUE |
|---|---|---|---|---|
| 1 | DNI | U1 | IRDA Tranceiver | DNI |
| 1 | DNI | J3 | .1" bottom entry sm socket | DNI |
| 1 | DNI | R8 | RESISTOR 6.2 | DNI |
| 1 | VCA-0002 | C3 | CAPACITOR, SM SIZE D | 10uF |
| 2 | VCA-0033 | C1-2 | CAPACITOR, SM 0805 | 0.1uF |
| 1 | VCB-0105 | R1 | RESISTOR, SM 0805 | 10k |
| 4 | VCB-0170 | RN2-5 | 4 Resistor Network, SM 0603 | 2.2k |
| 1 | VCB-0193 | R2 | RESISTOR, SM 0805 | 100 |
| 1 | VCB-0206 | R3 | RESISTOR, SM 2010 | 0 ohm |
| 1 | VCB-0207 | R9 | RESISTOR, SM 1206 | 12 |
| 1 | VCH-0004 | U2 | IR Receiver, SM | GP1U101X |
| 16 | VCL-0008 | LED0-15 | LED, SM 1206 | |
| 1 | VDC-0115 | J2 | Conn w/retension (for flex cable) | 1x6 |
| 1 | VDC-0134 | J5 | 16-Pin Header | 2x8 |
| 1 | VDC-0140 | J1 | 1" Male Header | 2x17 |
| 1 | VDC-0142 | J4 | 2-Pin Low Profile Socket | 1x2 |

FIG. 9A

AUTOMATION AND THEATER CONTROL SYSTEM

CROSS-REFERENCE TO RELATED APPLICATIONS

This application claims the benefit of U.S. Provisional Application No. 60/500,066, filed Sep. 3, 2003, which is hereby incorporated by reference herein in its entirety, including but not limited to those portions that specifically appear hereinafter, the incorporation by reference being made with the following exception: In the event that any portion of the above-referenced provisional application is inconsistent with this application, this application supercedes said above-referenced provisional application.

STATEMENT REGARDING FEDERALLY SPONSORED RESEARCH OR DEVELOPMENT

Not Applicable.

BACKGROUND

1. The Field of the Invention

The present invention relates generally to building automation systems, and more particularly, but not necessarily entirely, to automation systems for buildings and small theaters.

2. Background Art

Home automation and building automation are fairly new terms. Such terms now refer to combining many separately operated subsystems such as lighting, appliances, HVAC, security, audio/video, alarm, surveillance and climate control into one or more integrated central controllers. These central controllers can be built into a wall or many walls, or can be a stand alone units. The controllers may be used to control virtually every electrical device in a house. While such systems will be referred to herein as "home automation" systems, and other suitable terminology, it is to be understood that automation systems which can be implemented in many different types of buildings and structures, including residential and commercial buildings, is intended to fall within the scope of such terminology.

By combining many different systems into one or more control interfaces, extra control boxes are eliminated. For example, a home owner may add a one-stop control button at the garage door called "goodbye" that will turn off the house lights, stereo system, turn down the heat and arm the alarm system. Over time, the efficiency of a home automation system can save a home owner time and money.

Home automation has become very popular for both newly constructed homes and for existing homes. Newly constructed homes can be wired to facilitate home automation. Existing homes must use wireless communication in most instances since the wiring for home automation is not present. Of course, an existing home could be re-wired, but this would be cost prohibitive.

As mentioned above, most home automation systems generally comprise one or more controllers. The controllers may be wired to a communication network or may use wireless connections. The controllers contain the programming required to orchestrate complex commands. The controllers typically receive commands from remote locations through the use of keypads, sensors, touchscreen displays from throughout a house. The controllers may also have the ability to receive commands from manually actuated buttons located directly on the controllers. The controllers may be connected to a computer for programming through a communication port.

While existing controllers have been somewhat successful in reducing the number of controls for subsystems, in the past, an existing home owner would have to purchase multiple controllers for complete home automation. This situation is most often encountered where an existing home owner wants to automate a home, i.e. the entire house, and a home theater. The need for separate controllers is primarily due to the fact that previously available devices have not been able to accommodate into one integrated controller the features and functionality necessary to automate a whole house and a home theater due to the unique and specialized nature of each situation. Each of these will be explained briefly below.

First, in order to retrofit an existing home, a controller is installed a central location. The controller has an antenna for two way communication with a series of stations located throughout the house. Each individual station may in turn be connected to a power supply and an electrical device. Each station may control power to the electrical device to which it is connected. Further, each station has an antenna for two way communication with the controller. Buttons on each station or on other devices situated throughout the house may be programmed to control any electrical device on the system. Thus, the wireless communication between the controller and the stations require no new wiring thus eliminating the need for cutting holes and fishing wires in the house.

The radio frequency on which the stations and the controller communicate vary according to the requirements set by regulating authorities. The stations may also have one or more status lights to indicate whether power is currently being supplied to the electrical device controlled by a button on that station. One example of a controller previously available for controlling home lighting and other electrical devices for an entire house is the C-BOX™ with RADIOLINK™ controller available from Vantage Controls, Inc. located in Orem, Utah.

Next, as explained above, a specialized type of controller has been needed in the past to control a home theater. Home theater can mean different things to different people depending on the budget involved. A home theater may be a simple system located in a living room that includes a surround sound audio video receiver with several location specific speakers, a television and a few source components like a DVD player and satellite receiver. A home theater may also mean a dedicated room specifically designed and built for enhanced acoustics and the ultimate theater experience down to the velvet drapes and popcorn machine. In general, however, a home theater comprises primarily an audio/video receiver, a television, speakers, and one or more sources of audio and/or video (such as a VCR, DVD Player, Digital Satellite, CD Player, etc.).

A controller for home theater automation provides almost every connection for a home theater control and offers enough installation flexibility to exchange equipment without the worry of having the appropriate interface. However, presently available home theater controllers have not included an antenna for two way communication with stations located throughout the house. In this regard, previously available home theater controllers have been lacking.

An example of a controller previously available for automating a home theater system and all its related peripheral devices is the THEATREPOINT™ controller available from Vantage Controls, Inc. located in Orem, Utah.

In the past, stations had to be manufactured for distinct ranges of voltages depending on the power supply available in various locals across the world. It has not been known previously to have a universal station, both wireless and wired, that can plug into most ranges of voltages used throughout the world.

It has also been a problem in the past to arrive at a cost effective solution when installing stations for three-way and four way-switches lighting control switches during retrofitting for home automation. A three-way or four-way switch allows an electrical device to be controlled from two or more locations and is well known in the art. It is often cost prohibitive or at least wasteful to install a standard station with the ability to communicate via RF with a central controller at every wall box for a three-way or four-way switch. Unsatisfactory solutions to this problem have been attempted, but the result was lacking, in that while a station with limited functionality has been developed, the buttons on these station lack the functionality of the buttons located on a standard station. In particular, this included not being able to display the status of a load controlled by a station through a status indicator.

Despite the advantages of known home automation systems, improvements are still being sought. For example, as described above, many of the existing home automation systems require multiple controllers for complete home automation, i.e. whole house lighting and home theater, especially if an existing home is being retrofitted. Multiple controllers are undesirable due to the increased price and footprints. It would be advantageous to eliminate the need for multiple controllers.

Further, despite attempts to overcome disadvantages for automating three-way and four-way switches during a retrofit, significant need for improvement still remains. For example, a satellite station is needed that has the full functionality of a standard station, including status indicators.

Lastly, a universal station is needed that can be used with most of the power supplies available throughout the world.

The previously available devices are thus characterized by several disadvantages that are addressed by the present invention. The present invention minimizes, and in some aspects eliminates, the above-mentioned failures, and other problems, by utilizing the methods and structural features described herein.

The features and advantages of the invention will be set forth in the description which follows, and in part will be apparent from the description, or may be learned by the practice of the invention without undue experimentation. The features and advantages of the invention may be realized and obtained by means of the instruments and combinations particularly pointed out in the appended claims.

BRIEF DESCRIPTION OF THE DRAWINGS

The features and advantages of the invention will become apparent from a consideration of the subsequent detailed description presented in connection with the accompanying drawings in which:

FIG. 9A is a table of components for FIGS. 9B-9D.

DETAILED DESCRIPTION OF THE ILLUSTRATIVE EMBODIMENTS

Figure 1:
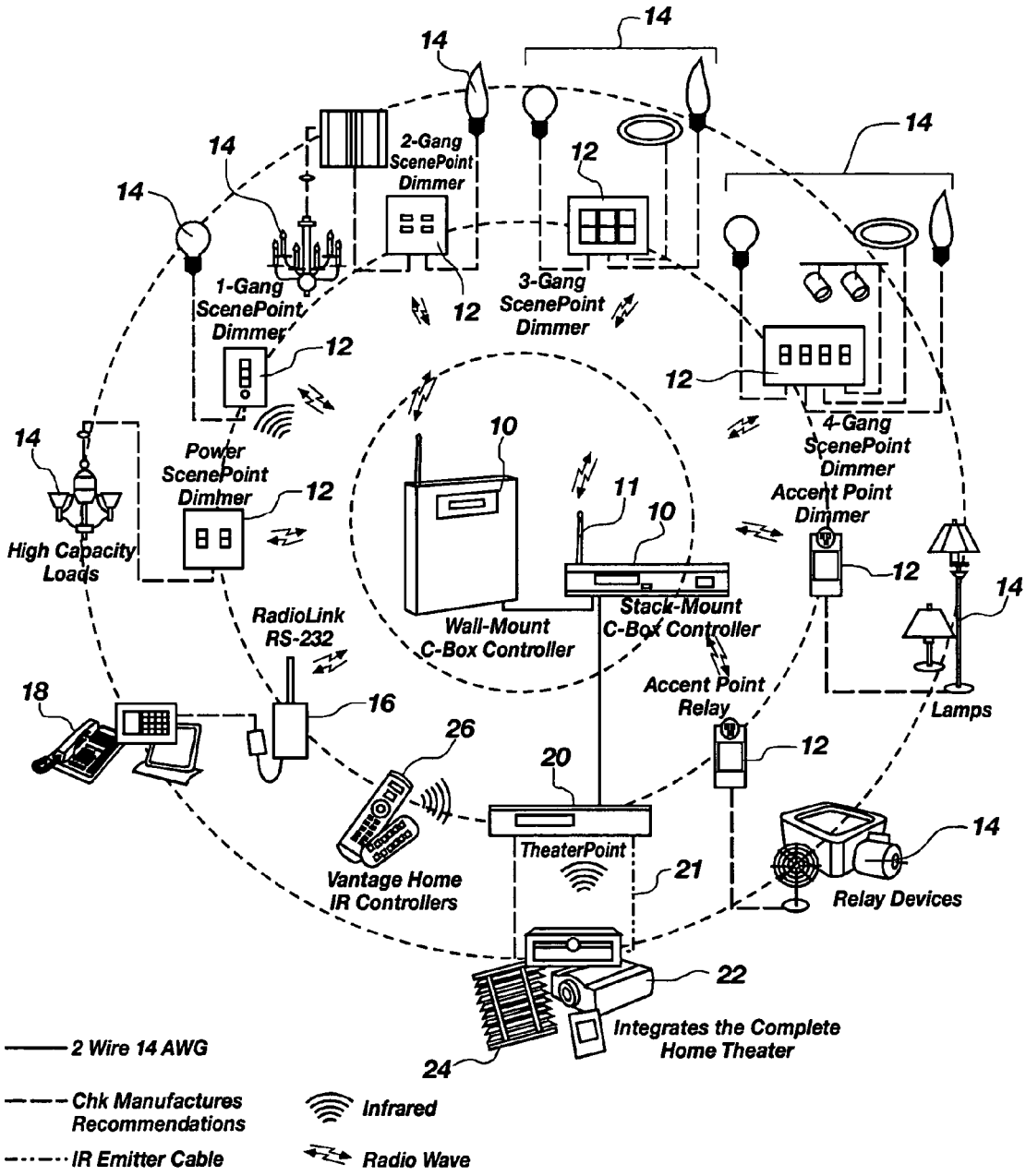
FIG. 1 illustrates a components useful in carrying out the embodiments of the present invention.

For the purposes of promoting an understanding of the principles in accordance with the invention, reference will now be made to the embodiments illustrated in the drawings and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would normally occur to one skilled in the relevant art and having possession of this disclosure, are to be considered within the scope of the invention claimed.

It must be noted that, as used in this specification and the appended claims, the singular forms "a," "an," and "the" include plural referents unless the context clearly dictates otherwise. In describing and claiming the present invention, the following terminology will be used in accordance with the definitions set out below.

As used herein, "comprising," "including," "containing," "characterized by," and grammatical equivalents thereof are inclusive or open-ended terms that do not exclude additional, unrecited elements or method steps.

Referring now to FIG. 1, there is shown components available in the industry which have application with embodiments of the present invention. Central controllers 10 are wireless controllers with RF connections to the surrounding stations 12 which are in turn connected to one or more loads 14. The central controllers 10 each comprise an antenna 11. The loads 14 may include lights, lamps, fans, pumps, motors, and other electrical devices found in a home. The central controllers 10 may also communicate with third party equipment 18, such as phones, computers, and keypads, through a wireless device 16, such as a RS-232 wireless connector.

A home theater controller 20 is also shown in FIG. 1. This is a separate unit from the central controllers 10. The home theater controller 20 communicates with theater system components 22 via IR emitter cable 21. Home theater system components 22 typically have an IR receiver (not shown) built in. The home theater controller 20 passes through signals received from remotes 26 to the theater system components 22 via the IR emitter cable 21. The remotes 26 may be programmed so that they can control the various home theater system components 22. In addition, the home theater controller 20 may also control other devices 24 such as shades and blinds. For example, the home theater controller 20 may close shade and blinds when a movie starts.

As can be seen, central controllers 10 and the home theater controller 20 are separate units.

Figure 2:
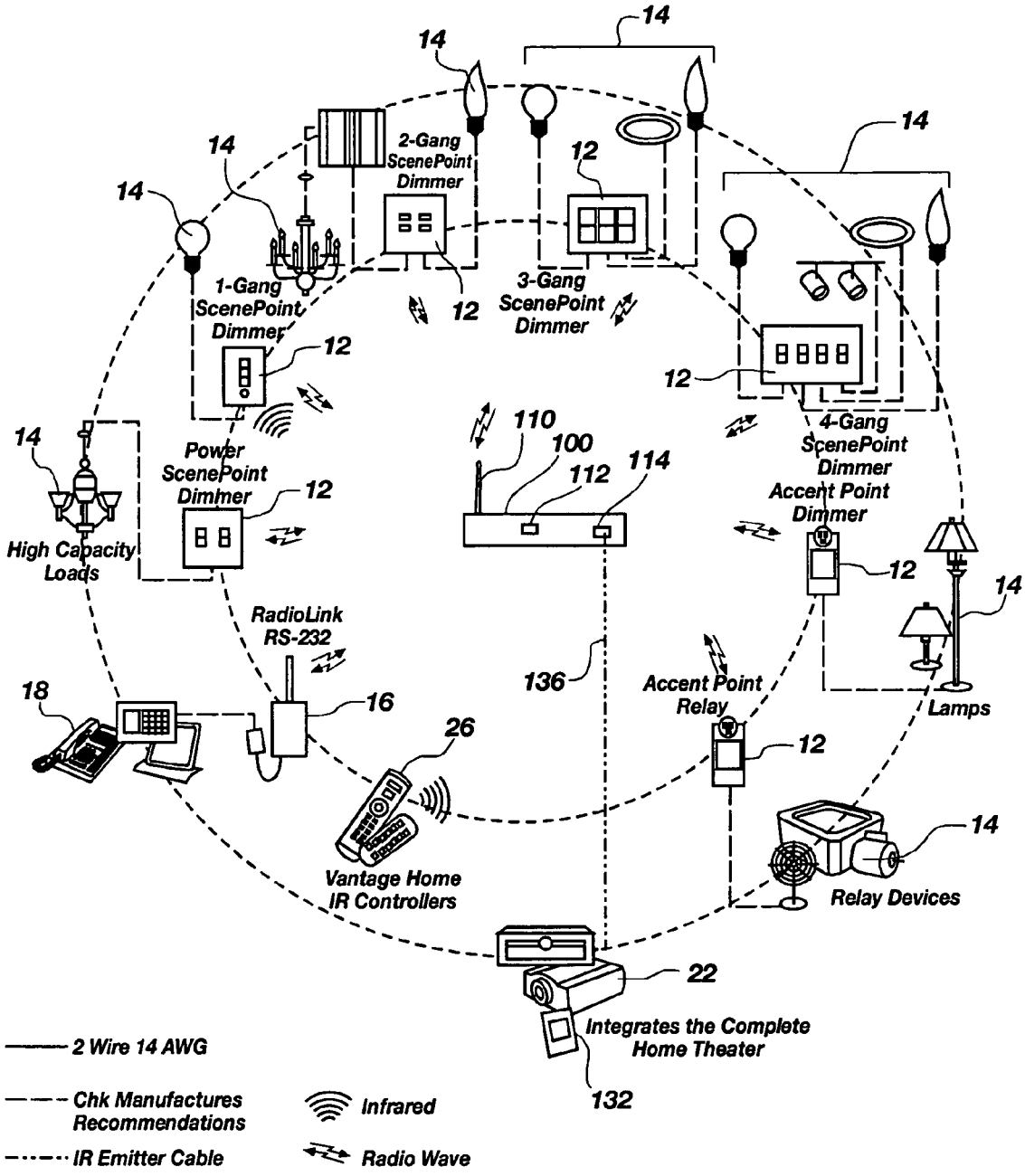
FIG. 2 illustrates one illustrative embodiment of the present invention.

Referring now to FIG. 2, there is shown an integrated controller 100 for controlling electrical devices 14 and theater system components 22 in accordance with the principles of one embodiment of the present invention. The integrated controller 100 comprises an antenna 110, infrared receiver 112 and at least one infrared output 114. Each of these components will be described below.

The antenna 110 on the integrated controller 100 is capable of two-way communication with each station 12, each of which may also have an antenna (not generally shown), through RF transmissions. Each station 12 is connected to a power supply (not shown) and one or more loads 14, such as, for example, a light. Each station 12 may comprise a keypad having buttons. Each button may be programmed to control any load 14 on the system. The integrated controller 100 broadcasts an RF control signal through its antenna 110 which is received by each of the stations 12. An individual station 12 will process the RF control signal if it is directed to the load to which the station 12 is connected. The station 12 may have a relay, traic or other device to control the power from the power supply (not shown) to the load(s) 14.

The buttons on any one station 12 can be programmed to control any electrical device connected to any other station 12. When a button of a station 120 is pressed, it sends an RF control signal to the integrated controller 100. Pursuant to its preassigned function programmed into the integrated controller 100, the integrated controller 100 broadcasts a second RF control signal to the appropriate station 12, connected to the load(s) 14 desired to be controlled. The appropriate station 12 receives the signal and processes it as dictated.

In a typical installation, stations 12 can be positioned throughout an entire house to control virtually all of the lighting and other electrical devices. In this manner, any station can control any load 14 connected to any other station 12. It will be appreciated that this constitutes automation.

The IR receiver 112 on the integrated controller 100 receives IR signals from remotes 26. Generally, the integrated controller 100 passes the IR signals through to a theater system component 22. One way of passing the IR signals through is by using an IR output 114 and an IR emitter cable 136. The IR signal is passed through the IR emitter cable 136 to the IR receiver (not shown) on the appropriate theater system component 22. A theater system component 22 may be, without limitation, a DVD player, VCR, television, projector, amplifier or other device having a built in IR receiver. The theater system component 22 may in turn be connected to a second electrical device (not shown) such as a television, amplifier or speakers.

It will be appreciated that the integrated controller 100 can have one IR output 114 or a plurality of IR outputs 114 (not explicitly shown) thereby allowing the integrated controller 100 to pass through IR signals to one or more theater system components 22 or any other device having an IR receiver.

Typically, the remotes 26 comprise a plurality of buttons. The integrated controller 100 or the remotes 26 can be programmed such that each button on the remotes 26 can control any function on the theater system components 22. It will be appreciated that this allows the remotes 26 to control multiple theater system components 22. Further, the theater system components 22 can be placed in a location where it could not receive IR signals directly. This is often desired in the home theater setting to hide the theater system components 22. In addition, the buttons on the remotes 26 may be programmed to be able to control any load(s) 14 connected to any station 12. Likewise, any button on any station 12 may be programmed to control any theater system component 22 through the IR output 114.

Figure 3:
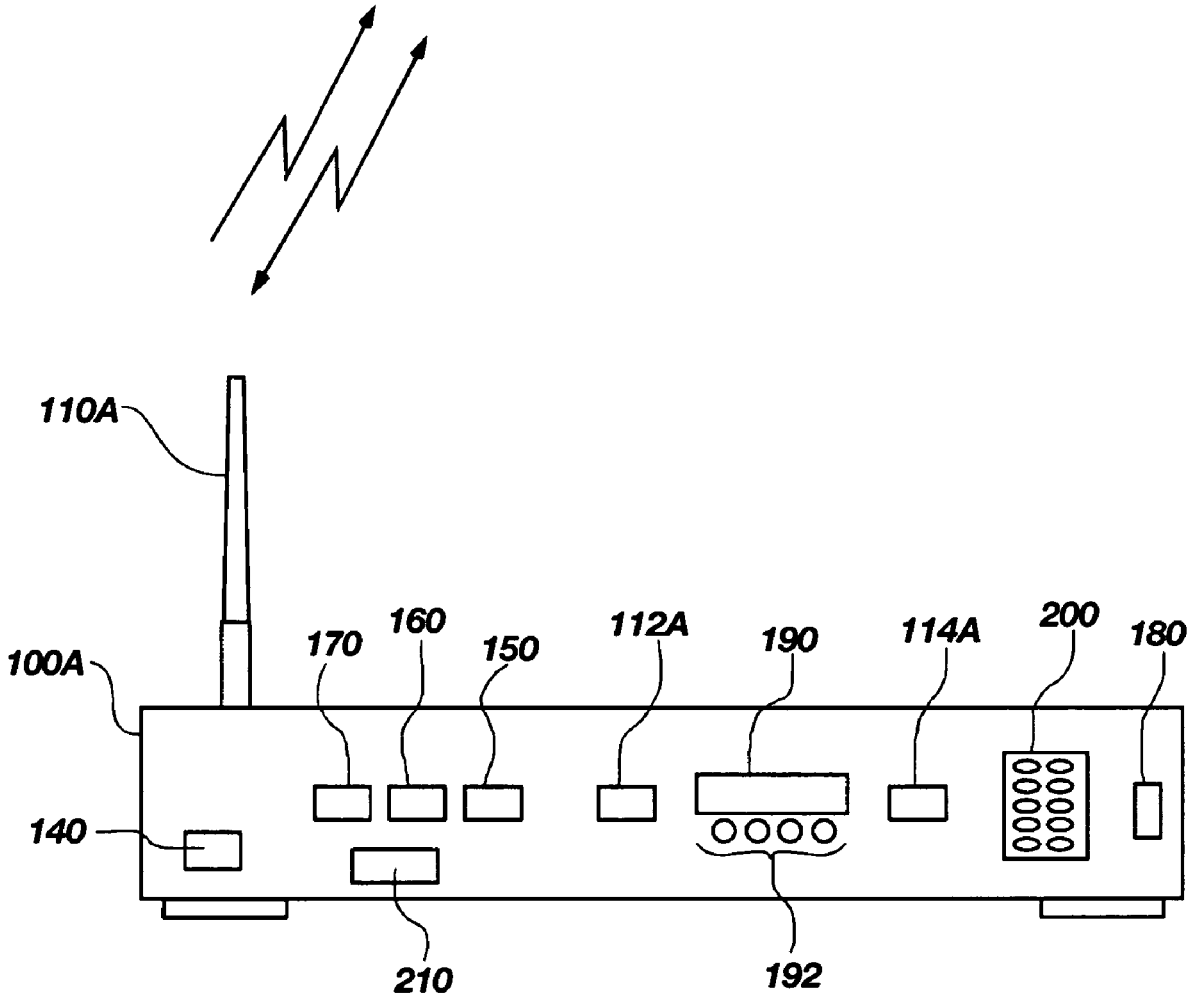
FIG. 3 illustrates an integrated controller pursuant to one illustrative embodiment of the present invention.

FIG. 3 illustrates an integrated controller 100A comprising an antenna 110A an IR receiver 112A and at least one IR output 114A. The antenna 110A may provide two-way communication with stations (not shown), as previously described, to control loads (not shown). Likewise, the IR receiver 112A may receive IR signals from remotes (not shown) to control theater system components (not shown) via the at least one IR output 114A. Additional components can be incorporated into the integrated controller 100A in varying combinations to create many other embodiments of the present invention. These components, each of which will be discussed in detail below, can be added separately or together in any combination. Further, each component can be added in multiples of itself, such as 2, 3, or more of any single component.

A communications port 140, such as, for example, an RS-232 port, can be incorporated into the integrated controller 100A. The communications port 140 allows a computer (not shown) to be connected to the integrated controller 100A. Software running on the computer allows all of the functionality and commands to be programmed into the integrated controller 100A. The software should provide a graphical user interface to facilitate the programming of the integrated controller 100A. Also, a transmitter, such as a wireless RS-232 link, can be plugged into the communications port 140 allowing wireless two-way communication with products such as, for example, security systems, audio/video, pool controls, draperies, and fountains.

A low voltage latching relay 150 may be incorporated into the integrated controller 100A. The low voltage relay 150 provides relay channels for sending contact closures to devices such as shades and blinds (not shown). The low voltage latching relay 150 can for example activate a motor thereby closing or opening a shade or blind.

A current sensing outlet 160 may also be incorporated into the integrated controller 100A. The current sensing outlet 160 senses when an electrical device (not shown) that is plugged into the outlet 160 is drawing current. The integrated controller 100A can be programmed to conduct specified operations upon sensing a change of state in the current sensing outlet 160. For example, the integrated controller 100A can be programmed to dim lights or turn other electrical devices on when it senses that power to an electrical device (not shown) plugged into the outlet 160 is turned on.

A contact input 170 may also be incorporated into the integrated controller 100A. The contact input 170 receives data from third party devices. These include, without limitation, devices such as probes, sensors, door contacts, stress sensors, magnetic contact switches, momentary switches, light sensors, temperature sensors and other sensory inputs. The integrated controller 100A can be programmed to carry out specified functions upon receiving data through the contact inputs 170.

A station bus 180 may also be incorporated into the integrated controller 100A. The station bus 180 allows communication with other devices (not shown) using wire. The other devices may be connected to the station bus in a daisy chain, star and/or branch configuration. The integrated controller 100A can send or receive control signals through the station bus. The other devices may include other controllers, keypads, dimmers, relays, LCD touchscreens, or any other device capable of being connected to a network.

An LCD display 190 may also be incorporated into the integrated controller 100A. The LCD display 190 allows information to be displayed to a user. The LCD display 190 may be used to program as well as monitor the status of the integrated controller 100A. Any number of human actuable switches 192 can also be incorporated into the integrated controller 100A. The switches 192 allow commands to be carried out by the integrated controller 100A. Also a menu can be displayed on the LCD display 190 which can be controlled by the switches 192. The menu can allow a user to select diagnosis and status routines.

An IR channel indicator 200 (ten are shown but any number allowable) can also be incorporated into the integrated controller 100A. The IR channel indicators 200 display when data is being sent through a corresponding IR output 114. The IR channel indicators 200 may comprise an LED that turns on or flashes when data is being transmitted through a corresponding IR output 114. This allows trouble shooting as well as visual verification of signal transmission.

IR inputs 210 can also be incorporated into the integrated controller 100A. The IR inputs 210 allow for external IR receivers (not shown) which are commercially available to be added to the integrated controller 100A.

In addition to the above components being added in any combination, the integrated controller 100A may be configured to track both real and astronomical time. The integrated controller 100A may include a battery backup.

Another illustrative embodiment of the present invention is an integrated controller comprising an antenna for sending and receiving RF control signals from a plurality of stations and at least one low voltage latching relay.

Still another illustrative embodiment of the present invention is an integrated controller comprising an antenna for sending and receiving RF control signals from a plurality of stations and at least one current sensing outlet.

Still yet another illustrative embodiment of the present invention is an integrated controller comprising an antenna for sending and receiving RF control signals from a plurality of stations and at least one contact input.

Still yet another illustrative embodiment of the present invention is an integrated controller comprising an antenna for sending and receiving RF control signals from a plurality of stations and at least one IR input for connecting an external infrared receiver.

Still yet another illustrative embodiment of the present invention is an integrated controller comprising an antenna for sending and receiving RF control signals from a plurality of stations and 12 IR outputs, 1 internal IR receiver, 2 IR inputs for attaching external IR receivers, two communication ports, six low voltage relays, six current sensing outlets, a bus port, and six contact inputs.

Still yet another illustrative embodiment of the present invention includes an integrated controller comprising an antenna for sending and receiving RF control signals from a plurality of stations and 12 IR outputs, 1 internal IR receiver, 2 IR inputs for attaching external IR receivers, two communication ports, six low voltage relays, a bus port and twelve contact inputs. It will be appreciated that embodiments of the present invention can include many a different number of input/output structures, for example the number of IR inputs can advantageously be increased to 6 or more.

It will be appreciated that the present invention can control a wide range of electrical devices common to both whole home automation and home theater automation in response to signals received from a variety of different sources. Some of these sources, listed without limitation, include keypads, stations, RF and IR signals, remotes, sensors, time controls, networks, touchscreens, can all be used to actuate both loads and theater system components of all types connected to an integrated controller, either directly or remotely (via wireless communication).

It will be further appreciated that the present invention comprises a combination of features that allows for home automation as well as home theater automation that was in the past contained in separate controllers. The present invention provides an integrated controller eliminating the need to purchase multiple controllers.

Figure 3A:
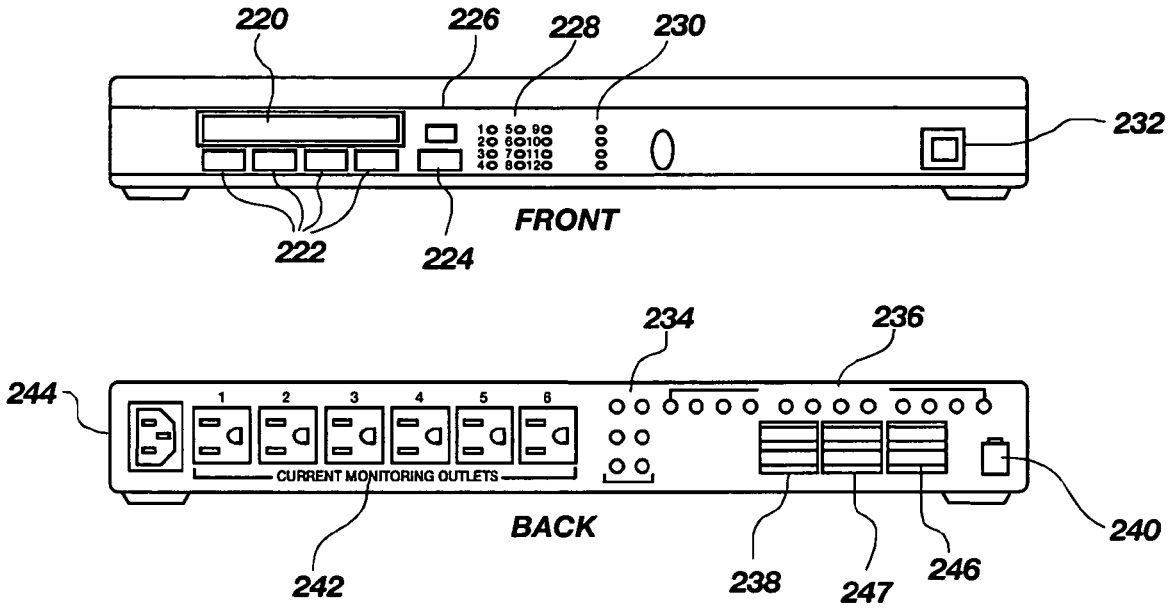
FIG. 3A illustrates another embodiment of an exemplary controller.

FIG. 3A illustrates a front and a back view of a controller pursuant to one embodiment of the present invention. An LCD display 220 is used by the controller to output messages. Buttons 222 are used in combination with the LCD display. Exit Button 224 is used to exit programming. IR-Input 226 is used to receive IR signals. IR channel indicators 228 indicate when a specific channel is being used. Indicators 230 show when the RS-232 channels are being used. Reset button 232 resets the system.

Plug 244 accepts a power cord for supplying power to the controller. Current monitored outlets 242 and contact inputs 234 are on the back of the controller. Infrared emitters 236 are also on the back of the controller. Relay outputs 238, IR Inputs and Ports 246 are also on the back of the controller. Bus connector 240 is on the back as well.

Figure 3B:
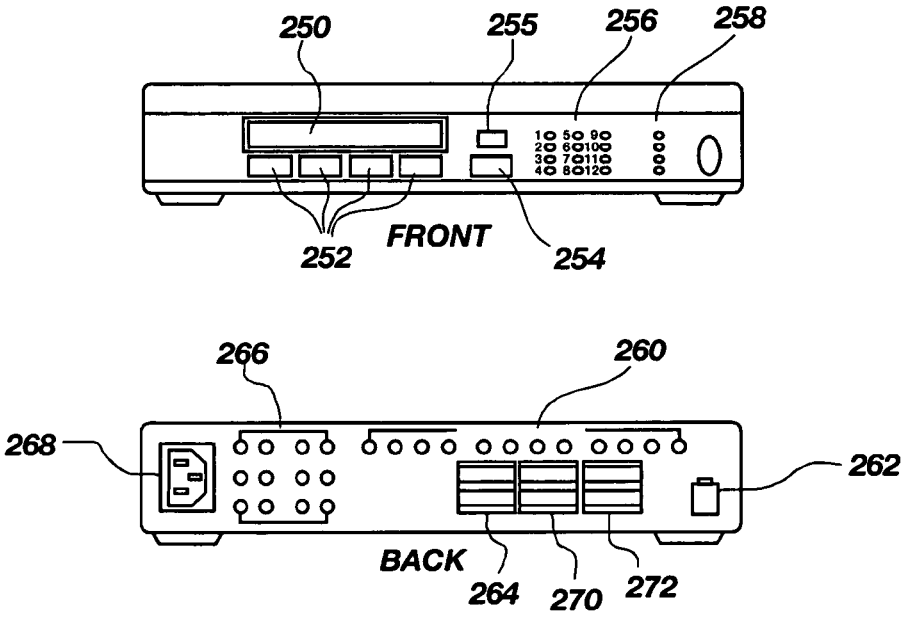
FIG. 3B illustrates another embodiment of an exemplary controller.

FIG. 3B illustrates a front and a back view of a controller. An LCD display 250 is used by the controller to output messages and accept user input. Buttons 252 are used in combination with the LCD display 250. Exit Button 254 is used to exit programming and menus. IR-Input 255 is used to receive IR signals. IR channel indicators 256 indicate when a specific channel is being used. Indicators 258 show when the RS-232 channels are being used.

Plug 268 accepts a power cord for supplying power to the controller. Contact inputs 266 are on the back of the controller. Infrared emitters 260 are also on the back of the controller. Relay outputs 264, IR Inputs 270 and Ports 272 are also on the back of the controller. Bus connector 240 is on the back as well.

Figure 4:
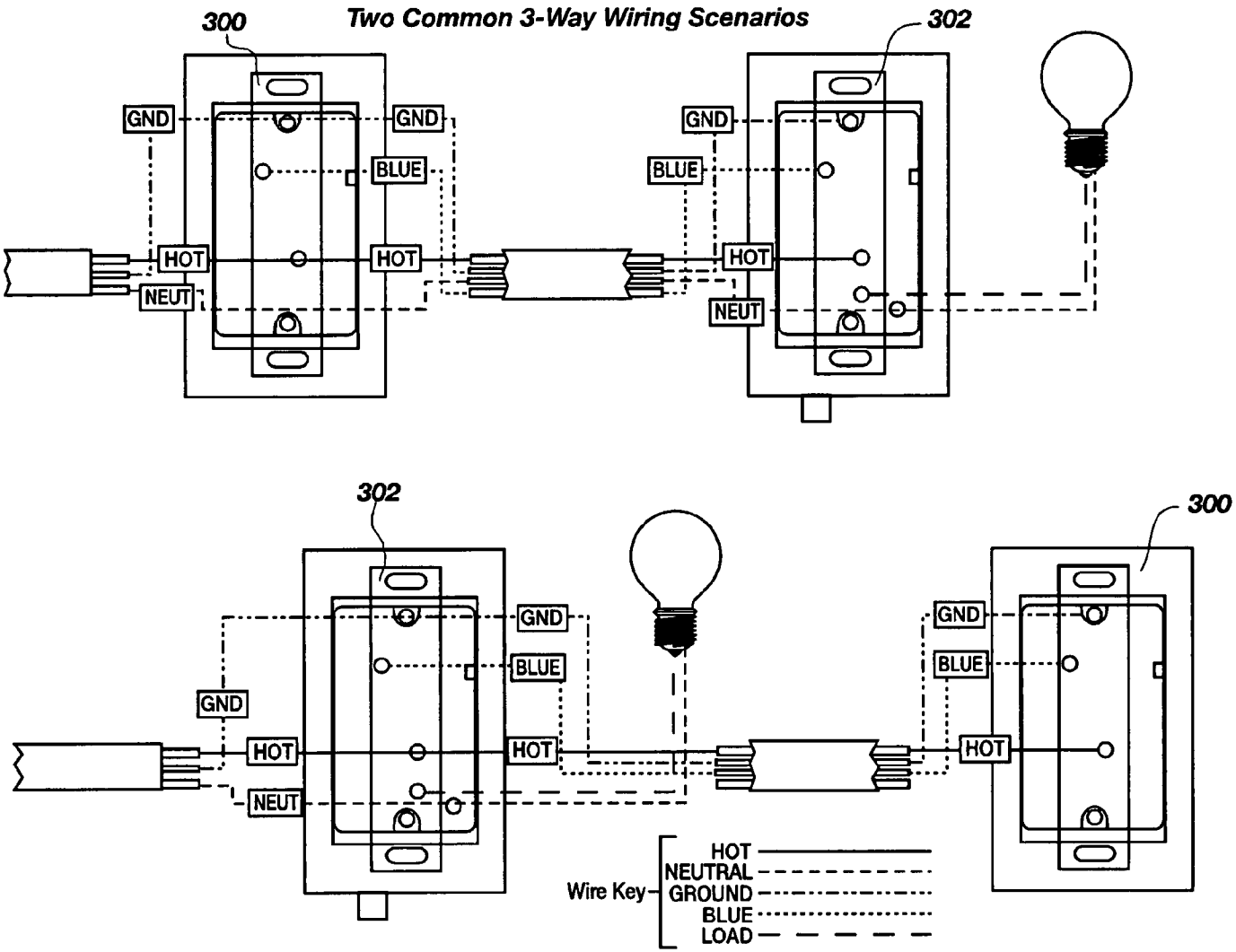
FIG. 4 illustrates a wiring diagram for one illustrative embodiment of the present invention.

FIG. 4 illustrates the use of a slave station 300 with a master station 302 in a retrofit situation to replace two or more standard switches controlling a single load. These are commonly referred to as three-way or four-way switches. The use of a slave station 300 in this situation is advantageous in that it is more cost effective than using a second master station 302. A general overview of the master station 302 and slave station 300 is provided below.

The master station 302 connects to a controller (not shown) via RF to form part of a network used for home automation. It is typically available in a one gang, one load configuration. It may be ganged with other stations, without any limitation as to the number of gangs. It may be powered via a local line feed, and communicates with a controller solely through RF transmissions.

Before the master station 302 is programmed, or if communication is lost, the master station 302 may function in a default mode as an independent dimmer. Any load on the master station 302 may be controlled by any other keypad, IR input, RS-232 or timed event, etc. via the controller and RF transmissions. A master station 302 may have multiple keypad buttons (not shown), and an optional internal IR receiver (not shown).

The master station 302 connects to a slave station 300 for multiple switch scenarios, such as 3-Way/4-Way switch scenarios. The slave station 300 may comprise one or more buttons. Both the buttons on the slave station 300 and the master station 302 may have an associated status indicator. The status indicator may be an LED. The status indicator can be programmed to indicate when there is power to the load controlled by a particular button.

The slave station 300 may be ganged with other stations or switches. The slave station 300 may be powered via the local line feed, and communicates with the controller through the traveler wires in the wiring loop with the master station 302 and the load. Since the wiring loop may be different depending on how the original switches were wired (see FIG. 4) it will be appreciated that this communication can occur for various wiring situations. In simple terms, the slave station 300 utilizes the master station 302 for communication with the controller.

In addition, before the buttons on the slave station 300 are programmed, or if communication is lost, it functions in default mode, remotely controlling the load that it is connected to. Once a button is programmed on the slave station 300, it can perform any operation that the standard master station 302 supports. The operation of the buttons on a slave station 300, as well as a master station, may be programmed at the controller.

It will be appreciated that the master station 302 and the slave station 300 both contain circuitry to engage in two-way communication over the traveler wires in the wiring loop and requires no new wiring which is ideal for a retrofit situation. The two-way communication over the traveler wires allows the slave station 300 to retain the full functionality of any other station on the system. A button on the slave station 300 may operate any load connected to any station on the system through the master station 302, since the slave station 300 does not have the capability to communicate with the controller directly via RF transmissions. In addition, the status of that load can be indicated at the slave station 300.

The steps for installing the master station 302 and slave station 300 are as follows. Determine the 3-way wiring scenario used before placing and connecting the master station 302 and slave station 300. Two common scenarios are shown in FIG. 4. Other variations are possible. Turn the circuit breaker off and make sure no voltage is present. Before turning the circuit breaker on, check to see that all connections are correct. In its standard configuration, the master station 302 is connected to neutral. If operation without Neutral is required, a "NO NEUTRAL" master station 302 and "NO NEUTRAL" slave station 300 can be used.

It should be noted that one master station 302 can be connected with a plurality of slave stations 300. Each button on the slave stations 300 having the same capability as any button on the master station 302. The buttons on the slave stations 300 can be programmed through the controller to operate any other device controlled by the system.

The buttons on the slave station 300 have a status indicator, usually an LED display, to indicate if there is power to the load to which the buttons control. It will be appreciated that this is an improvement over the prior art. The slave station 300 receives control signals via the master station 302, which is in RF communication with the controller. It will be appreciated that this provides a low cost solution instead of having a fully configured station mounted in every wall box for a multiple switch scenario. A slave station 300 is cheaper to manufacture since it does not have the ability to communicate directly with the controller via RF, but instead does so through a master station 302.

It should also be noted that for purposes of this invention, the term wiring loop refers to the wiring "loop" used to control any electrical device from more than one location as is well known in the art. It should also be noted that the slave station 300 and the master station 302 can work with any controller that is capable of sending and receiving RF signals, but can also operate with an integrated controller as described above.

Figure 5:
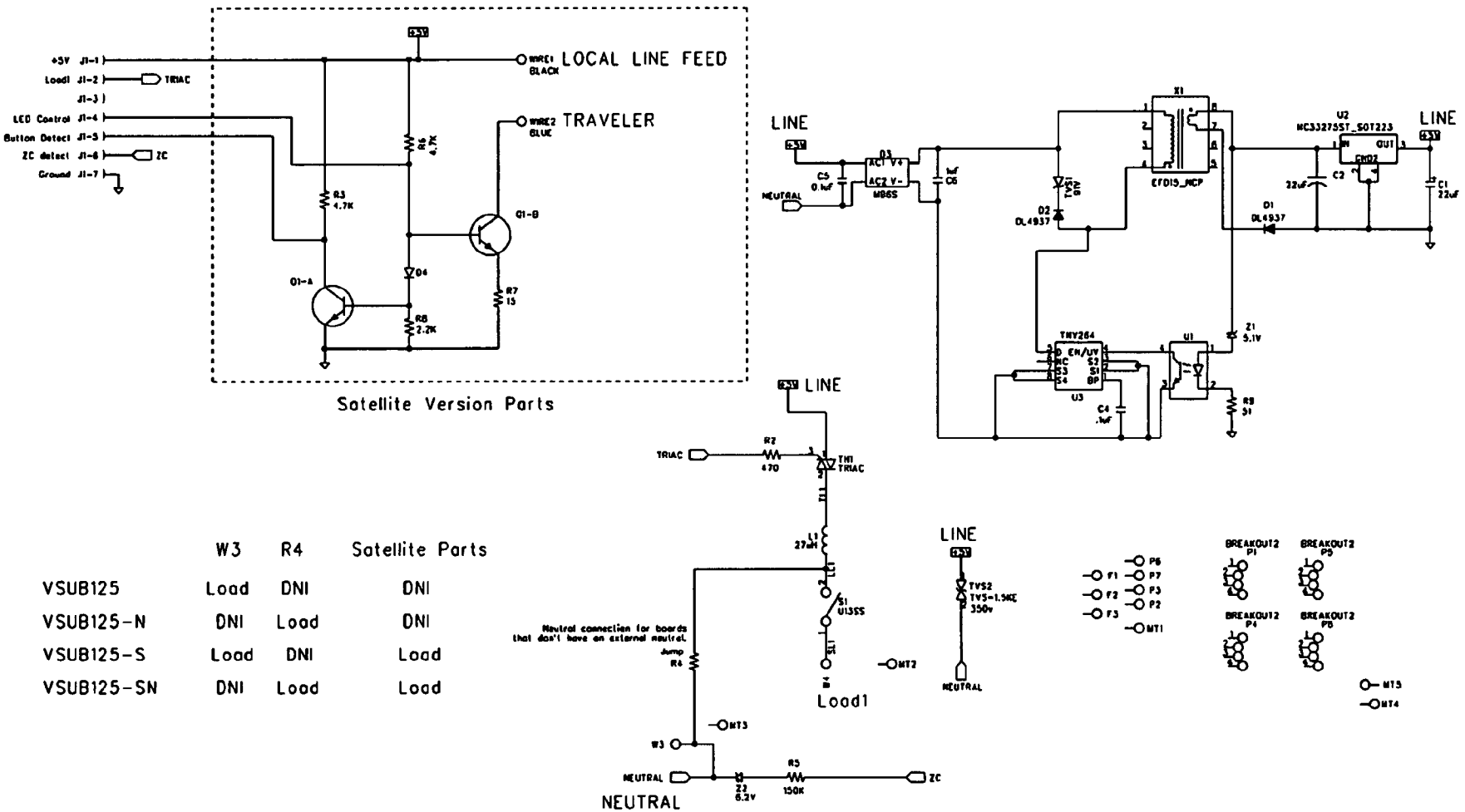
FIG. 5 illustrates a schematic for one illustrative embodiment of a master station.

Referring now to FIG. 5, there is shown a schematic of one embodiment of a master station 302. Table 1, below, is a parts lists corresponding to the schematic shown in FIG. 5.

TABLE 1

| Qt | Reference | Description |
|---|---|---|
| 1 | Q1 | DUAL NPN TRANSISTOR (3904) |
| 2 | R3 R6 | 0603 RESISTOR 5% 4.7k OHM |
| 1 | R8 | 0603 RESISTOR 5% 2.2k OHM |
| 1 | R7 | 0603 RESISTOR 5% 15 OHM |
| 1 | D4 | DIODE, SM SOD123 BAS16 |
| 1 | WIRE1 | Black Wire 18 AWG |
| 1 | WIRE2 | BLUE WIRE 18 AWG |
| 1 | J1 | 7-pin 2mm connector |
| 1 | TH1 | TRIAC, TO-220 PACKAGE |
| 1 | U1 | OPTO-ISOLATOR, 4-PIN, SM |
| 1 | U3 | SM LOW POWER OFF-LINE SWITCHER |
| 1 | U2 | +5 V LOW DROPOUT REGULATOR, S0T-223 |
| 1 | TVS2 | 350 v BIDIRECTIONAL TVS |
| 1 | TVS1 | 91 V TVS, Through Hole |
| 1 | C4 | 0805 CAPACITOR .1 UF |
| 1 | C1 | CAPACITOR, SM C 22 uF |
| 1 | C2 | CAPACITOR, SM D 22 uF |
| 1 | C5 | .1 uF 275AC SAFETY TYPE 2 CAPACITOR |
| 1 | C6 | 1 uF 400 V 10% POLYESTER UNCOATED CAPACITOR |
| 1 | R4 | RESISTOR SM 1206 (optional) |
| 1 | R2 | RESISTOR, 1/10 W 0805 470 Ohm |
| 1 | R5 | RESISTOR, 1/8 W 1206 150K |
| 1 | R9 | RESISTOR, SM 0805 51 Ohm |
| 1 | L1 | 26 uH 18AWG CHOKE |
| 1 | X1 | FLYBACK TRANSFORMER |
| 1 | S1 | SPST 13A switch |
| 2 | D1-2 | DIODE, SM 4937 |
| 1 | Z2 | ZENER DIODE SOD123 6.2 V |
| 1 | D3 | Diode Bridge .5 A, 600 V |
| 1 | Z1 | ZENER DIODE, 5.1 V, SOD-123 |
| 1 | W3 | WHITE WIRE 18 AWG |
| 1 | W4 | RED WIRE 18 AWG |

Figure 6:
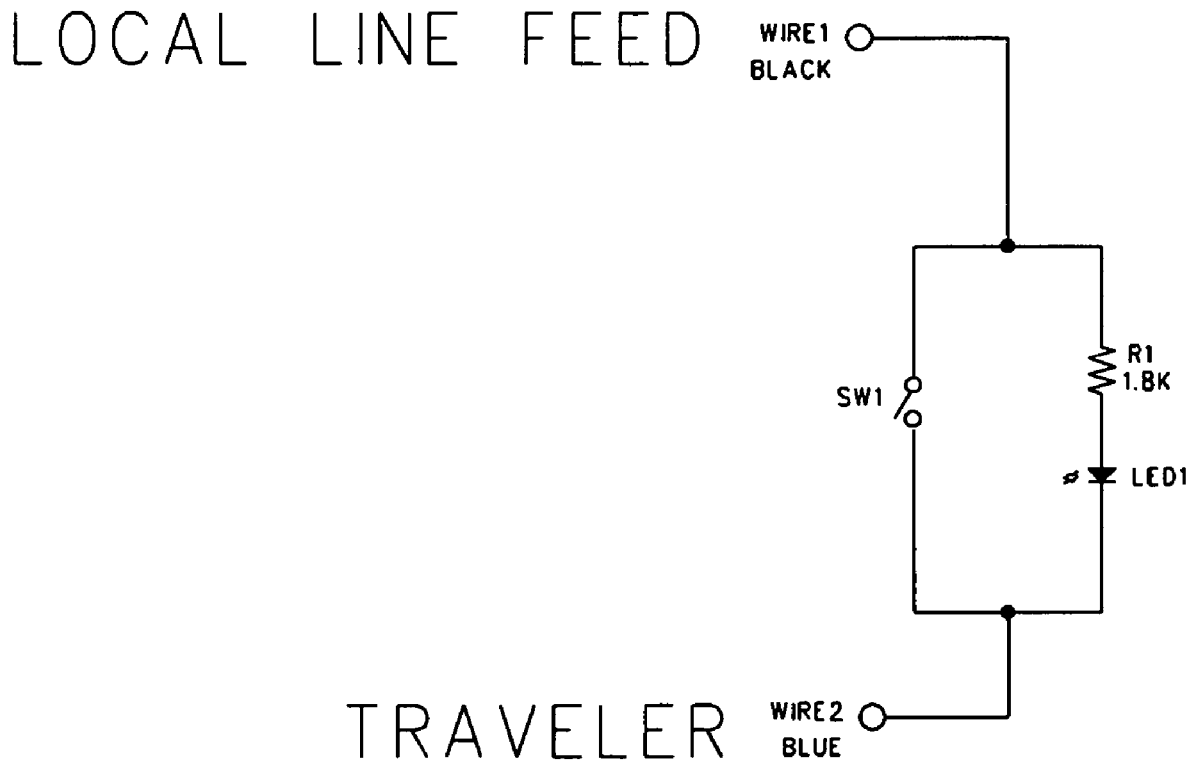
FIG. 6 illustrates a schematic for one illustrative embodiment of a slave station.

Referring now to FIG. 6, there is shown a schematic of one embodiment of a slave station 300. Table 2, below, is a parts lists corresponding to the schematic shown in FIG. 6.

TABLE 2

| Qt | Reference | Description |
|---|---|---|
| 1 | R1 | 0603 RESISTOR 5% 1.8K |
| 1 | SW1 | SPST MOMENTARY TACTILE SWITCH |
| 1 | LED1 | LED, RED, SURFACE MOUNT |
| 1 | WIRE1 | BLACK WIRE 18 AWG |
| 1 | WIRE2 | BLUE WIRE 18 AWG |

The following discussion relates to both the master station 302 and the slave station 300 and FIGS. 5 and 6. The basic function is to allow the master station 302 to detect a button press and control the status of an indicator on one or a plurality of slave stations 300. The circuit of each slave station 300 (see FIG. 6) is comprised of a momentary single-pole single-throw switch (SW1) connected in parallel with an appropriately sized resistor (R1) and light emitting diode (LED1). There are two external leads. A black wire (WIRE1) is connected the local line feed, and a blue wire (WIRE2) that is a traveler utilized for control signals. When SW1 is pressed it bypasses R1 and LED1 by shorting WIRE1 and WIRE2 together.

The circuit on the master station 302 detects the difference between a short circuit and the LED/resistor combination on the slave station 300. As shown on the schematic, the positive supply (+5V) for the digital circuitry is connected directly to the local line feed and ground rides at 5V below line potential. This allows for a common potential at both the slave and master stations (300 and 302). The traveler is switched between GND and +5V using the circuitry comprised of R3, R6, R7, R8, D4, Q1-A and Q1-B. There are two control lines (LED Control, Button Detect) that are wired to a microcontroller on the Master station 302. When LED Control is set high, transistor Q1-B is turned on. This pulls the traveler wire to GND, and turns on LED1 on the slave station 300. Setting LED Control low turns Q1-B and LED1 off. D4 and Q1-A are connected in such a way as to set a limit on the total current flowing through Q1-B. The diode junctions from base to emitter of Q1-A and D4 set a fixed voltage level of two diode drops.

If that voltage level is exceeded, then both D4 and Q1-A will begin to conduct. This will happen when enough current is flowing through R7 that the sum of the voltage across R7 and the base-to-emitter voltage of Q1-B exceed the potential required to cause D4 and Q1-A to conduct.

The resistor on each slave station 300 is sized such that it will limit the current to a level below the threshold that would activate the current limiting circuit on the Satellite Dimmer. A plurality of slave stations 300 may be connected in parallel as long as the total current that is drawn when the LEDs are active remains below the threshold to activate the current limiting on the master station 302. This is how control of the indicator is achieved.

Pressing a button on any of the slave stations 300 while the LED is being turned on will short circuit the LED and resistor. This causes Q1-B to conduct as much current as possible and activate the current limiting circuit. Normally, R3 holds the Button Detect line at +5V. When the current limiting circuit is activated due to a button press on a slave station 300, Q1-A conducts and pulls the Button Detect line low.

Through these mechanisms, the microcontroller on the master station 302 can turn on the LED and detect the button press on one or a plurality of slave station 300. It should be noted that the LED must be turned on to detect a button press. The master station 302 periodically turns the LED on for a very short duration (short enough that the LED does not emit a perceptible amount of light) and checks the state of the button, so that the LED is not constantly lit. Also, the line feed and the traveler wire form a transmission line connecting the master station 302 and the slave station 300. This causes a delay between the time when the signal is sent to test the button and when the status is returned due to the speed at which the pulse propagates down the transmission line and back. This may limit the total length of the connection between the master station 302 and the slave station 300, because the LED can only be turned on for a short period of time to prevent it from being illuminated when it is supposed to be off.

In one illustrative embodiment, +5V on the master station 302 is at the same potential as the local line feed which eliminates the need for high voltage isolation. The circuit could be redesigned using opto-isolators or other isolating devices if it is not possible or desirable to connect reference the +5V to line as shown here.

Figure 7:
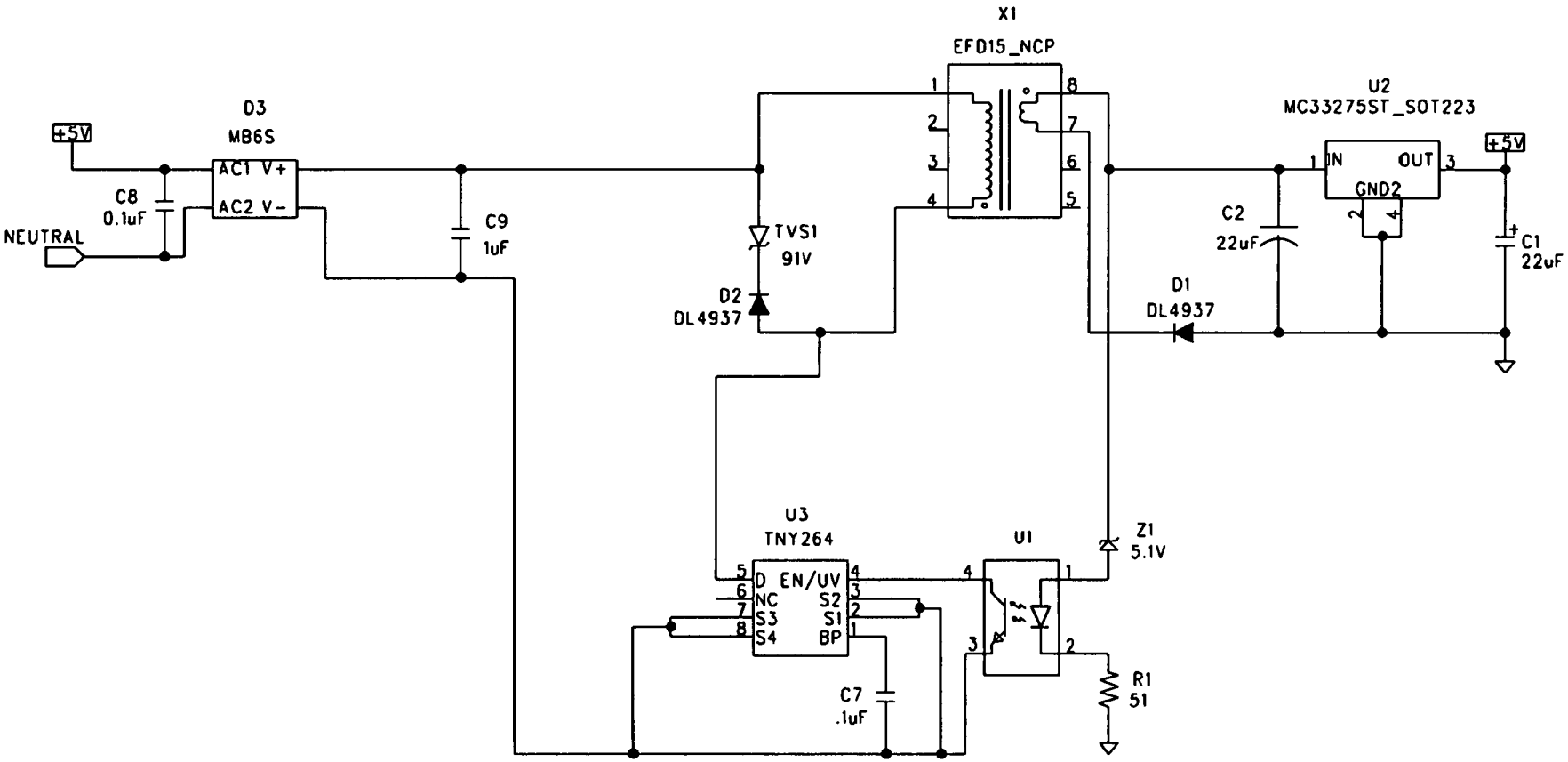
FIG. 7 illustrates a schematic for a one illustrative embodiment of a universal power supply.
Figure 8:
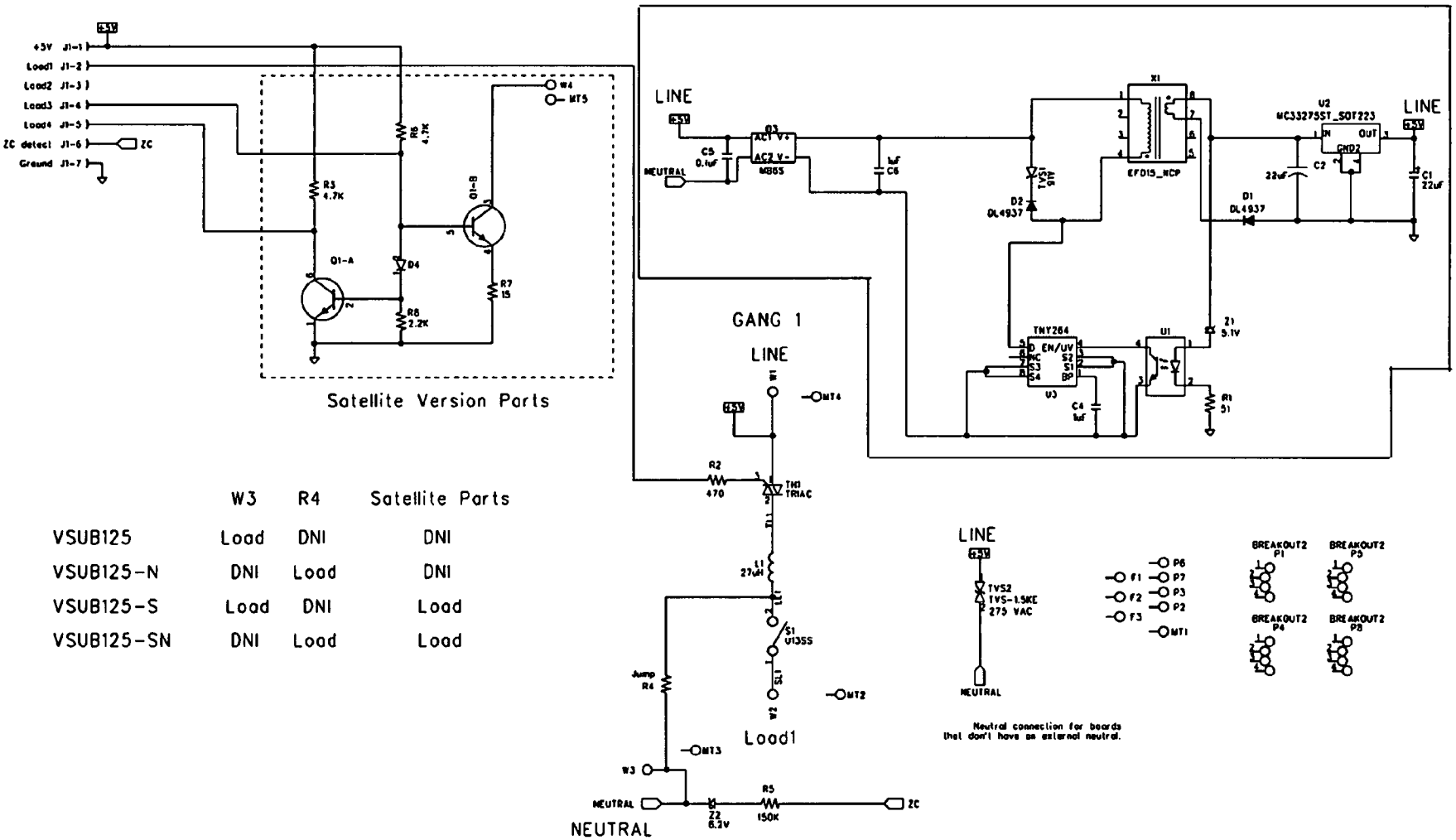
FIG. 8 illustrates a schematic for a second illustrative embodiment of a universal power supply.
Figure 9B:
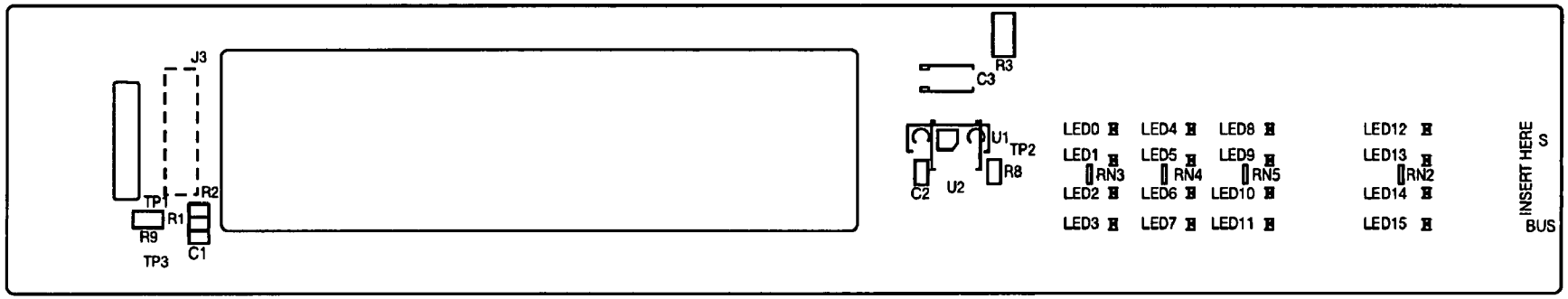
FIGS. 9B-9D illustrate schematics for an exemplary embodiment of the present invention.
Figure 9C:
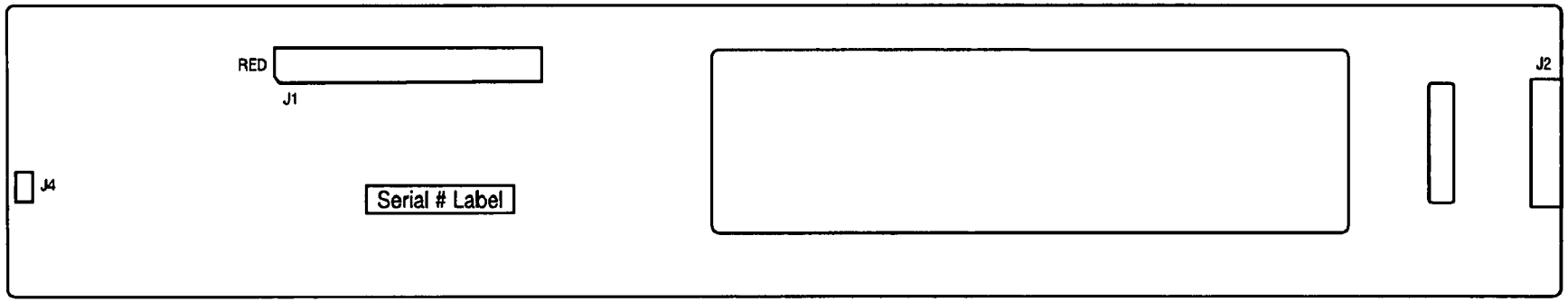
Figure 9D:
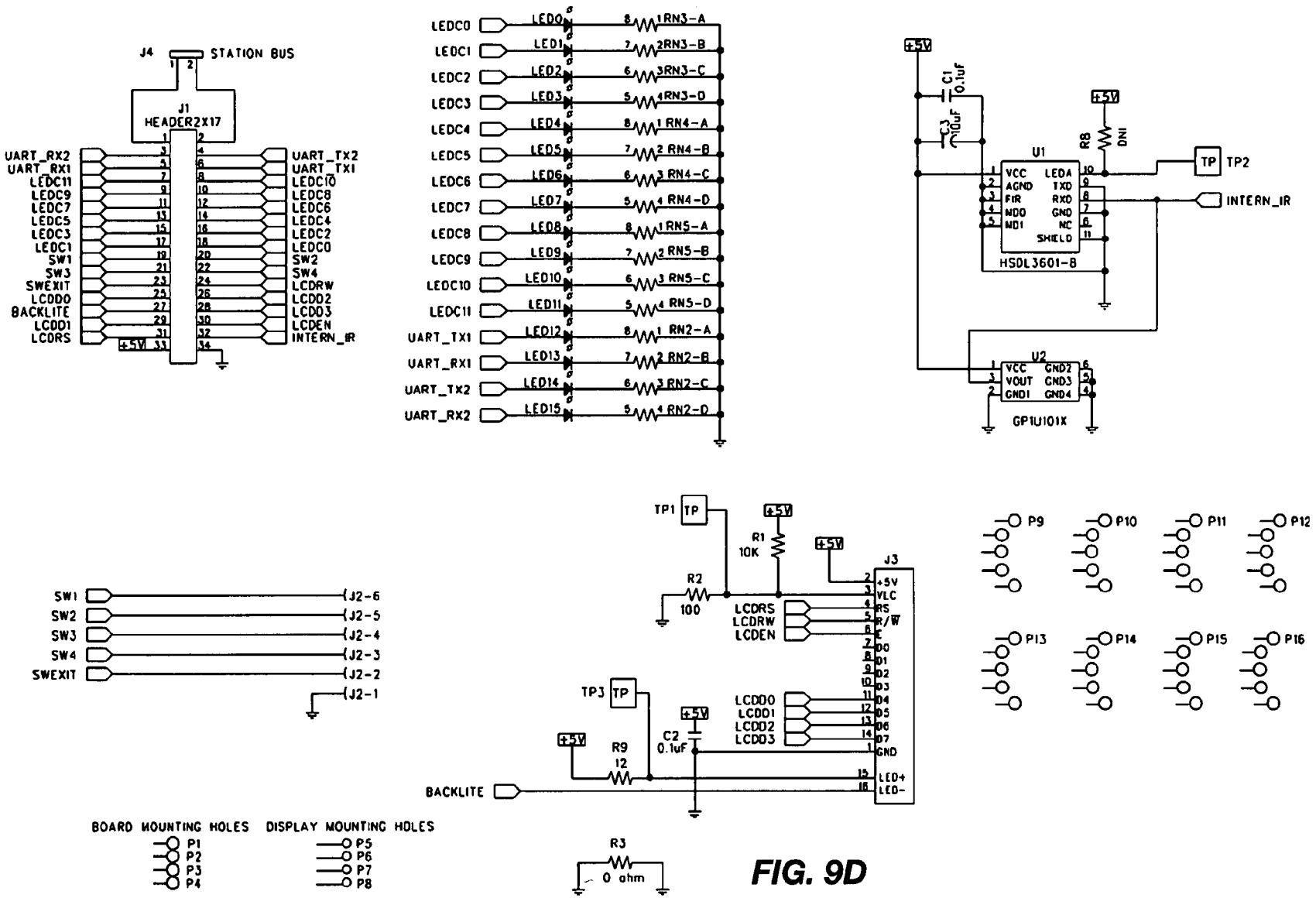
Figure 10A:
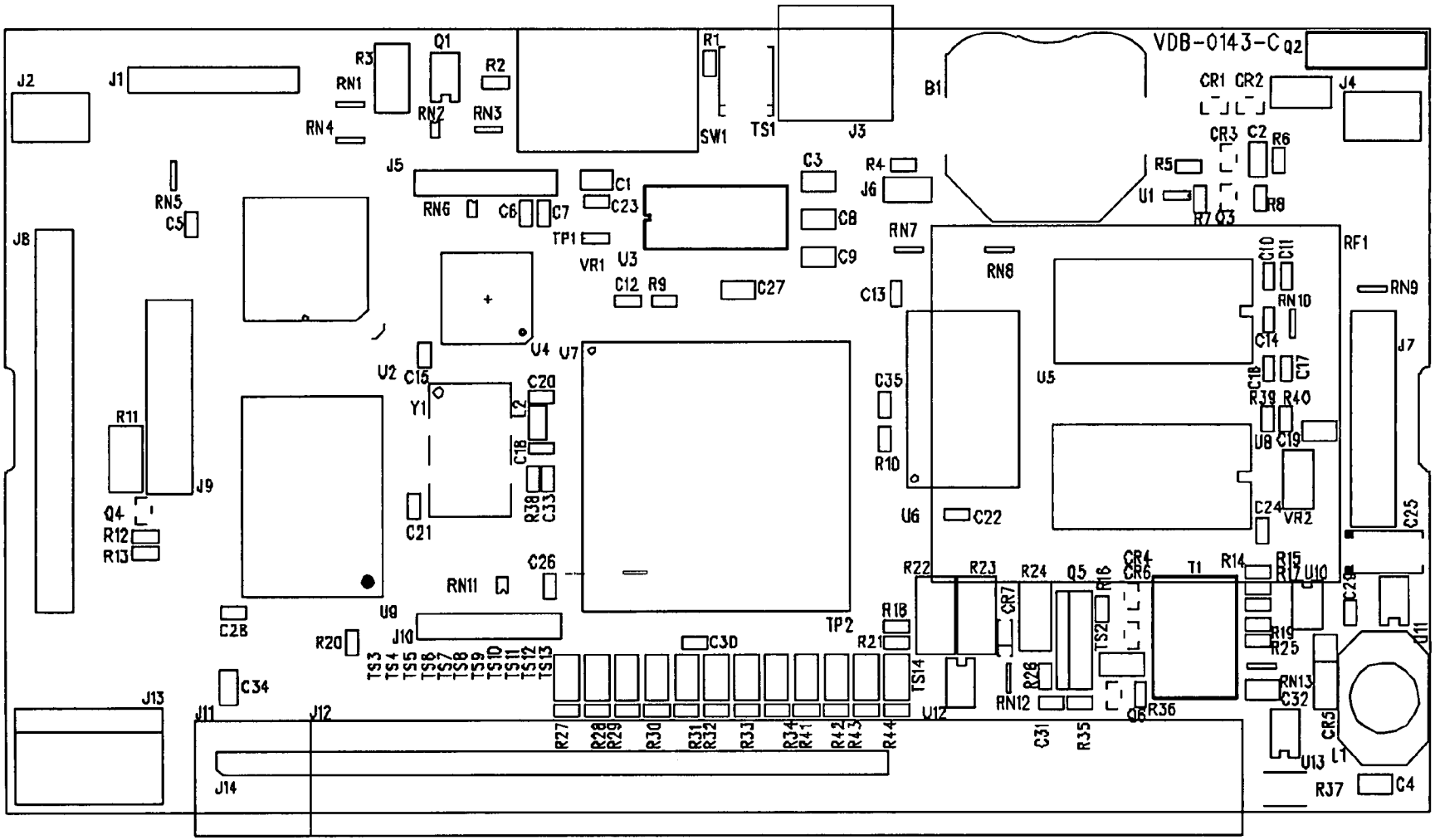
FIGS. 10A-10D illustrate schematics for an exemplary embodiment of the present invention.
Figure 10B:
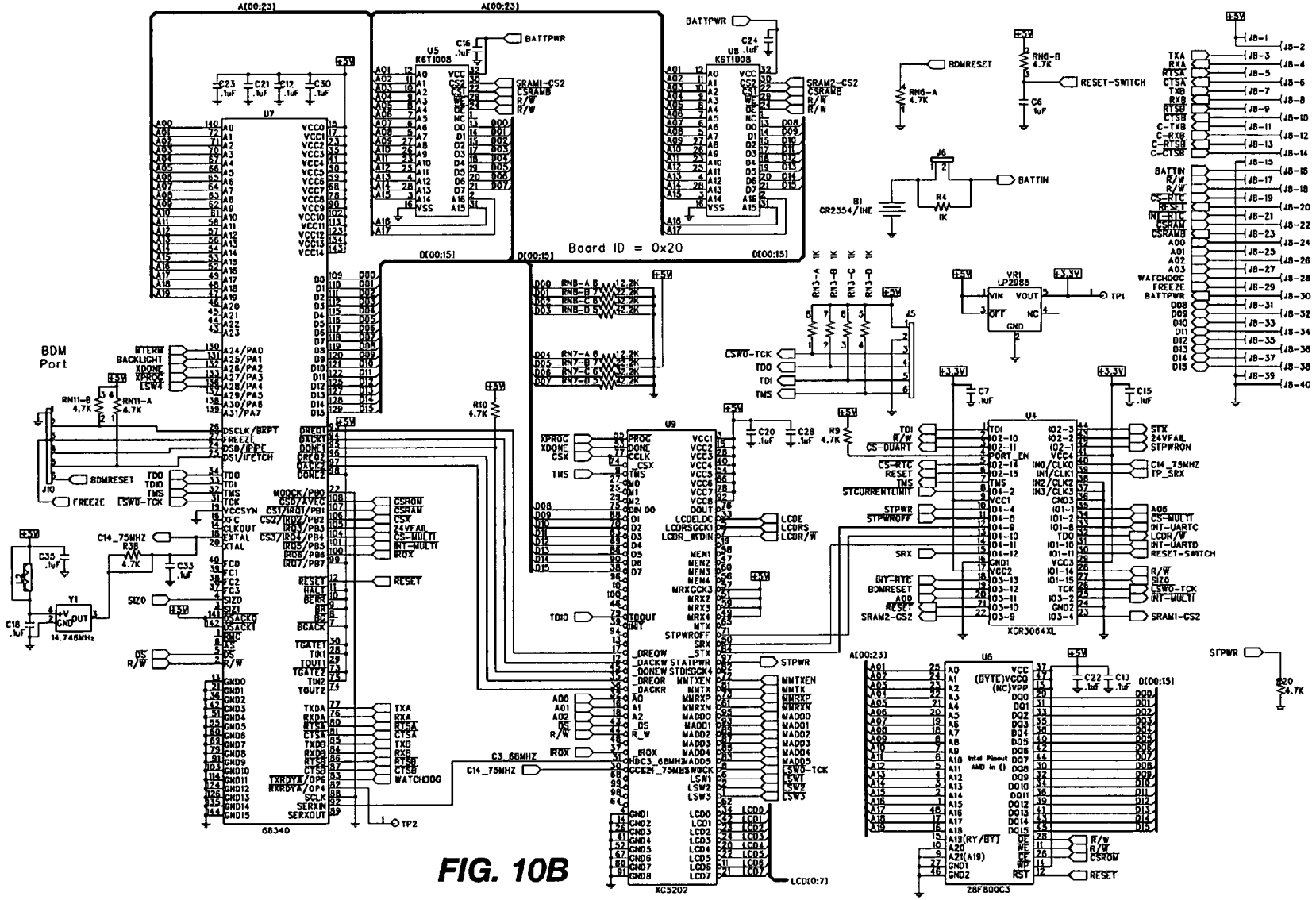
Figure 10C:
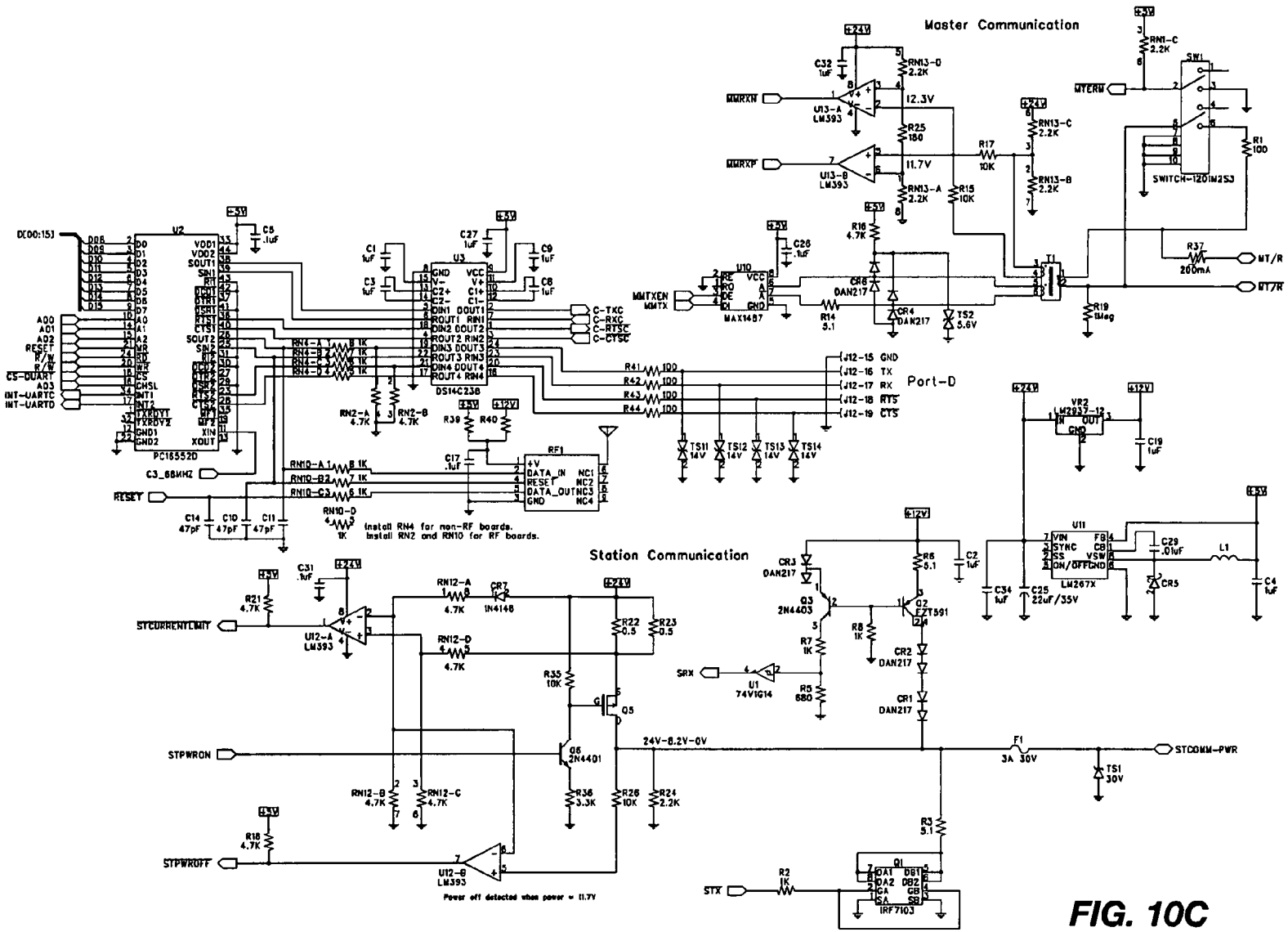
Figure 10D:
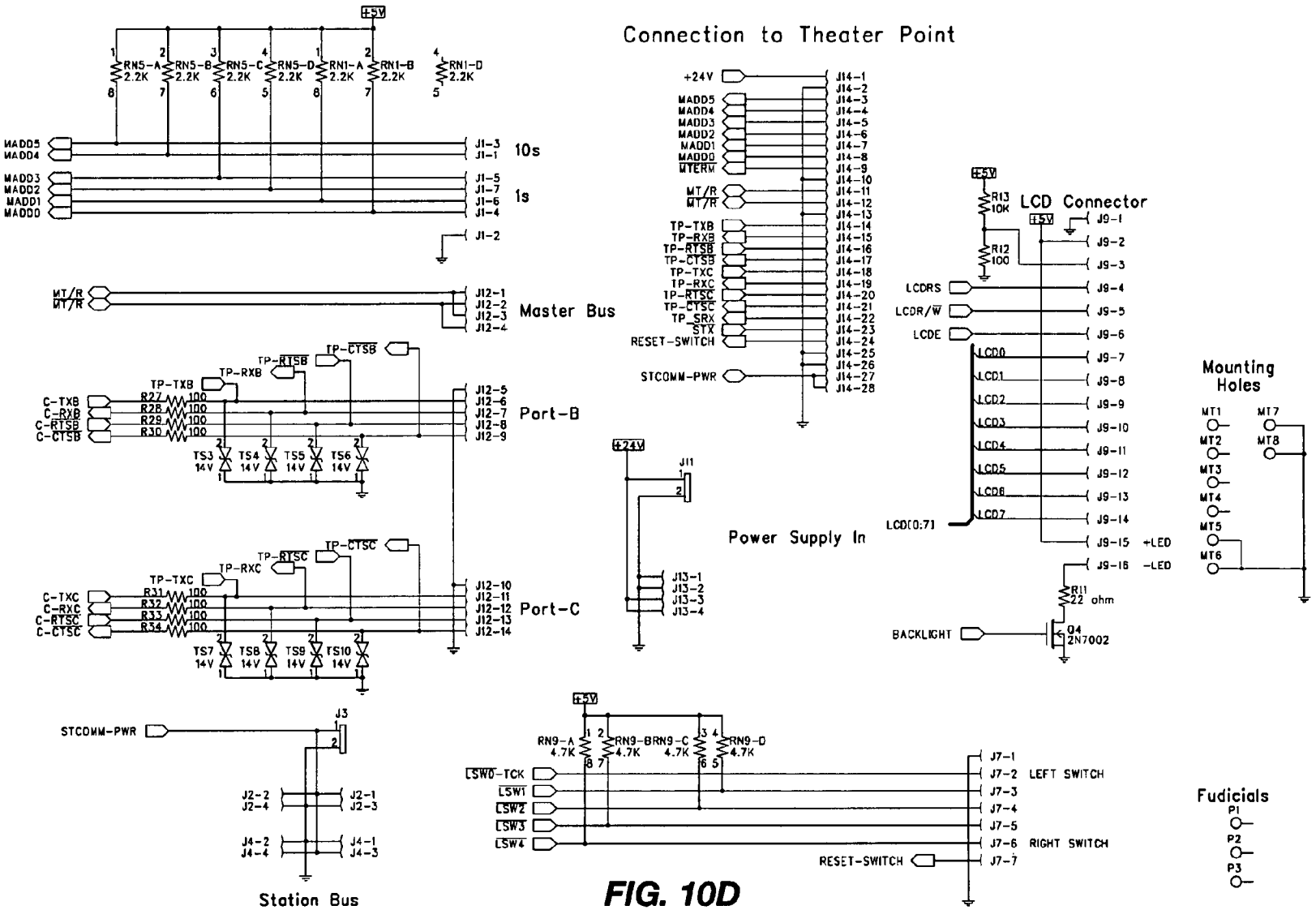

FIGS. 7 and 8 illustrate the schematics of embodiments for a universal power supply to be used with wall mounted dimmer stations. Table 3, below, contains a parts list corresponding to FIGS. 7 and 8.

TABLE 3

| QTY | TRANSERA | Reference | Description | VALUE |
|---|---|---|---|---|
| 1 | VCL-0025 | D3 | Diode Bridge .5 A, 600 V | MB6S |
| 1 | VCA-0033 | C4 | 0805 CAPACITOR .1 UF | .1 uF |
| 1 | VCA-0095 | C5 | .1 uF 275AC SAFETY TYPE 2 CAPACITOR | 0.1 uF |
| 1 | VCA-0105 | C6 | 1 uF 400 V 10% POLYESTER UNCOATED CAPACITOR | 1 uF |
| 1 | VCA-0077 | C2 | CAPACITOR, SM D | 22 uF |
| 1 | VCA-0076 | C1 | CAPACITOR, SM C | 22 uF |
| 2 | VCL-0002 | D1-2 | DIODE, SM | 4937 |
| 1 | VCC-0017 | X1 | FLYBACK TRANSFORMER | EFD-15 |
| 1 | VBH-0013 | U2 | +5 V LOW DROPOUT REGULATOR, S0T-223 | MC33275ST-5.0 |
| 1 | VBF-0041 | U1 | OPTO-ISOLATOR, 4-PIN, SM | H11A817B |
| 1 | VCB-0162 | R1 | RESISTOR, SM 0805 | 51 |
| 1 | VBF-0055 | U3 | SM LOW POWER OFF-LINE SWITCHER | TNY264G |
| 1 | VBZ-0026 | TVS1 | 91 V TVS, Through Hole | 91 V |
| 1 | VCL-0026 | Z1 | ZENER DIODE, 5.1 V, SOD-123 | 5.1 V |

The illustrative operation of the circuits shown in FIGS. 7 and 8 are as follows.

Line Filtering:

C5 is a high voltage type x safety capacitor. The purpose of C5 is to remove transients caused by the switching circuit from the AC Mains.

Line Rectification:

D3 is a bridge rectifier. This device is used to convert the AC Mains into a rectified volt AC signal.

Holding Capacitor:

C6 is a high voltage capacitor. The function of C6 is to smooth the rectified AC by storing energy in the high voltage regions, and releasing it during low voltage regions.

Fly-Back Transforming:

The Fly-back Transformer (X1), in conjunction with the switching controller (U3), form the fly-back switching, and transforming circuitry. The switching controller (U3) creates a path for energy to flow from the holding capacitor, to the rectified "ground". This causes a build up of energy in the Transformer (X1). When this voltage nears "Saturation" (the most energy the transformer can hold at one time), the switching controller removes the path for the energy to travel back to ground. This "open" path causes the energy which was stored in the transformer (X1) to "collapse" when this happens an energy pulse is transferred to the "Secondary" side of the transformer. This energy is the useful energy. This energy is then stored, and regulated.

Fly-Back Snubber:

The snubber circuit (TVS1, D2) is used to channel excess energies (created by the primary collapse) back through the transformer. This prevents those very high voltages from causing a fault condition in the "gate" of the switching controller.

Switching Feedback:

U3, Z1, and R1 form the switching feedback circuit. U1 is an optocoupling device uses to control the switching "Mode" of the switching controller. When the voltage being stored in the secondary circuit reaches the reverse breakdown voltage of the Zener diode (Z1), it causes the LED inside U1 to emit light, this light is then used as a trigger to the transistor inside the optocoupler. The transistor then shorts to ground causing the switching controller to stop sending additional energy until the voltage in the secondary falls below the reverse breakdown voltage of Z1, at which time the shorting condition is removed, and the switching controller begins sending more energy. This cycle is continuously repeated, thus keeping the secondary energy to a useable level.

Output Regulation:

C2, U2, and C1 form the output regulation circuit. Together they keep the final output voltage at a set level (lower than the secondary voltage). This voltage is then used to power the low voltage circuitry.

It will be appreciated that the structure and apparatus disclosed herein is merely one example of a means for a universal power supply, and it should be appreciated that any structure, apparatus or system for universal power supply which performs functions the same as, or equivalent to, those disclosed herein are intended to fall within the scope of a means for universal power supply, including those structures, apparatus or systems for universal power supply which are presently known, or which may become available in the future. Anything which functions the same as, or equivalently to, a means for universal power supply falls within the scope of this element.

FIGS. 9B-9D, FIGS. 10A-10D, FIGS. 11A-11C, FIGS. 12A and 12B, FIGS. 13A-13F, and FIGS. 14A-14C illustrate schematics for an exemplary embodiment of a controller. It should be understood that these schematics should not be construed as limiting, and that those skilled in the art will recognize that many different designs will fall within the scope of the present invention.

Table 4, below, contains a parts list corresponding to FIGS. 10A-10D.

TABLE 4

| QTY | VANTAGE # | REFERENCE | DESCRIPTION | VALUE |
|---|---|---|---|---|
| 7 | DNI | J1-J7 | | DNI |
| 1 | DNI | J9 | 2x8 DUAL HEADER | DNI |
| 2 | DNI | J11 J12 | | DNI |
| 1 | DNI | L2 | Inductor | DNI |
| 3 | DNI | R1 R39 R40 | 0603 SM RESISTOR | DNI |
| 4 | DNI | R41-44 | 0603 SM RESISTOR | DNI |
| 1 | DNI | RF1 | RF Daughterboard | DNI |
| 1 | DNI | RN2 | 2 RESISTOR 0603 SM NETWORK | DNI |
| 2 | DNI | RN10 RN12 | 4 RESISTOR 0603 SM NETWORK | DNI |
| 1 | DNI | SW1 | SWITCH, DPST VERTICAL | DNI |
| 4 | VBZ-0008 | TS11-14 | TRANSIENT VOLTAGE SUPPRESSOR | DNI |
| 1 | VAA-0026 | U1 | SCHMITT-TRIGGER INVERTER | 74HC1G14 |
| 1 | VAB-0019 | U7 | Microcontroller | 68340 |
| 2 | VAC-0003 | U5 U8 | SRAM 128Kx8 | K6X1008 |
| 1 | VAC-0009 | U6 | AMD or Intel Flash 8M-32M | 28F800 |
| 1 | VAD-0004 | U9 | 64 macro FPGA for PQFP package | XC5202 |
| 2 | VAZ-0001 | U12-13 | Dual Comparator | LM393 |
| 1 | VBF-0012 | Q4 | N-Channel MosFET | 2N7002 |
| 1 | VBF-0013 | Q2 | PNP TRANSISTOR | |
| 1 | VBF-0016 | Q6 | NPN SIGNAL TRANSISTOR | 2N4401 |
| 1 | VBF-0017 | Q3 | PNP Small Signal Transistor | |
| 1 | VBF-0023 | Q5 | 23 A 60 V P-chan MosFet T0-220 | MTP23P06V |
| 1 | VBF-0037 | Q1 | Dual N-Channel MosFets | IRF7103 |
| 1 | VBH-0011 | U11 | NATIONAL 260 kHz 5 V SWITCHING REG. | 500 mA |
| 1 | VBH-0019 | VR1 | 3.3 V Regulator SOT23-5 | |
| 1 | VBH-0022 | VR2 | LDO LINEAR REG. SOT-223 | LM2937-12 |
| 1 | VBI-0003 | U2 | Dual UART with FIFO | PC16552D |
| 1 | VBI-0005 | U10 | DIFFERENTIAL TRANSCEIVER | MAX1487 |
| 1 | VBI-0009 | U3 | RS-232 TRANSCEIVER | DS14C238 |
| 1 | VBZ-0003 | TS2 | TRANSIENT VOLTAGE SUPPRESSOR | 5.6 V |
| 8 | VBZ-0008 | TS3-10 | TRANSIENT VOLTAGE SUPPRESSOR | 14 V |
| 1 | VBZ-0023 | TS1 | TVS 1500 W SMC | 30 V |
| 10 | VCA-0039 | C1-4 C8-9 C19 C27 C32 C34 | 0805 SM CAPACITOR | 1 uF |
| 19 | VCA-0043 | C5-7 C12-13 C15-18 C20-24 C26 C28 C30 C33 C35 | 0603 SM CAPACITOR | .1 uF |
| 3 | VCA-0054 | C10-11 C14 | 0603 SM CAPACITOR | 47 pF |
| 1 | VCA-0061 | C29 | 0603 SM CAPACITOR | .01 uF |
| 1 | VCA-0080 | C31 | 0603 SM CAPACITOR | .1 uF |
| 1 | VCA-0097 | C25 | SIZE D TANTALUM | 22 uF/35 V |
| 2 | VCB-0023 | RN6 RN11 | 2 RESISTOR SM NETWORK | 4.7K |
| 1 | VCB-0119 | R3 | 2010 SM RESISTOR | 5.1 |

TABLE 4-continued

| QTY | VANTAGE # | REFERENCE | DESCRIPTION | VALUE |
|---|---|---|---|---|
| 4 | VCB-0133 | R2 R4 R7-8 | 0603 SM RESISTOR | 1K |
| 5 | VCB-0134 | R13 R15 R17 R26 R35 | 0603 SM RESISTOR | 10K |
| 7 | VCB-0135 | R9-10 R16 R18 R20-21 R38 | 0603 SM RESISTOR | 4.7K |
| 1 | VCB-0141 | R5 | 0603 SM RESISTOR | 680 |
| 9 | VCB-0143 | R12 R27-34 | 0603 SM RESISTOR | 100 |
| 2 | VCB-0165 | RN3 RN4 | 4 RESISTOR 0603 SM NETWORK | 1K |
| 1 | VCB-0166 | RN9 | 4 RESISTOR 0603 SM NETWORK | 4.7K |
| 5 | VCB-0170 | RN1 RN5 RN7-8 RN13 | 4 RESISTOR 0603 SM NETWORK | 2.2K |
| 1 | VCB-0188 | R11 | 2010 SM RESISTOR | 22 ohm |
| 1 | VCB-0216 | R19 | 0603 SM RESISTOR | 1 Meg |
| 2 | VCB-0221 | R22-23 | Resistor 2512 5% | 0.5 |
| 1 | VCB-0225 | R24 | 2010 RESISTOR 5% | 2.2K |
| 1 | VCB-0230 | R36 | 0603 SM RESISTOR | 3.3K |
| 1 | VCB-0231 | R25 | 0603 SM RESISTOR | 180 |
| 2 | VCB-0242 | R6 R14 | 0603 SM RESISTOR | 5.1 |
| 1 | VCC-0022 | L1 | Inductor | 100 uH |
| 1 | VCI-0006 | R37 | PTC Fuse | 200 mA |
| 1 | VCI-0010 | F1 | RESETTABLE PTC | 3 A 30 V |
| 1 | VCK-0008 | Y1 | OSCILLATOR | 14.746 MHz |
| 5 | VCL-0007 | CR1-4 CR6 | DUAL HEAD-TO-TAIL DIODE PACKAGE | DAN217 |
| 1 | VCL-0019 | CR7 | SIGNAL DIODE | 1N4148 |
| 1 | VCL-0021 | CR5 | Schottky Diode | DL5818 |
| 1 | VDC-0024 | J10 | HEADER, BERG STICK .100 SPACING | 1x6 |
| 1 | VDC-0175 | B1 | COIN BATTERY RETAINER | Retainer |
| 1 | VDC-0189 | J8 | 40 PIN CONNECTOR | 2x20 |
| 1 | VDC-0244 | J14 | 28 PIN MALE HEADER | PEG28SR |
| 1 | VDC-0245 | J13 | .156 SPACING HEADER | 640445-4 |
| 1 | VFB-0005 | B1 | 3 V BATTERY | 3 V Battery |
| 1 | VFC-0005 | T1 | PCA Pulse Transformer | |
| 1 | VSUB138-B | U4 | VAD-0009 64 Macrocell CPLD-VQFP44 | |

Figure 11A:
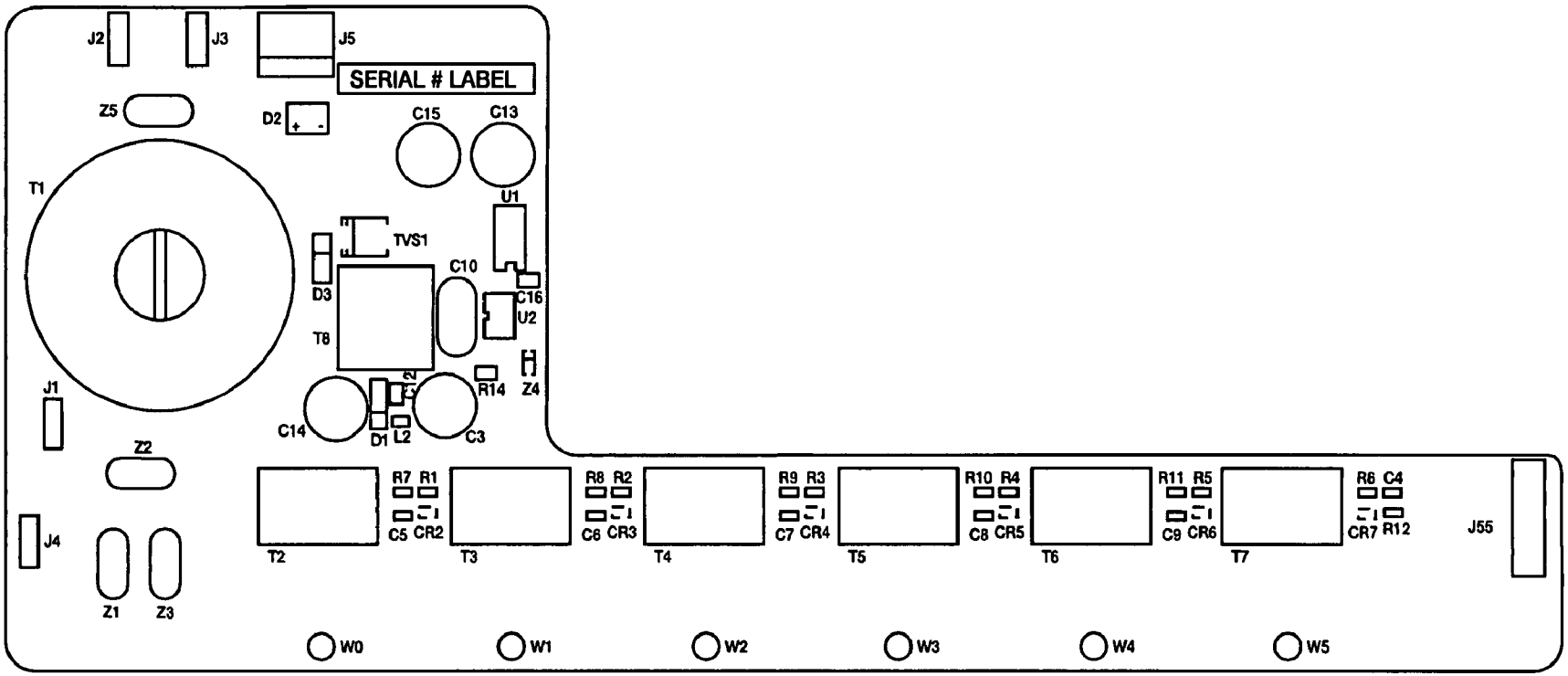
FIGS. 11A-11C illustrate schematics for an exemplary embodiment of the present invention.
Figure 11B:
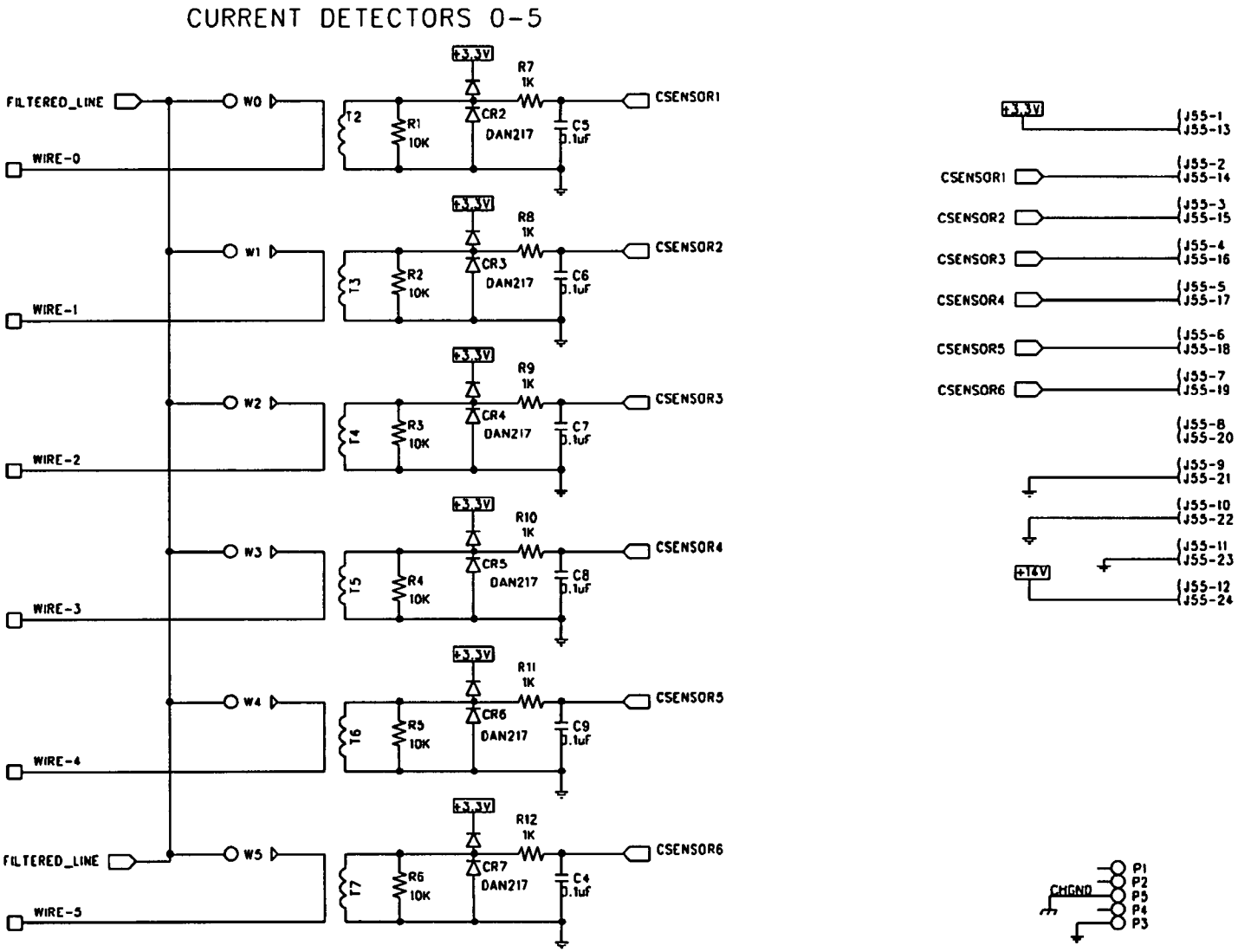
Figure 11C:
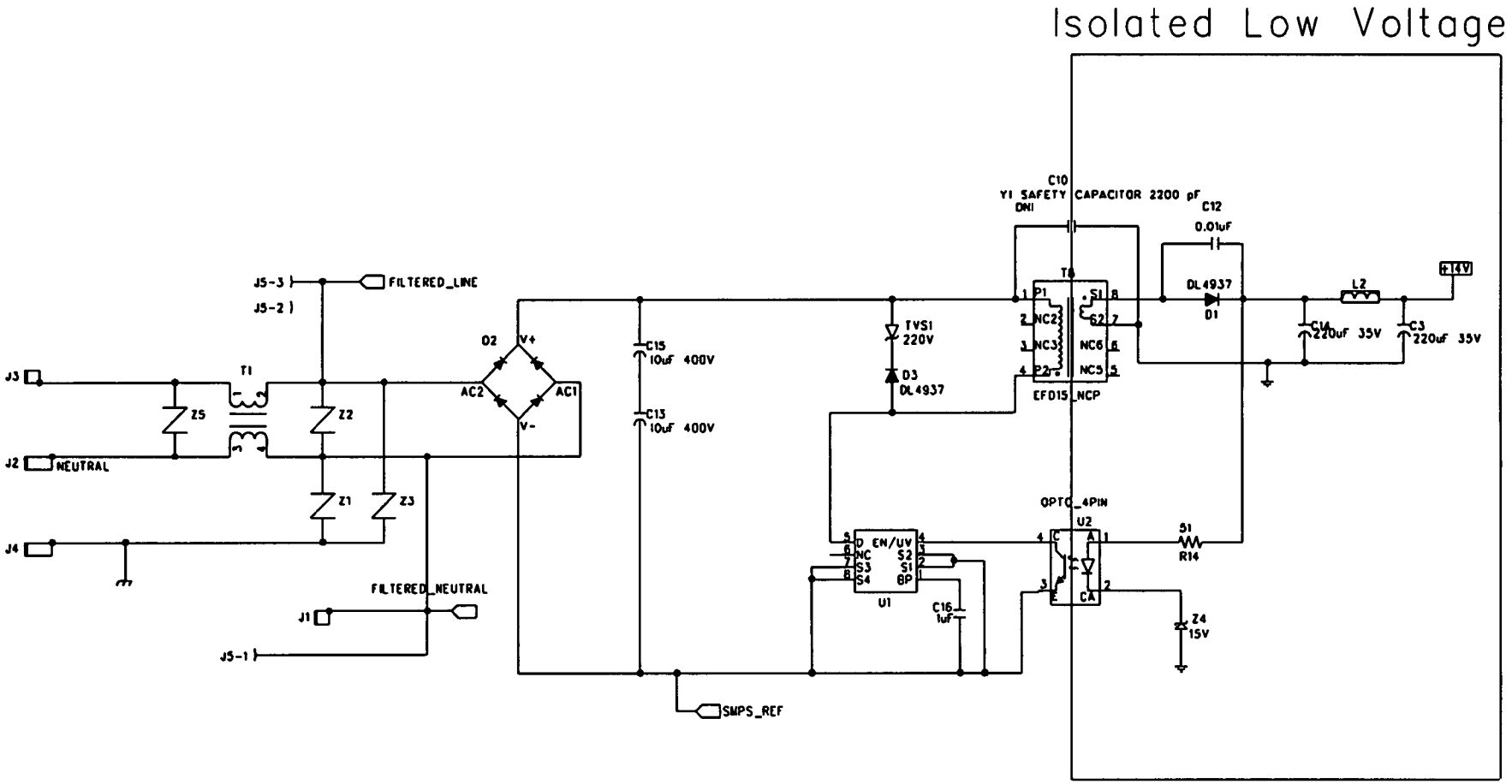

Table 5, below, contains a parts list corresponding to FIGS. 11A-11C.

TABLE 5

| QTY | VANTAGE # | REFERENCE | DESCRIPTION | VALUE |
|---|---|---|---|---|
| 1 | DNI | C10 | Y1 SAFETY CAPACITOR 2200 pF | DNI |
| 1 | DNI | U2 | OPTO-TRANSISTOR, 4-PIN, SMT | DNI |
| 1 | DNI | U1 | LOW POWER OFF-LINE SWITCHER | DNI |
| 1 | DNI | TVS1 | 220 V Tvs | DNI |
| 1 | DNI | C16 | CAPACITOR, SM 0805 | DNI |
| 1 | DNI | C12 | CAPACITOR SM 0805 | DNI |
| 2 | DNI | C13 C15 | Electrolytic Cap. 10 uF 400 V | DNI |
| 2 | DNI | C3 C14 | Electrolytic Cap.LOW ESR. | DNI |
| 1 | DNI | R14 | RESISTOR, SM 0805 | DNI |
| 1 | DNI | T8 | FLYBACK TRANSFORMER | DNI |
| 1 | DNI | L2 | FERRITE BEAD, 180 OHM, 1.5 A | DNI |
| 2 | DNI | D1 D3 | Diode - MELF, 600 V | DNI |
| 1 | DNI | D2 | RECTIFIER 1 AMP SM | DNI |
| 1 | DNI | Z4 | ZENER DIODE, 15 V SOD-123 | DNI |
| 4 | VBZ-0030 | Z1-3 Z5 | MOV SURGE ABSORBER | 275VAC |
| 6 | VCA-0080 | C4-9 | CAPACITOR, SM 0603 | 0.1 uF |
| 6 | VCB-0133 | R7-12 | RESISTOR, SM 0603 | 1K |
| 6 | VCB-0134 | R1-6 | RESISTOR, SM 0603 | 10K |
| 1 | VCC-0016 | T1 | COMMON-MODE CHOKE | MTC66012-04 |
| 6 | VCL-0007 | CR2-7 | DUAL HEAD-TO-TAIL DIODE | DAN217 |
| 6 | VDA-0079 | W0-5 | CURRENT SENSE WIRE 5.25" | |
| 1 | VDC-0145 | J55 | 2x6 HEADER .100 DUAL ENTRY | 2x6 |
| 1 | VDC-0263 | J5 | CONNECTOR, 3 PIN .156 SPACING | |
| 6 | VFC-0008 | T2-7 | Current Sense Transformer | XFMR-1689 |
| 4 | VMDIF009 | J1-4 | Stab connector 1021 .250 MALE | CON-1021 |

Figure 12A:
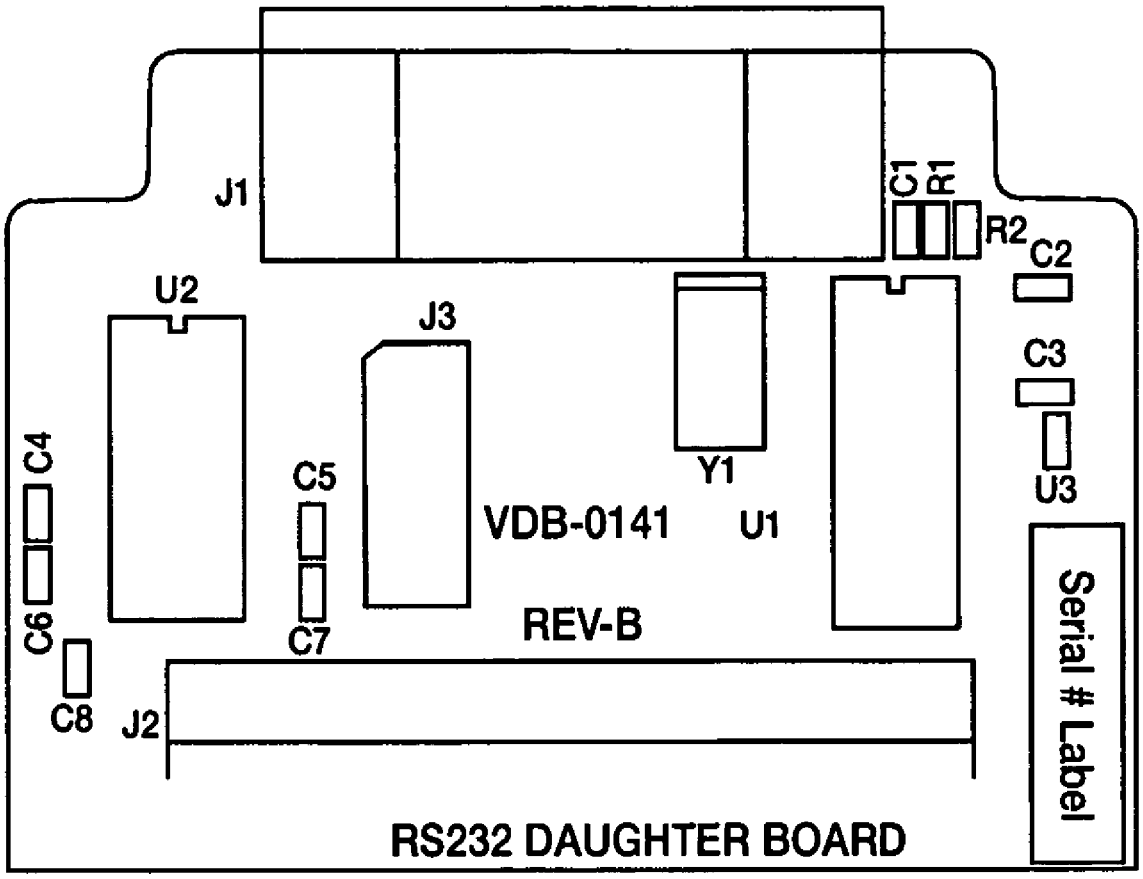
FIGS. 12A and 12B illustrate schematics for an exemplary embodiment of the present invention.
Figure 12B:
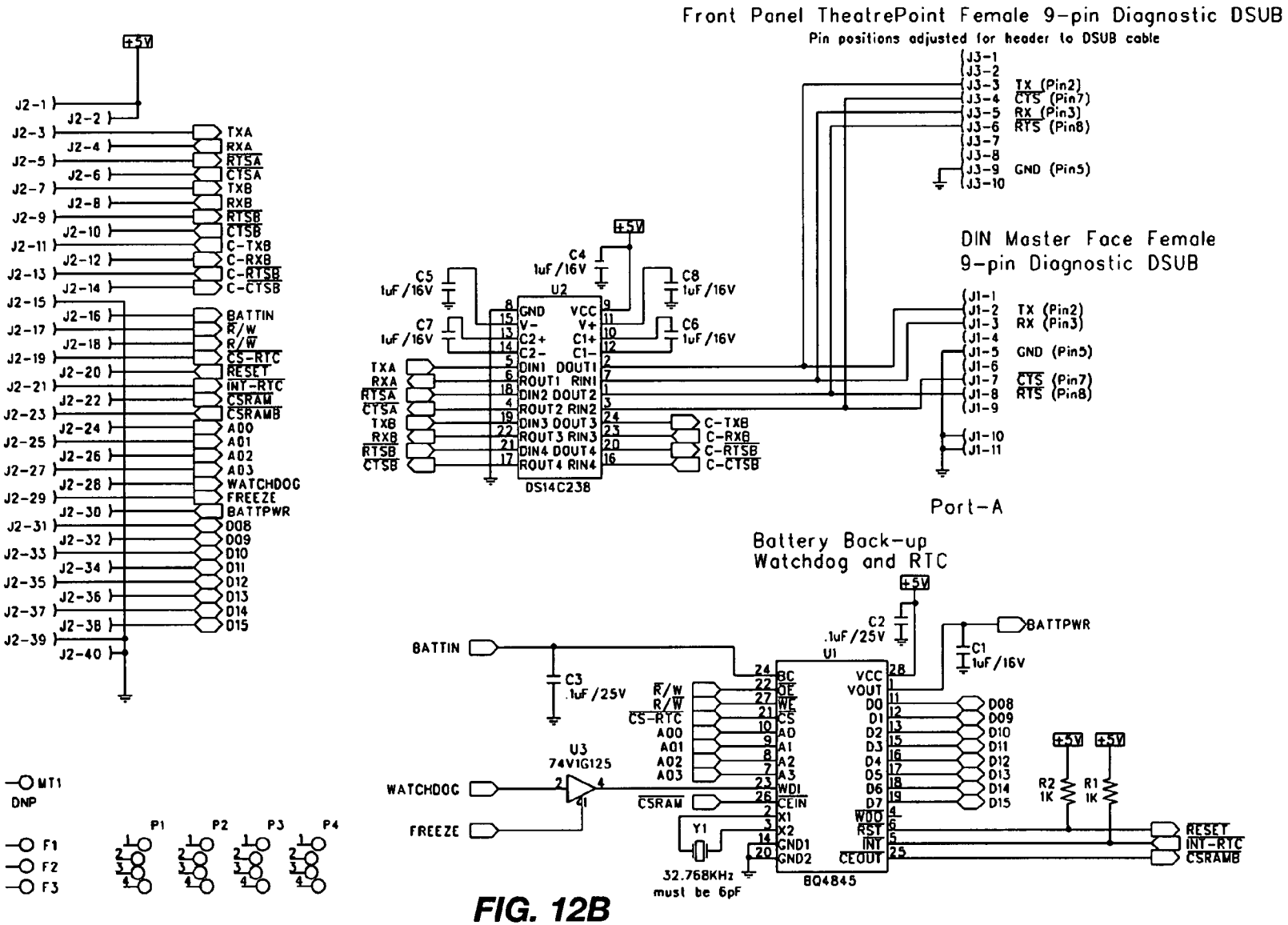
Figure 13A:
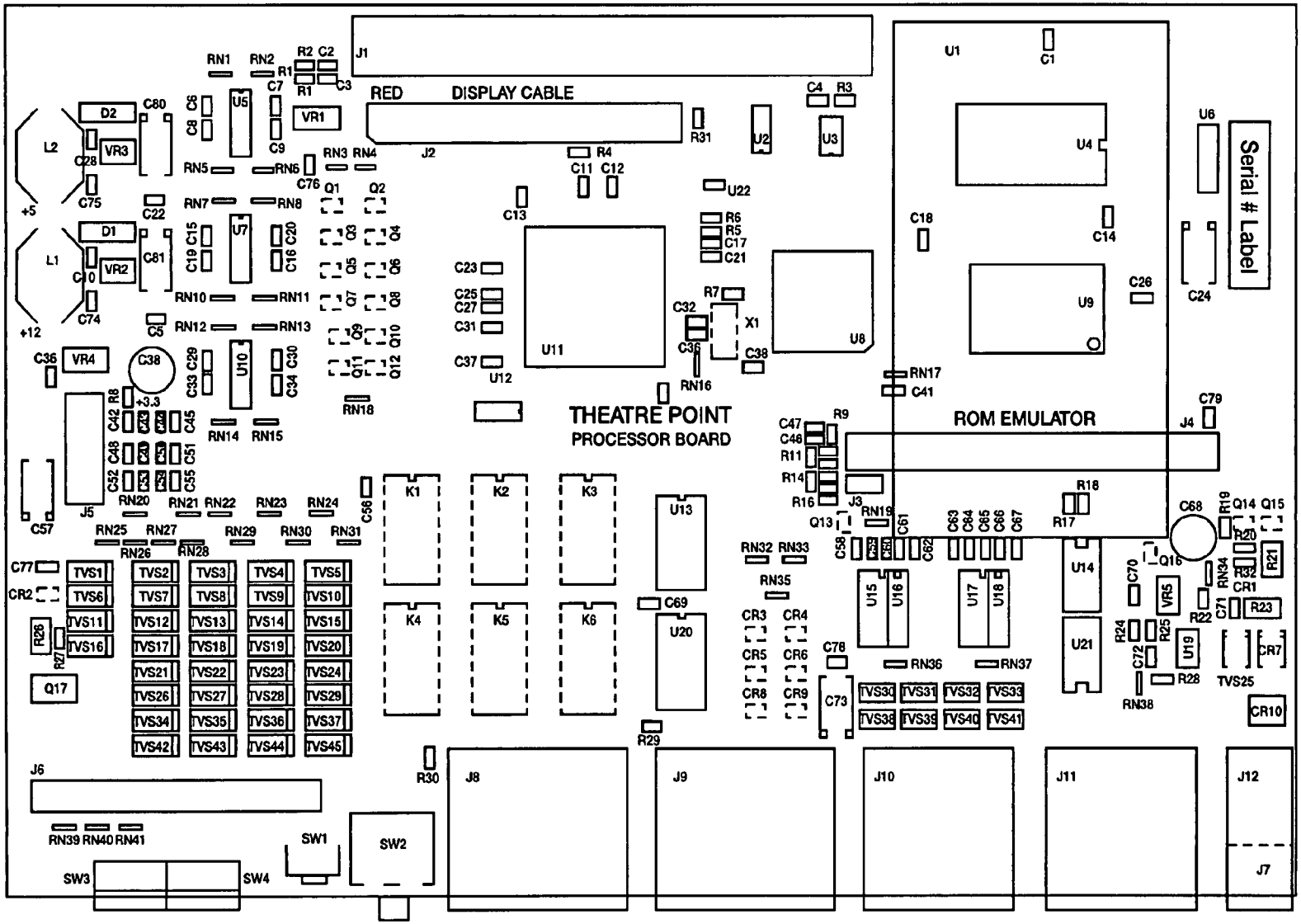
FIGS. 13A-13F illustrate schematics for an exemplary embodiment of the present invention.
Figures 1, 13B:
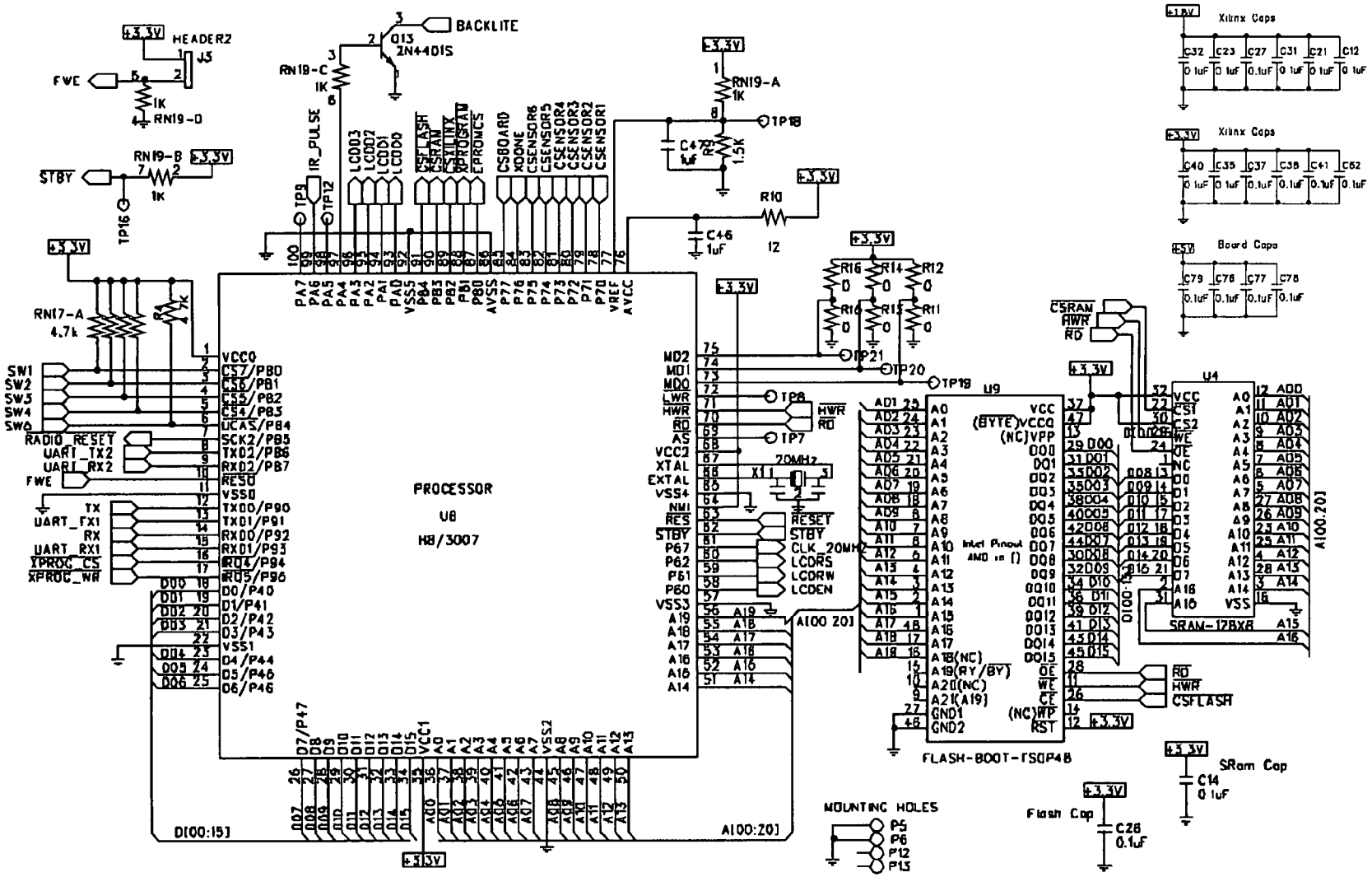
Figures 2, 13B:
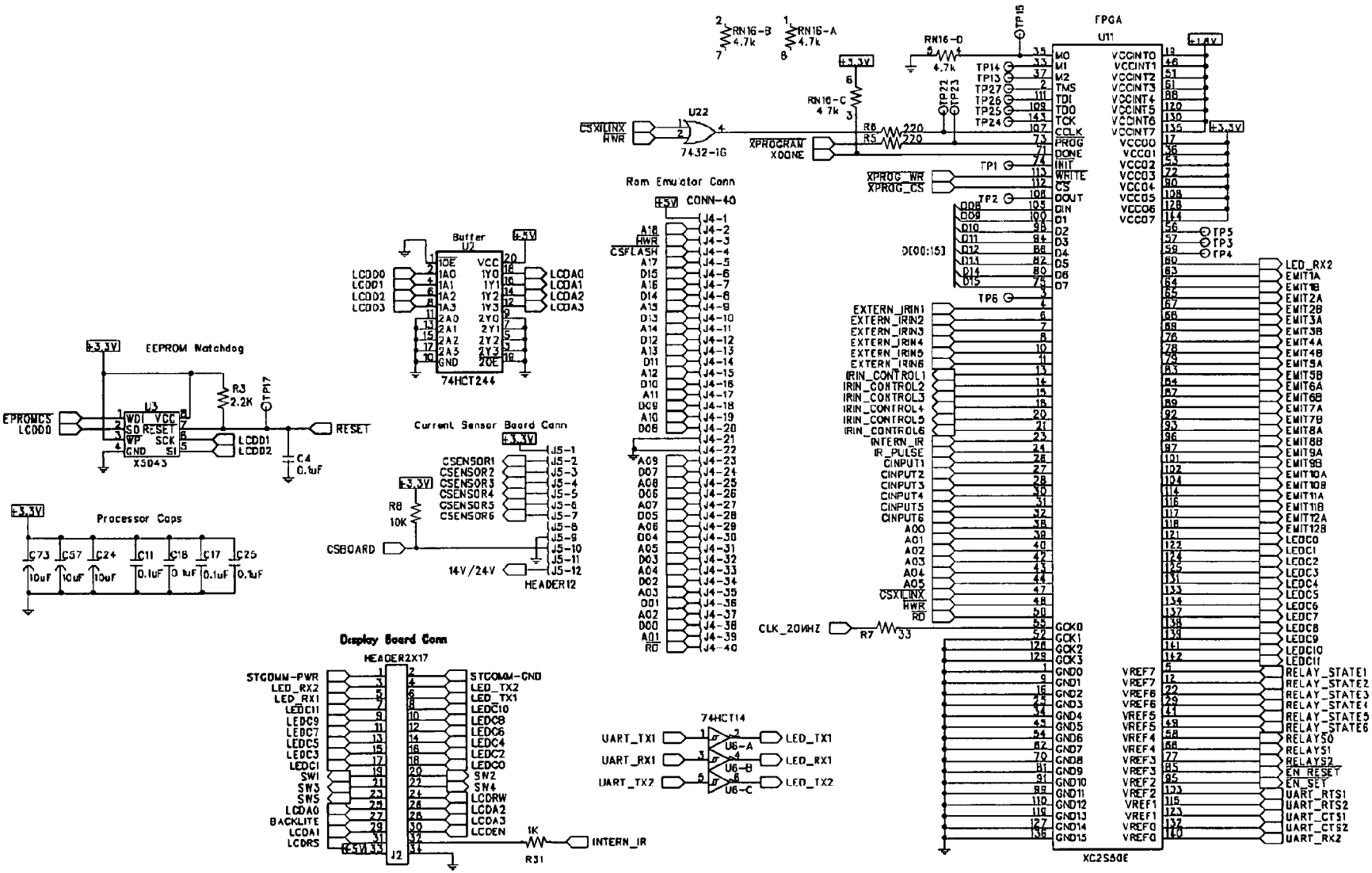
Figures 1, 13C:
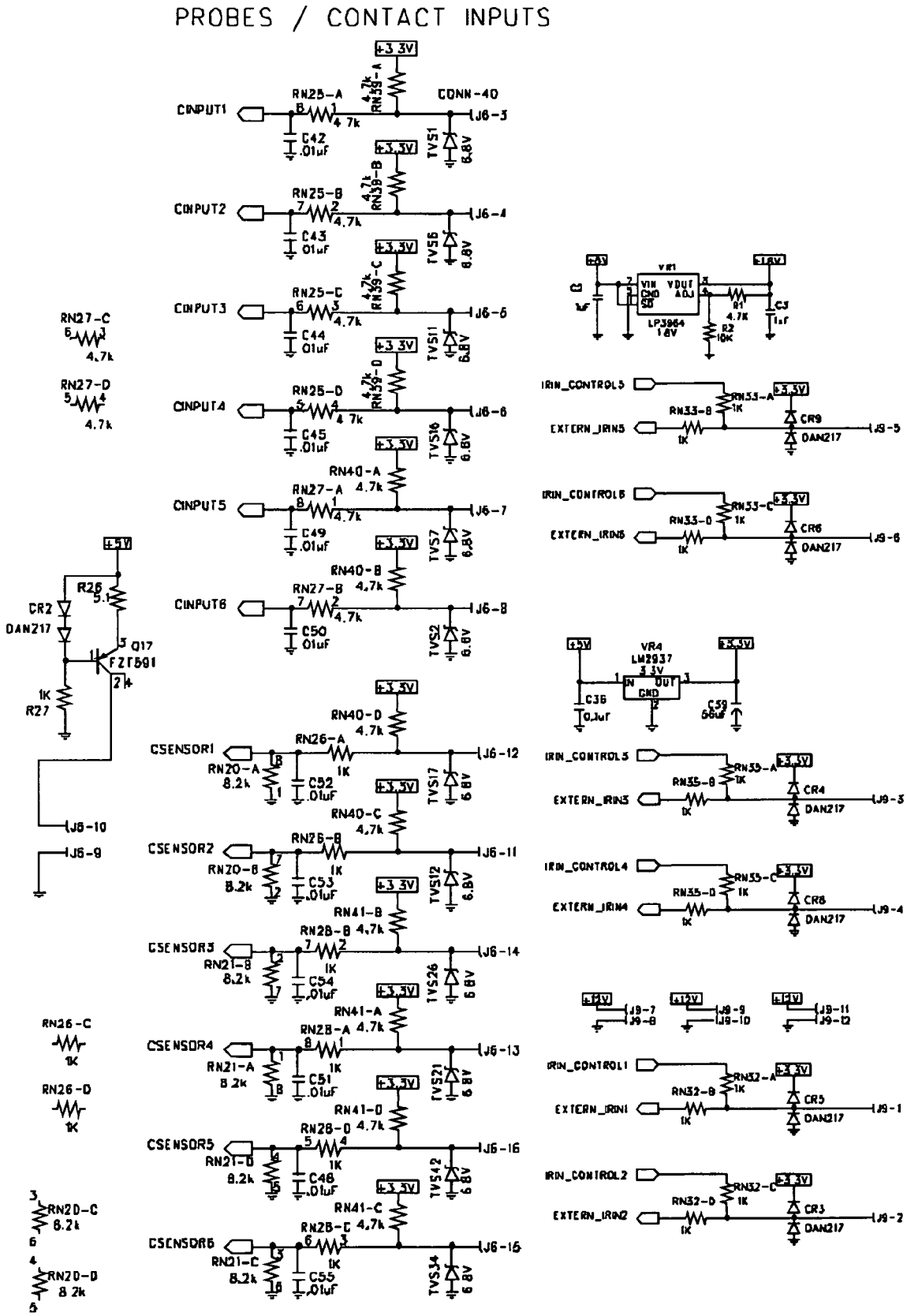
Figures 2, 13C:
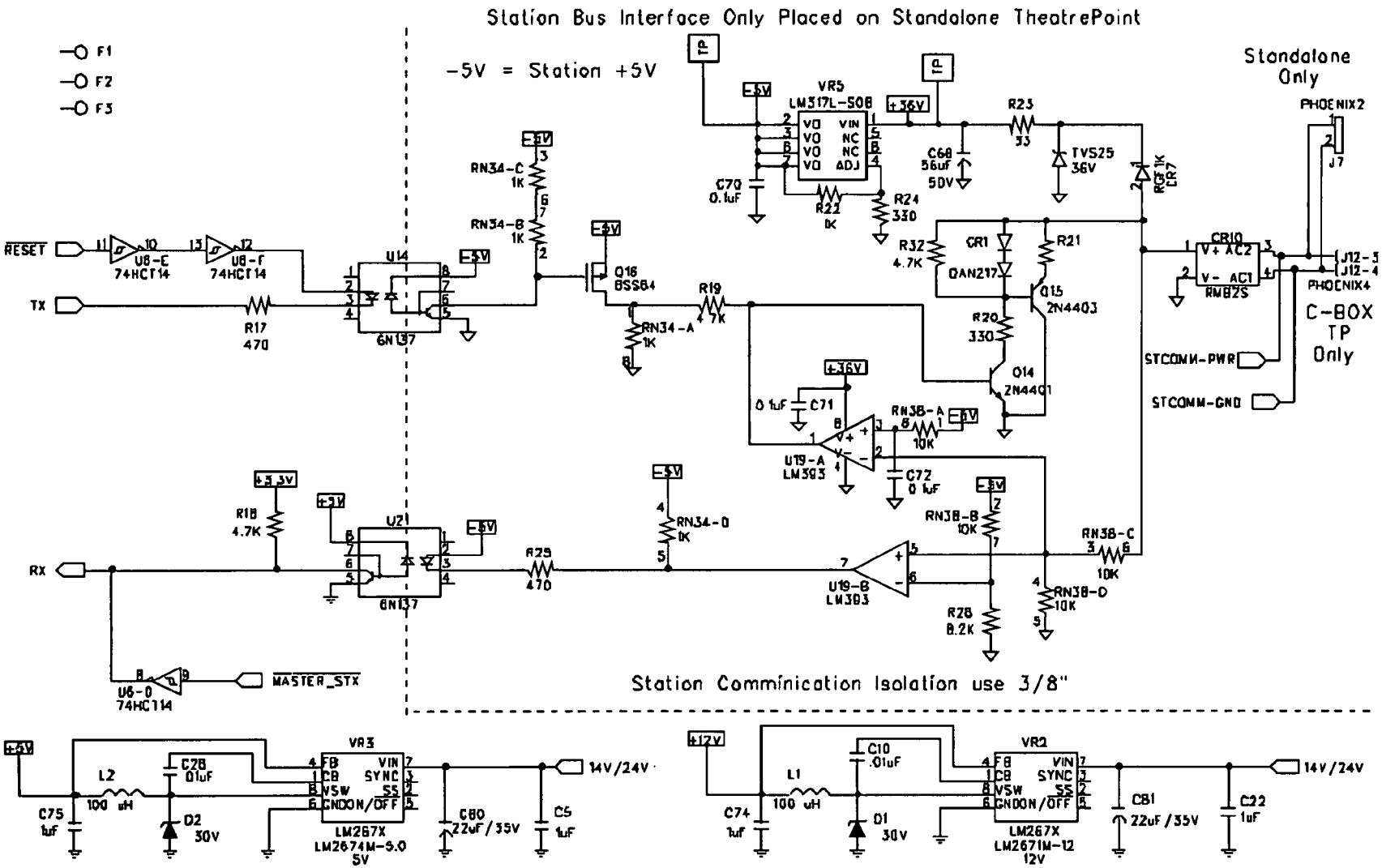
Figure 13D:
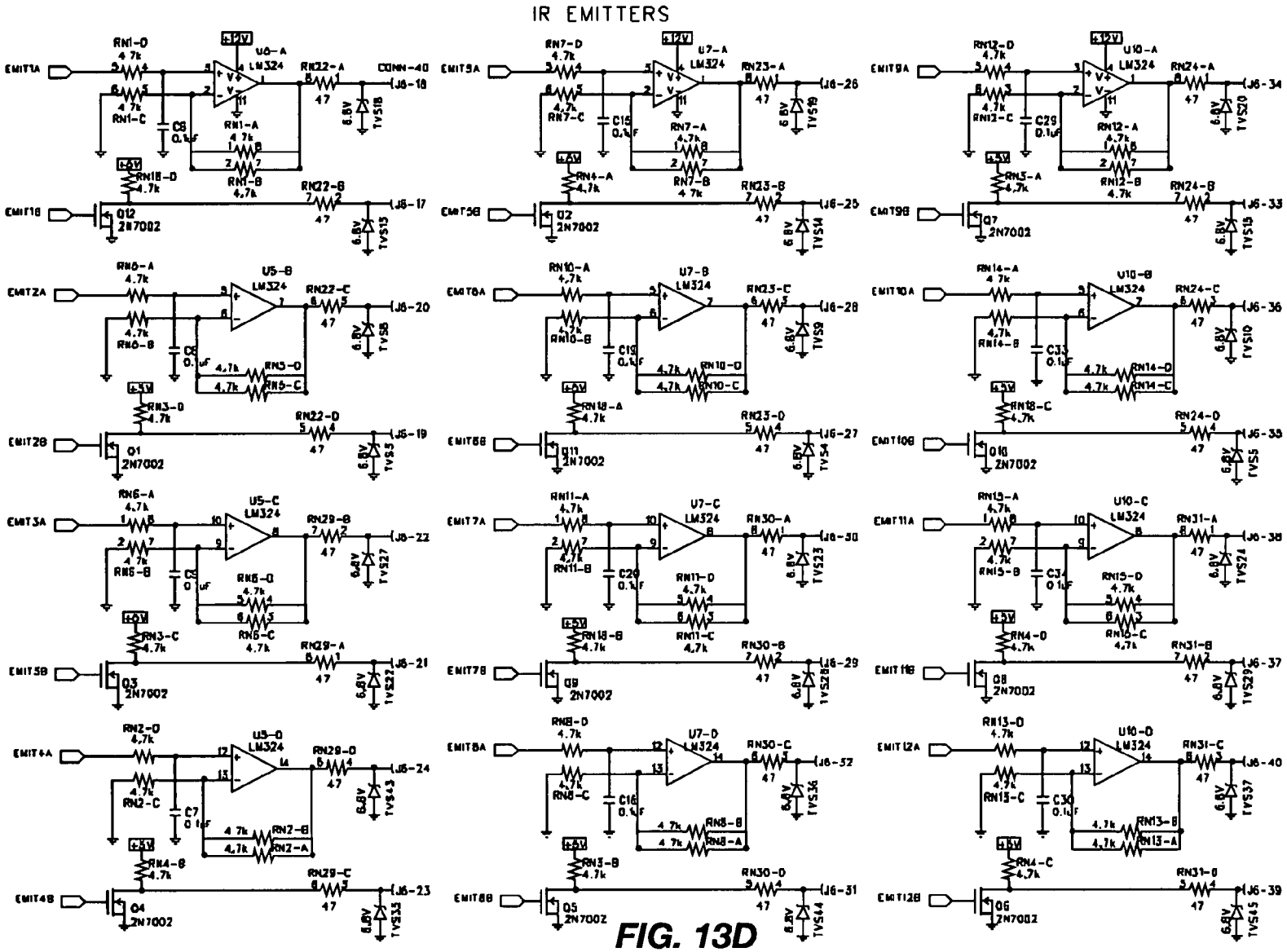
Figure 13E:
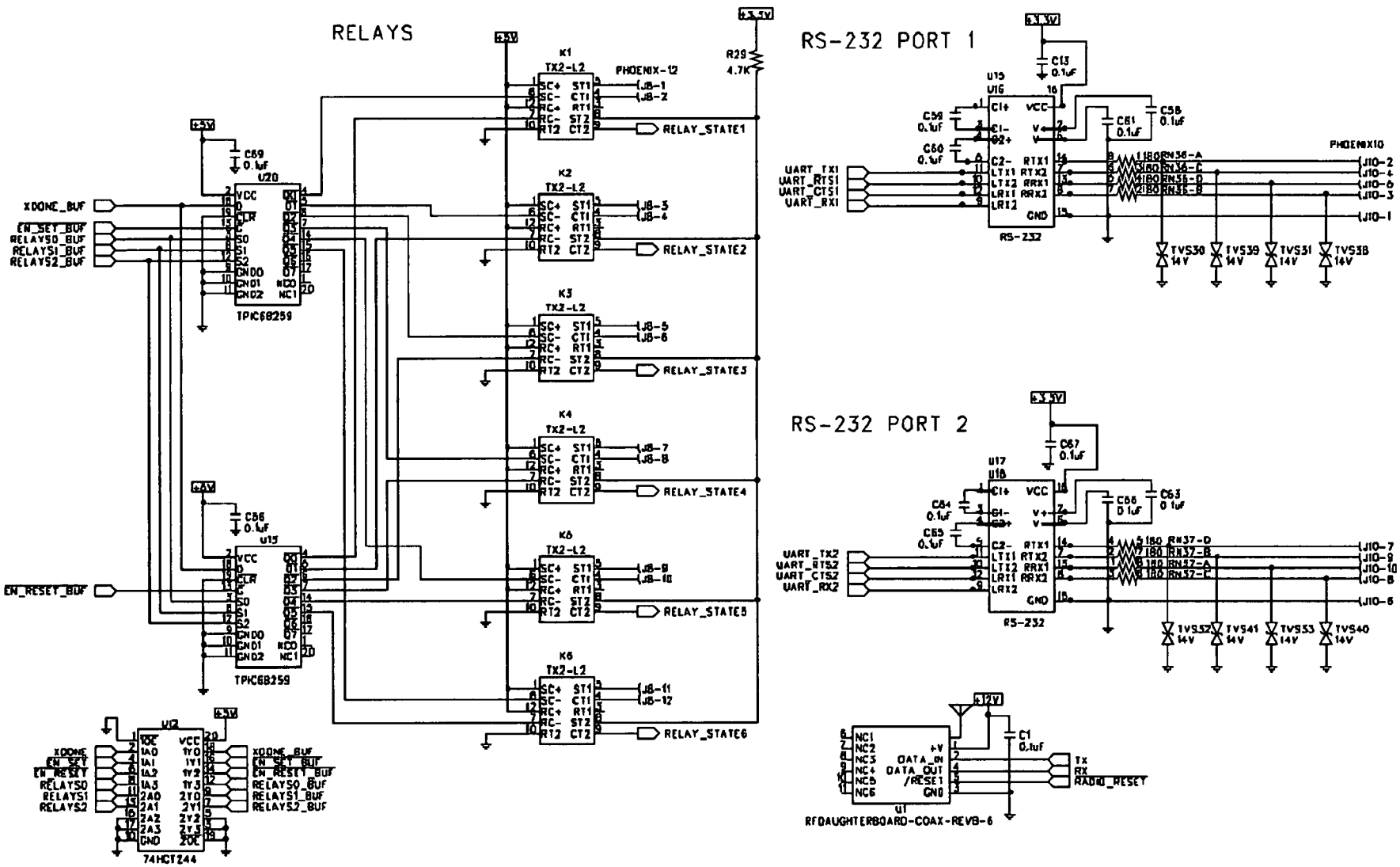
Figure 13F:
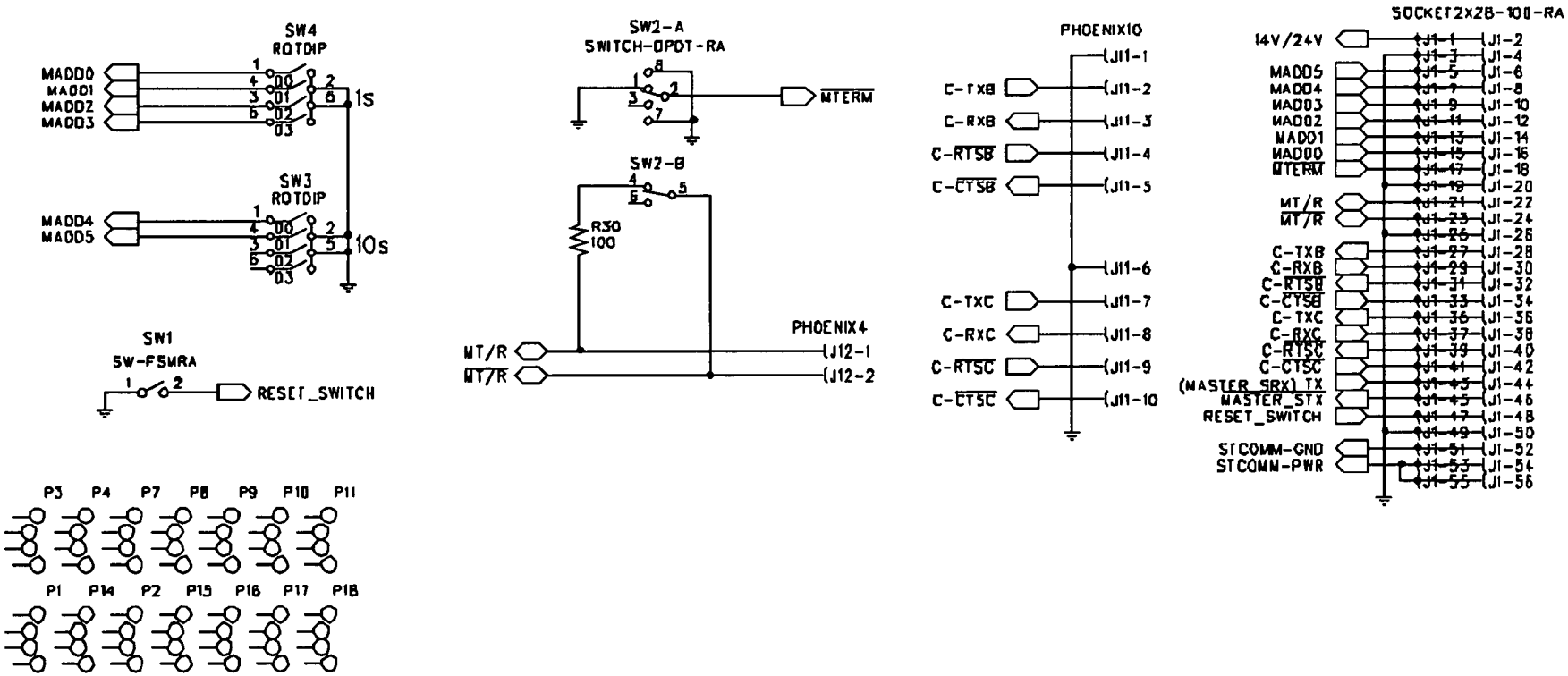

Table 6, below, contains a parts list corresponding to FIGS. 12A and 12B.

TABLE 6

| QTY | VANTAGE # | REFERENCE | DESCRIPTION | VALUE |
|---|---|---|---|---|
| 1 | DNI | J1 | 9-pin female DSUB-Edge Mount | DNI |
| 1 | VAA-0016 | U3 | Single Gate Tri-State Buffer | 74V1G125 |
| 1 | VAZ-0002 | U1 | RTC with uP supervisor & RAM | BQ4845 |
| 1 | VBI-0009 | U2 | RS-232 TRANSCEIVER | DS14C238 |
| 2 | VCA-0043 | C2-3 | CAPACITOR, SM 0603 | .1 uF/25 V |
| 6 | VCA-0110 | C1 C4-8 | CAPACITOR, SM 0603 | 1 uF/16 V |
| 2 | VCB-0133 | R1-2 | RESISTOR, SM 0603 | 1K |
| 1 | VCK-0017 | Y1 | CRYSTAL, SM | 32.768 KHz |
| 1 | VDC-0116 | J3 | 10 PIN 2-ROW HEADER .100 | |
| 1 | VDC-0191 | J2 | 40 PIN CONNECTOR | |

Table 7, below, contains a parts list corresponding to FIGS. 13A-13F.

TABLE 7

| QTY | VANTAGE # | REFERENCE | DESCRIPTION | VALUE |
|---|---|---|---|---|
| 1 | DNI | U1 | RF Daughterboard Coax RevB | DNI |
| 1 | DNI | J4 | 40 PIN CONNECTOR - proto ony | DNI |
| 1 | DNI | J3 | HEADER2 | DNI |
| 2 | DNI | U15 U17 | RS232 LEVEL SHIFTER | DNI |
| 1 | DNI | Q14 | NPN SIGNAL TRANSISTOR | DNI |
| 1 | DNI | Q15 | PNP SIGNAL TRANSISTOR | DNI |
| 1 | DNI | CR10 | Diode Bridge .5 A | DNI |
| 1 | DNI | C68 | CAPACITOR | DNI |
| 3 | DNI | C70-72 | SM CAPACITOR 0603 | DNI |
| 1 | DNI | CR1 | DUAL HEAD-TO-TAIL DIODE | DNI |
| 1 | DNI | CR7 | DOIDE, SMA | DNI |
| 1 | DNI | Q16 | P Channel mosfet | DNI |
| 1 | DNI | U19 | Dual Comparator | DNI |
| 1 | DNI | VR5 | Adjustable Voltage Regulator | DNI |
| 2 | DNI | U14 U21 | Fast Opto-Transistor 1 us | DNI |
| 1 | DNI | J7 | 2-Pin Terminal Block Header | DNI |
| 1 | DNI | R23 | SM RESISTOR 1206 | DNI |
| 7 | DNI | R19-20 R22 R24-25 R28 R32 | SM RESISTOR 0603 | DNI |
| 1 | DNI | R21 | SM RESISTOR 1206 | DNI |
| 2 | DNI | RN34 RN38 | 4 Resistor SM Network 0603 | DNI |
| 3 | DNI | R12, R14, R15 | SM RESISTOR 0603 | DNI |
| 1 | DNI | TVS25 | TVS 600 W SMB | DNI |
| 1 | DNI | U22 | Single Gate 2-Input OR Gate | DNI |
| 1 | VAA-0010 | U6 | HEX SCHMITT-TRIGGER INVERTER | 74HCT14 |
| 2 | VAA-0018 | U13 U20 | Power Logic 8 bit Latch | TPIC6B259 |
| 2 | VAA-0036 | U2 U12 | OCTAL TRI-STATE BUFFER | 74HCT244 |
| 2 | VAB-0036 | U16 U18 | RS232 LEVEL SHIFTER | RS-232 |
| 1 | VAB-0044 | U8 | 16 bit Microprocessor VAB-0044 | 3028 |
| 1 | VAC-0003 | U4 | 128k × 8 SRAM | |
| 1 | VAD-0012 | U11 | FPGA TQ144 | |
| 1 | VAZ-0009 | U3 | RESET W/WATCHDOG AND EEPROM | X5043 |
| 3 | VBA-0003 | U5 U7 U10 | QUAD Single Supply OP AMP | LM324 |
| 12 | VBF-0012 | Q1-12 | N-Channel MosFET | 2N7002 |
| 1 | VBF-0013 | Q17 | transistor | |
| 1 | VBF-0016 | Q13 | NPN SIGNAL TRANSISTOR | 2N4401 |
| 1 | VBH-0011 | VR3 | 260 KHz 5.0 V SWITCHING REG. | 5 V |
| 1 | VBH-0023 | VR4 | Low Dropout Linear Regulator | 3.3 V |
| 1 | VBH-0026 | VR2 | 12 V SWITCHING 269 KHz REG. | 12 V |
| 1 | VBH-0031 | VR1 | Adjustable linear LDO REG. | 1.8 V |
| 36 | VBZ-0007 | TVS1-24 TVS26-29 TVS34-37 TVS42-45 | TVS Uni-directional | 6.8 V |
| 8 | VBZ-0008 | TVS30-33 TVS38-41 | BIDIRECTIONAL TVS | 14 V |
| 3 | VCA-0002 | C24 C57 C73 | SM CAPACITOR 0603 | 10 uF |
| 1 | VCA-0003 | C39 | CAPACITOR | 56 uF |
| 14 | VCA-0061 | C10 C28 C42-45 C48-55 | SM CAPACITOR 0603 | .01 uF |
| 8 | VCA-0078 | C2-3 C5 C22 C46-47 C74-75 | SM CAPACITOR 0603 | 1 uF |

TABLE 7-continued

| QTY | VANTAGE # | REFERENCE | DESCRIPTION | VALUE |
|---|---|---|---|---|
| 49 | VCA-0080 | C1 C4 C6-9 C11-21 C23 C25-27 C29-38 C40-41 C56 C58-67 C69 C76-79 | SM CAPACITOR 0603 | 0.1 uF |
| 2 | VCA-0097 | C80-81 | CAPACITOR | 22 uF/35 V |
| 1 | VCB-0032 | R26 | SM RESISTOR 1206 | 5.1 |
| 2 | VCB-0133 | R27 R31 | SM RESISTOR 0603 | 1K |
| 2 | VCB-0134 | R2 R8 | SM RESISTOR 0603 | 10K |
| 4 | VCB-0135 | R1 R4 R18 R29 | SM RESISTOR 0603 | 4.7K |
| 3 | VCB-0137 | R11, R13, R16 | SM RESISTOR 0603 | 0 |
| 1 | VCB-0143 | R30 | SM RESISTOR 0603 | 100 |
| 6 | VCB-0165 | RN19 RN26 RN28 RN32-33 RN35 | 4 Resistor SM Network 0603 | 1K |
| 22 | VCB-0166 | RN1-8 RN10-18 RN25 RN27 RN39-41 | 4 Resistor SM Network 0603 | 4.7k |
| 2 | VCB-0168 | RN36-37 | 4 Resistor SM Network 0603 | 180 |
| 2 | VCB-0171 | RN20-21 | 4 Resistor SM Network 0603 | 8.2k |
| 1 | VCB-0199 | R10 | SM RESISTOR 0603 | 12 |
| 1 | VCB-0200 | R3 | SM RESISTOR 0603 | 2.2K |
| 1 | VCB-0202 | R7 | SM RESISTOR 0603 | 33 |
| 1 | VCB-0203 | R17 | SM RESISTOR 0603 | 470 |
| 6 | VCB-0205 | RN22-24 RN29-31 | 4 Resistor SM Network 0603 | 47 |
| 1 | VCB-0217 | R9 | SM RESISTOR 0603 | 1.5K |
| 2 | VCB-0223 | R5-6 | SM RESISTOR 0603 | 220 |
| 2 | VCC-0022 | L1-2 | Coilcraft SMT power inductor | 100 uH |
| 6 | VCF-0003 | K1-6 | DPDT SM Relay | TX2-L2 |
| 1 | VCG-0027 | SW2 | SWITCH, SLIDE DPDT, PC MTG | |
| 2 | VCG-0028 | SW3-4 | 10 POSITION ROT SWITCH | ROTDIP |
| 1 | VCG-0029 | SW1 | RA MOMENTARY SPST SWITCH | |
| 1 | VCK-0013 | X1 | CERAMIC RESONATOR WITH CAPS | 20 MHz |
| 7 | VCL-0007 | CR2-6 CR8-9 | DUAL HEAD-TO-TAIL DIODE | DAN217 |
| 2 | VCL-0021 | D1-2 | ZENER DIODE | 30 V |
| 1 | VDC-0140 | J2 | 34-Pin Male Header | 2x17 |
| 1 | VDC-0146 | J5 | 2x6 .1 pitch Male Header | 2X6 |
| 1 | VDC-0239 | J6 | 40 PIN FEMALE SOCKET | 2X20 |
| 2 | VDC-0240 | J10-11 | 10-Pin Terminal Block Header | 2x5 |
| 2 | VDC-0241 | J8-9 | 12-Pin Terminal Block Header | 2x6 |
| 1 | VDC-0242 | J12 | 4-Pin Terminal Block Header | 2x2 |
| 1 | VDC-0243 | J1 | Socket - Right Angle 28 pin | 2x28 |
| 1 | VSUB171-A | U9 | Flash 8 Mbit 3 V | 29W800 |

Figure 14A:
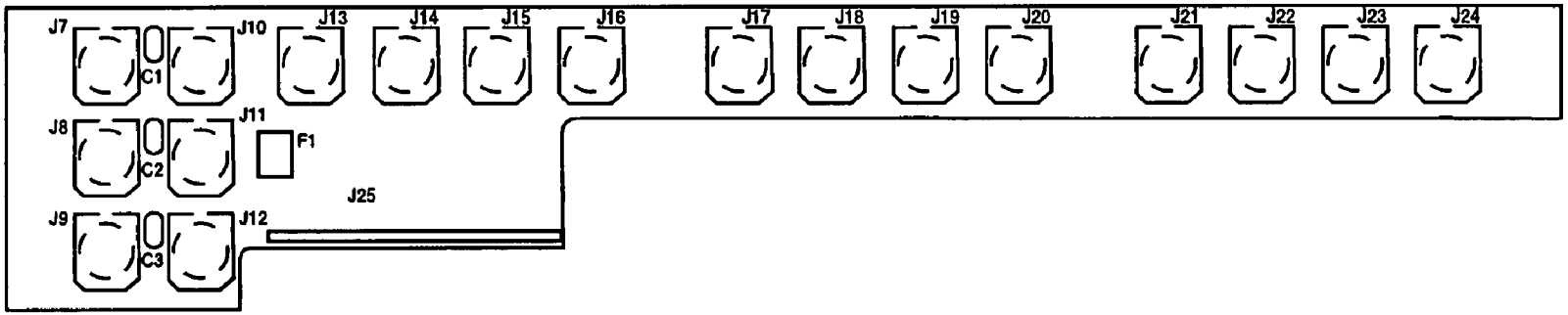
FIGS. 14A-14C illustrate schematics for an exemplary embodiment of the present invention.
Figure 14B:
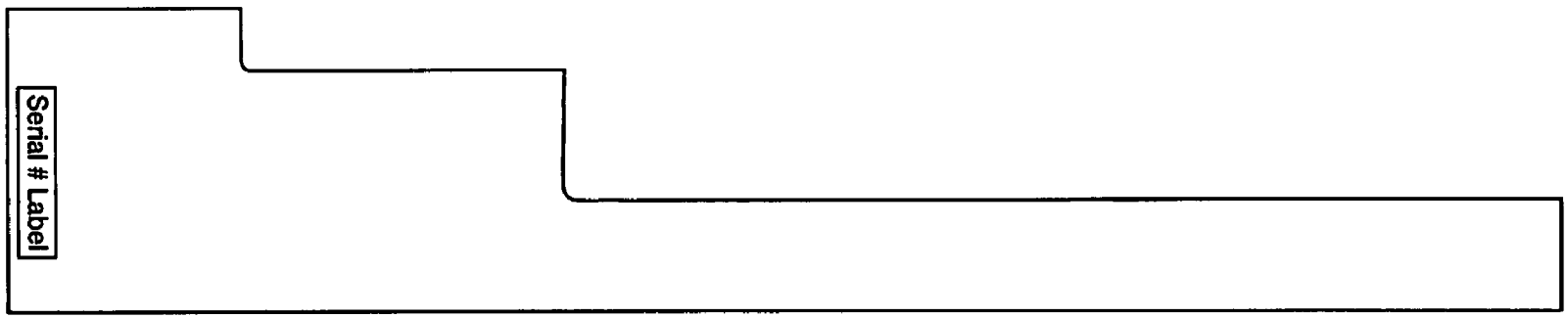
Figure 14C:
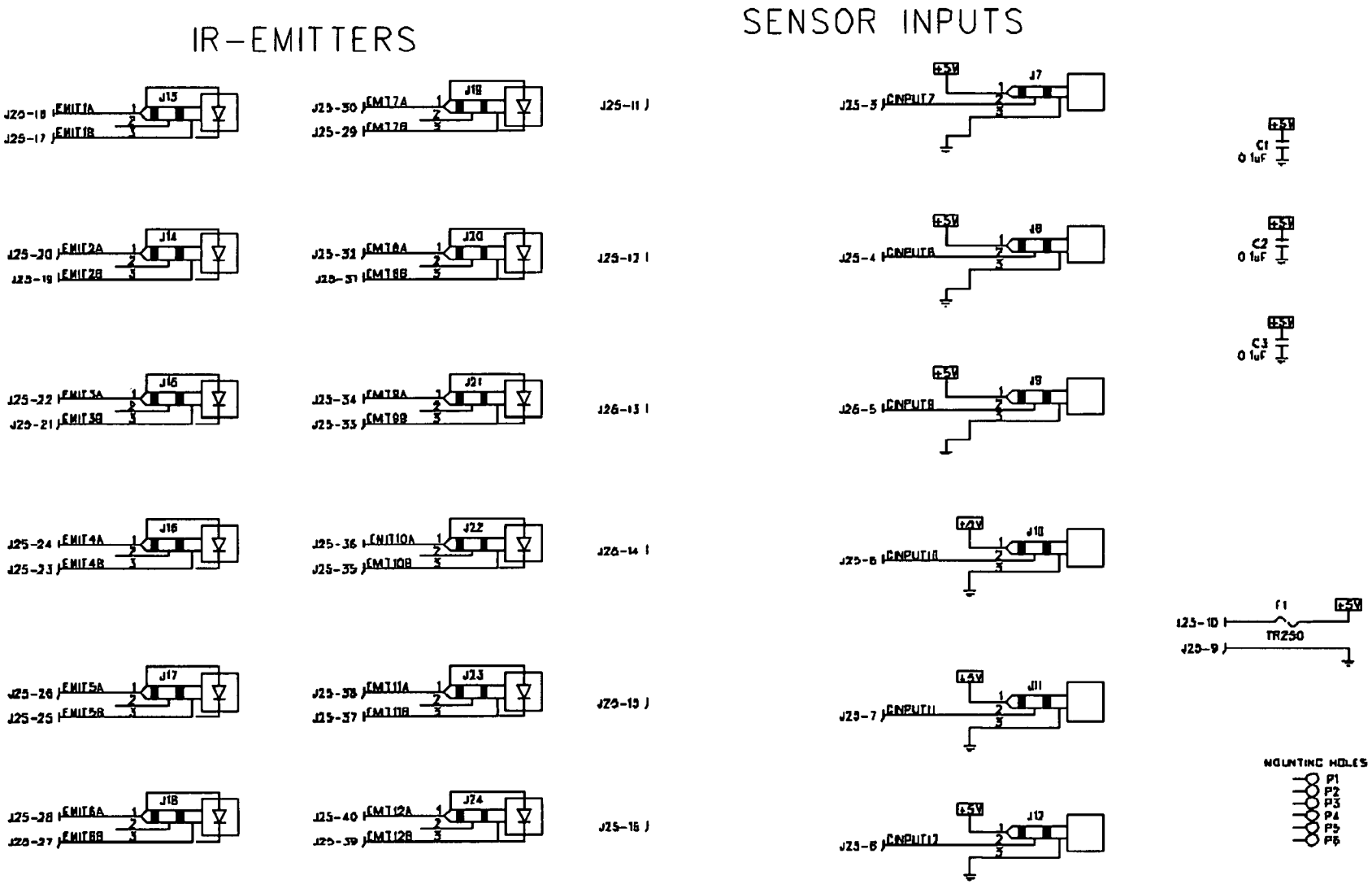

Table 8, below, contains a parts list corresponding to FIGS. 14A-14C.

TABLE 8

| QTY | VANTAGE # | REFERENCE | DESCRIPTION | VALUE |
|---|---|---|---|---|
| 3 | VCA-0092 | C1-3 | CAPACITOR, TH | 0.1 uF |
| 18 | VDC-0110 | J7-24 | 3.5 mm Vertical Phono Jack | LJE-0352-3RT |
| 1 | VDC-0262 | J25 | 40 PIN MALE CONNECTOR | 2x20 |
| 1 | VMRA006 | F1 | RESETABLE FUSE | RT250-120 |

Those having ordinary skill in the relevant art will appreciate the advantages provided by the features of the present invention. For example, it is a feature of the present invention to provide a complete home automation system. Another feature of the present invention to provide such a low cost means for retrofitting a three-way switch with an automation system. It is a further feature of the present invention, in accordance with one aspect thereof, to provide a universal power supply for wall mounted dimmers.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been shown in the drawings and described above with particularity and detail, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A control apparatus comprising:

an integrated controller having an antenna, an IR receiver, at least one IR output and a current sensing outlet;

the antenna configured to send RF control signals to at least a first station, the first station connected to at least a first electrical device;

the IR receiver configured to receive IR control signals from a remote;

the at least one IR output configured to pass the IR signals received by the IR receiver to at least a second electrical device;

the current sensing outlet configured to sense when an attached third electrical device is drawing current;

wherein the first electrical device is controlled by RF control signals sent by the antenna to the first station, and the second electrical device is controlled by IR signals sent by the at least one IR output;

wherein the integrated controller is programmed to send a RF control signal to the first station upon sensing a change of state of the third electrical device attached to the current sensing outlet;

wherein the first station includes a first dimmer means and the first electrical device is a first light; and wherein upon sensing that power to the third electrical device attached to the current sensing outlet has been turned on, the integrated controller is programmed to send a RF control signal to the first station to dim the first light.

2. The apparatus of claim 1, wherein the integrated controller further includes at least one RS-232 port, the at least one RS-232 port configured to provide two way communication with an input device.

3. The apparatus of claim 1, wherein the integrated controller further includes at least one IR input, the at least one IR input configured to connect to an external IR receiver.

4. The apparatus of claim 1, wherein the integrated controller further includes at least one low voltage relay, the at least one low voltage relay configured to send a control signal to a second station having a controller for an electric motor; and wherein the integrated controller is programmed to send a control signal via the at least one low voltage relay to the second station upon sensing a change of state of the third electrical device attached to the current sensing outlet; and wherein upon sensing that power to the third electrical device attached to the current sensing outlet has been turned on, the integrated controller is programmed to send a control signal via the at least one low voltage relay to the second station to activate the electric motor to open or close a shade or blind.

5. The apparatus of claim 1, wherein the integrated controller further includes at least one contact input, the at least one contact input configured to receive data from a fourth electrical device, said data actuating one of the first, second, third or fourth electrical devices.

6. The apparatus of claim 1, wherein the integrated controller further includes a bus outlet, said bus outlet: (i) connected to a second station, and (ii) configured to send a control signal to the second station, the second station connected to a fourth electrical device;

wherein upon sensing a change of state of the third electrical device attached to the current sensing outlet, the integrated controller is programmed to send a control signal via the bus outlet to the second station.

7. The apparatus of claim 6, wherein the second station includes a controller for an electric motor; and wherein upon sensing that power to the third electrical device attached to the current sensing outlet has been turned on, the integrated controller is programmed to send a control signal via the bus outlet to the second station to activate the electric motor to open or close a shade or blind.

8. The apparatus of claim 1, wherein the integrated controller further includes an LCD display.

9. The apparatus of claim 1, wherein the integrated controller further includes a status indicator for the at least one IR output.

10. The apparatus of claim 1, wherein the integrated controller further includes a computing means for tracking real time and astronomical time.

11. The apparatus of claim 1, wherein the RF control signals are transmitted using a digital spread frequency.

12. The apparatus of claim 11, wherein the RF control signals are transmitted using frequency hopping.

13. The apparatus of claim 1, wherein the RF control signals are transmitted at about 900 MHZ.

14. The apparatus of claim 1, wherein the antenna is configured to receive an RF control signal.

15. The apparatus of claim 14, wherein the first station is capable of transmitting an RF control signal to the antenna.

16. The apparatus of claim 1, wherein the integrated controller further includes: (i) at least one low voltage relay, the at least one low voltage relay configured to send a control signal to a second station connected to a fourth electrical device, and (ii) a bus outlet connected to a third station, the bus outlet configured to send a control signal to the third station, the third station connected to a fifth electrical device;

wherein upon sensing a change of state of the third electrical device attached to the current sensing outlet, the integrated controller is programmed to send a control signal: (i) via the at least one low voltage relay to the second station, and (ii) via the bus outlet to the third station.

17. The apparatus of claim 16, wherein the second station includes a controller for an electric motor;

wherein the third station includes a second dimmer means and the fifth electrical device is a second light;

wherein upon sensing that power to the third electrical device attached to the current sensing outlet has been turned on, the integrated controller is programmed to send a control signal: (i) via the at least one low voltage relay to the second station to activate the electric motor to open or close a shade or blind, and (ii) via the bus outlet to the third station to dim the second light.

18. A control system comprising:

an integrated controller, said integrated controller having an antenna configured to receive and send RF transmissions, said integrated controller further including a current sensing outlet, a bus outlet, an IR receiver and an IR output, said IR output in communication with at least a first electrical device;

at least a first station in communication with the antenna, the first station controlling power from a power supply to at least a second electrical device connected to the first station, the first station having an antenna to send and receive RF transmissions;

a remote for sending IR signals to the IR receiver, said IR signals passing from the IR receiver to at least the first electrical device;

the current sensing outlet configured to sense when an attached third electrical device is drawing current;

the bus outlet connected to a second station, the bus outlet configured to send a control signal to the second station, the second station connected to a fourth electrical device;

wherein the second electrical device connected to the first station is controlled by RF control signals sent from the integrated controller and the first electrical device is controlled by IR control signals sent by the IR output;

wherein the first station includes a first dimmer means and the second electrical device is a first light;

wherein the second station includes a first controller for a first electric motor; and wherein upon sensing that power to the third electrical device attached to the current sensing outlet has been turned on, the integrated controller is programmed to: (i) send a RF control signal to the first station to dim the first light, and (ii) send a control signal via the bus outlet to the second station to activate the first electric motor to open or close a shade or blind.

19. The system of claim 18 wherein the integrated controller further includes at least one low voltage relay, the at least one low voltage relay configured to send a control signal to a third station having a fifth electrical device; and wherein upon sensing that power to the third electrical device attached to the current sensing outlet has been turned on, the integrated controller is programmed to send a control signal via the at least one low voltage relay to the third station.

20. The system of claim 19 wherein the third station includes a second controller for a second electric motor; and wherein upon sensing that power to the third electrical device attached to the current sensing outlet has been turned on, the integrated controller is programmed to send a control signal via the at least one low voltage relay to the third station to activate the second electric motor to open or close a shade or blind.

21. The system of claim 18 wherein the integrated controller further includes an RS-232 port.

22. The system of claim 18 wherein the integrated controller further includes contact inputs.

23. The system of claim 18 wherein the integrated controller further includes an LCD display.

24. The system of claim 18 wherein the integrated controller further includes a battery backup.

25. A control apparatus comprising;

an integrated controller having an IR receiver; at least one IR output; a current sensing outlet; and a bus outlet;

a remote for sending IR signals to the IR receiver, the IR signals passing from the IR receiver to at least a first electrical device in communication with the at least one IR output;

the current sensing outlet configured to sense when an attached second electrical device is drawing current;

the bus outlet connected to a first station, the bus outlet configured to send a control signal to the first station, the first station connected to a third electrical device;

wherein the first electrical device is controlled by IR control signal sent by the at least one IR output;

wherein the first station includes a first dimmer means and the third electrical device is a light; and wherein upon sensing that power to the second electrical device attached to the current sensing outlet has been turned on, the integrated controller is programmed to send a control signal via the bus outlet to the first station to dim the light.

26. A control apparatus comprising:

an integrated controller, the integrated controller having an antenna configured to receive and send RF transmissions, the integrated controller further including a current sensing outlet, a bus outlet, a low voltage relay, an IR receiver and an IR output, the IR output in communication with at least a first electrical device;

at least a first station in communication with the antenna, the first station connected to at least a second electrical device;

a remote for sending IR signals to the IR receiver, said IR signals passing from the IR receiver to at least the first electrical device;

the current sensing outlet configured to sense when an attached third electrical device is drawing current;

the bus outlet connected to a second station, the bus outlet configured to send a control signal to the second station, the second station connected to a fourth electrical device;

the low voltage relay configured to send a control signal to a third station connected to a fifth electrical device;

wherein the second electrical device connected to the first station is controlled by RF control signals sent from the integrated controller and the first electrical device is controlled by IR control signals sent by the at least one IR output;

wherein the first station includes a first dimmer means and the second electrical device is a first light;

wherein the second station includes a second dimmer means and the fourth electrical device is a second light;

wherein the third station includes a controller for an electric motor;

wherein upon sensing that power to the third electrical device attached to the current sensing outlet has been turned on, the integrated controller is programmed to: (i) send a RF control signal to the first station to dim the first light, (ii) send a control signal via the bus outlet to the second station to dim the second light, and (iii) send a control signal via the low voltage relay to the third station to activate the electric motor to open or close a shade or blind.

27. The apparatus of claim 26, wherein the integrated controller further includes at least one RS-232 port, the at least one RS-232 port configured to provide two way communication with an input device.

28. The apparatus of claim 26, wherein the integrated controller further includes at least one IR input, the at least one IR input configured to connect to an external IR receiver.

29. The apparatus of claim 26, wherein the integrated controller further includes at least one contact input, the at least one contact input configured to receive data from an external device, said data actuating one of the first, second, third, fourth or fifth electrical devices.

30. The apparatus of claim 26, wherein the integrated controller further includes an LCD display.

31. The apparatus of claim 26, wherein the integrated controller further includes a status indicator for the IR output.

32. The apparatus of claim 26, wherein the integrated controller further includes a computing means for tracking real time and astronomical time.

33. The apparatus of claim 26, wherein the integrated controller further includes a battery backup.

34. The apparatus of claim 26, wherein the RF control signals are transmitted using a digital spread frequency.

35. The apparatus of claim 34, wherein the RF control signals are transmitted using frequency hopping.

36. The apparatus of claim 26, wherein the RF control signals are transmitted at about 900 MHZ.

37. The apparatus of claim 26, wherein each station is configured to transmit RF control signals to the antenna.

* * * * *